US009799162B2

(12) United States Patent
Fotevski

(10) Patent No.: US 9,799,162 B2
(45) **Date of Patent: *Oct. 24, 2017**

(54) SYSTEM, METHOD, AND APPARATUS FOR THE ELECTRONIC OPERATION, MANAGEMENT, SPONSORSHIP, ADVERTISING, PROMOTION, MARKETING, AND REGULATION OF GAMES OF CHANCE ON A NETWORK

(71) Applicant: Nemisys Networks, LLC, Orchard Park, NY (US)

(72) Inventor: David Fotevski, Orchard Park, NY (US)

(73) Assignee: Nemisys Networks LLC, Orchard Park, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/972,156

(22) Filed: Dec. 17, 2015

(65) Prior Publication Data

US 2016/0104348 A1 Apr. 14, 2016

Related U.S. Application Data

(63) Continuation of application No. 14/510,412, filed on Oct. 9, 2014, now Pat. No. 9,248,369, which is a (Continued)

(51) Int. Cl.

| | |
|---|---|
| ***A63F 9/24*** | (2006.01) |
| ***G07F 17/32*** | (2006.01) |
| ***A63F 3/08*** | (2006.01) |

(52) U.S. Cl.

CPC ..... *G07F 17/3241* (2013.01); *A63F 3/08* (2013.01); *G07F 17/32* (2013.01); *G07F 17/3223* (2013.01); *Y10S 707/942* (2013.01)

(58) Field of Classification Search

CPC ..... G06Q 20/3674; G06Q 20/401; G06Q 30/0261; G07F 17/3239; G07F 17/3241; (Continued)

(56) References Cited

U.S. PATENT DOCUMENTS

| | | | |
|---|---|---|---|
| 6,104,815 | A | 8/2000 | Alcorn |
| 6,645,068 | B1 | 11/2003 | Kelly et al. |

(Continued)

OTHER PUBLICATIONS

Gaming News, Quova, Wagerworks Brings Geography to Online Gaming, Apr. 2, 2002, 2 pages.

(Continued)

*Primary Examiner* — Steve Rowland

(74) *Attorney, Agent, or Firm* — Roach Brown McCarthy & Gruber, P.C.; Kevin D. McCarthy

(57) ABSTRACT

The present invention is directed to a computer network system that allows a user to register for games of chances throughout the country and in accordance with national, state and local laws and ordinances. This system analyses the geographical location and residency information of a user in relation to the geographical access and participation areas permitted, excluded, and restricted for a game of chance as governed by jurisdictional laws, statutes, rules, and regulations. If the user is not located within a permitted area or falls within an excluded or restricted area, the user will not be allowed to access or participate in the game of chance. The ability of the system to limit participation by geographical location is based on user input, data, and variable analysis, and the comparison between the areas where games of chance are permitted, excluded, restricted, and user location and residency, filters data to determine user accessibility to a game of chance, listings, and advertising. The methods and apparatus of this system have applications on the Internet for raffles as well as other conventional games of chance.

28 Claims, 43 Drawing Sheets

Related U.S. Application Data continuation of application No. 13/743,649, filed on Jan. 17, 2013, now Pat. No. 8,900,056, which is a continuation of application No. 13/281,477, filed on Oct. 26, 2011, now Pat. No. 8,382,588, which is a continuation of application No. 11/593,696, filed on Nov. 7, 2006, now Pat. No. 8,066,565.

(60) Provisional application No. 60/735,264, filed on Nov. 10, 2005.

(58) Field of Classification Search
CPC .... G07F 17/329; G07F 17/3223; A63F 13/12; A63F 2300/5546; A63F 2300/5573; G06F 21/31
See application file for complete search history.

(56) References Cited

U.S. PATENT DOCUMENTS

| | | | |
|---|---|---|---|
| 2002/0094858 | A1 | 7/2002 | Yacenda |
| 2002/0138594 | A1 | 9/2002 | Rowe |
| 2003/0125973 | A1 | 7/2003 | Mathews et al. |
| 2007/0055440 | A1 | 3/2007 | Denker et al. |

OTHER PUBLICATIONS

Aherns, "Bill to Ban Gambling Online Gets 4th Chance" The Washington Post, May 25, 2006.
Chan, "Congress Rethinks Its Ban on Internet Gambling" The New York Times, Jul. 28, 2010.

Figure 1
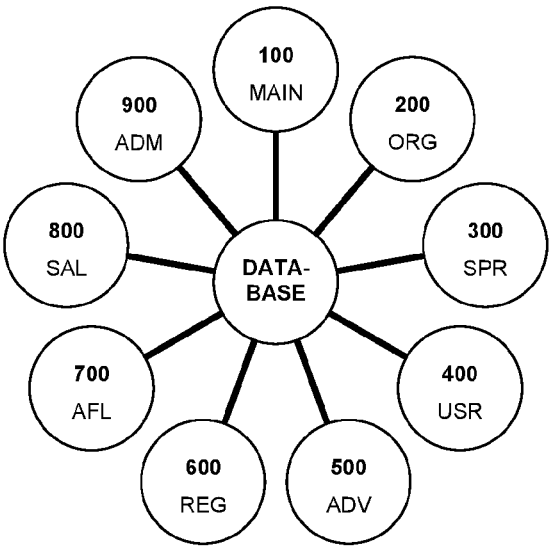
Figure 14
Reference
Figure: 1
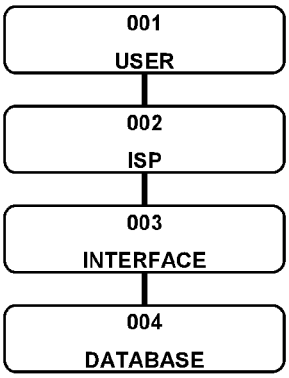
Figure 15
Reference
Figure: 1
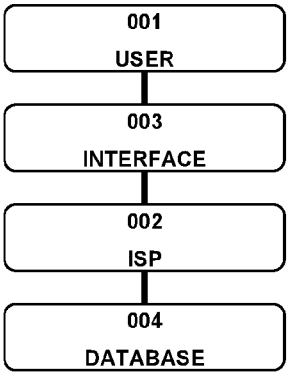
Figure 16
Reference
Figure: 1
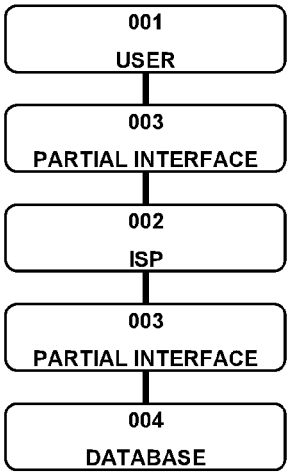

Reference
Figure: 1, Node: 100

Reference
Figure: 2, Node: 101

Reference
Figure: 2, Node: 101

Reference
Figure: 2, Node: 101

Reference
Figure: 2, Node: 101

Reference
Figure: 1, Node: 200

Reference
Figure: 1, Node: 300

Reference
Figure: 4, Node: 303

Reference
Figure: 4, Node: 302

Reference
Figure: 4, Node: 302

Reference
Figure: 1, Node: 400

Reference
Figure: 5, Node: 402

Reference
Figure: 5, Node: 402

Reference
Figure: 1, Node: 500

Reference
Figure: 6, Node: 502

Reference
Figure: 6, Node: 502

Reference
Figure: 6, Node: 502

Reference
Figure: 1, Node: 600

Reference
Figure: 7, Node: 601
Figure: 7, Node: 602
Figure: 7, Node: 603
Figure: 7, Node: 604

Reference
Figure: 1, Node: 700

Reference
Figure: 9, Node: 702

Reference
Figure: 9, Node: 702

Reference
Figure: 9, Node: 702

Reference
Figure: 2, Node: 102

Reference
Figure: 10, Node: 110

Reference
Figure: 10, Node: 108
Figure: 10, Node: 109
Figure: 10, Node: 110
Figure: 10, Node: 111
Figure: 10, Node: 112
Figure: 10, Node: 113

Reference
Figure: 2, Node: 103

Reference
Figure: 11, Node: 103

Reference
Figure: 11, Node: 114

Reference
Figure: 11, Node: 115

Reference
Figure: 2, Node: 104

Reference
Figure: 12, Node: 104

Reference
Figure: 12, Node: 120

Reference
Figure: 12, Node: 121

Reference
Figure: 2, Node: 105

Reference
Figure: 13, Node: 105

Reference
Figure: 13, Node: 105
Figure: 100, Node: 093

Reference
Figures: 17 and 18, Block: 005
Figures: 35 to 49, Block: 007

Reference
Figures: 18 and 20, Block: 007
Figures: 17 to 20, Block: 008

Reference
Figures: 17 and 18, Block: 005
Figures: 22 and 23, Block: 010

Reference
Figures: 17 and 18, Block: 005
Figures: 22 and 23, Block: 010

Reference
Figures: 17 and 18, Block: 005
Figures: 22 and 23, Block: 010

Reference
Figures: 17 and 18, Block: 005
Figures: 22 and 23, Block: 010

Reference
Figures: 17 and 18, Block: 005
Figures: 22 and 23, Block: 010

Reference
Figures: 17 to 20, Block: 006

Reference
Figures: 17 to 20, Block: 006

Reference
Figures: 17 to 20, Block: 006

Reference
Figures: 17 to 20, Block: 006

Reference
Figures: 17 to 20, Block: 006

Reference
Figures: 17 to 20, Block: 006

Reference
Figures: 17 and 19, Block: 006

Reference
Figures: 17 and 19, Block: 006

Reference
Figures: 17 and 19, Block: 006

Reference
Figures: 17 and 19, Block: 006

Reference
Figures: 17 and 19, Block: 006

Reference
Figures: 17 and 19, Block: 006

Reference
Figures: 17 and 19, Block: 006

Reference
Figures: 17 and 19, Block: 006

Reference
Figures: 17 and 19, Block: 006

Reference
Figures: 17 and 19, Block: 006

Reference
Figures: 17 and 19, Block: 006

Reference
Figures: 17 and 19, Block: 006

Reference
Figures: 17 and 19, Block: 006

Reference
Figures: 17 and 19, Block: 006

Reference
Figures: 17 and 19, Block: 006

Reference
Figures: 17 to 20, Block: 006

Reference
Figures: 17 to 20, Block: 006

Reference
Figures: 17 to 20, Block: 006

Reference
Figures: 17 to 20, Block: 006

Reference
Figures: 17 to 20, Block: 006

Reference
Figures: 17 to 20, Block: 006

Reference
Figures: 29 to 31, 36, 38, 40, and 41, Block: 027
Figure: 44, 46, 47, 50, 51, and 52, Block: 033
Figure: 45, 48, 49, 53, 54, and 55, Block: 037

Reference
Figures: 32, 33, 34, 37, 39, 42, and 43, Block: 030
Figures: 44, 46, 47, 50, 51, and 52, Block: 034
Figures: 45, 48, 49, 53, 54, and 55, Block: 036

Reference
Figures: 32, 33, 34, 37, 39, 42, and 43, Block: 030
Figures: 44, 46, 47, 50, 51, and 52, Block: 034
Figures: 45, 48, 49, 53, 54, and 55, Block: 036

Reference
Figures: 32, 33, 34, 37, 39, 42, and 43, Block: 030
Figures: 44, 46, 47, 50, 51, and 52, Block: 034
Figures: 45, 48, 49, 53, 54, and 55, Block: 036

Reference
Figures: 32, 33, 34, 37, 39, 42, and 43, Block: 030
Figures: 44, 46, 47, 50, 51, and 52, Block: 034
Figures: 45, 48, 49, 53, 54, and 55, Block: 036

Reference
Figure: 60, Block: 046

Reference
Figure: 60, Block: 046

Reference
Figure: 60, Block: 046

Figure 64

Reference
Figures: 29, 30, 36, 38, and 40, Block: 028
Figures: 29,31,32,34,35,36,37,38,39,41,42,43,44,45,47,49,50, and 52, Block: 029
Figures: 32, 33, 37, 39, and 42, Block: 031
Figures: 35, Block: 032
Figures: 44, 45, 46, 48, 50, and 51, Block: 035

051
SINGLE PRIZE RAFFLE

Figure 65

Reference
Figures: 29, 30, 36, 38, and 40, Block: 028
Figures: 29,31,32,34,35,36,37,38,39,41,42,43,44,45,47,49,50, and 52, Block: 029
Figures: 32, 33, 37, 39, and 42, Block: 031
Figures: 35, Block: 032
Figures: 44, 45, 46, 48, 50, and 51, Block: 035

052
CHOICE PRIZE RAFFLE

Figure 66

Reference
Figures: 29, 30, 36, 38, and 40, Block: 028
Figures: 29,31,32,34,35,36,37,38,39,41,42,43,44,45,47,49,50, and 52, Block: 029
Figures: 32, 33, 37, 39, and 42, Block: 031
Figures: 35, Block: 032
Figures: 44, 45, 46, 48, 50, and 51, Block: 035

053
MULTIPLE PRIZE RAFFLE

Figure 67

Reference
Figures: 29, 30, 36, 38, and 40, Block: 028
Figures: 29,31,32,34,35,36,37,38,39,41,42,43,44,45,47,49,50, and 52, Block: 029
Figures: 32, 33, 37, 39, and 42, Block: 031
Figures: 35, Block: 032
Figures: 44, 45, 46, 48, 50, and 51, Block: 035

054
MEGA PRIZE RAFFLE

Figure 68
Reference
Figure: 66, Block: 053
Figure: 67, Block: 054

055
EARLY BIRD DRAWINGS

Figure 69
Reference
Figures: 17 to 20, Block: 008

056
ONLINE PARTICIPATION

Figure 70
Reference
Figures: 17 to 20, Block: 008

057
OFFLINE PARTICIPATION

Figure 71
Reference
Figures: 17 to 20, Block: 008

058
ONLINE AND OFFLINE

Figures: 17 to 20, Block: 008

Reference
Figures: 17 to 20, Block: 008

Reference
Figures: 72 and 73, Block: 062

Reference
Figures: 72 and 73, Block: 062

Figure 76
Reference
Figures: 17, 18, Block: 005
Figures: 17 to 20, Block: 006
Figures: 18, 20, Block: 007
Figures: 17 to 20, Block: 008
Figures: 17 to 20, Block: 009

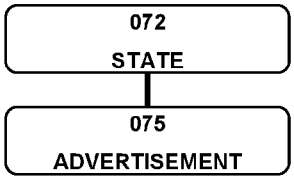

Figure 77
Reference
Figures: 17, 18, Block: 005
Figures: 17 to 20, Block: 006
Figures: 18, 20, Block: 007
Figures: 17 to 20, Block: 008
Figures: 17 to 20, Block: 009

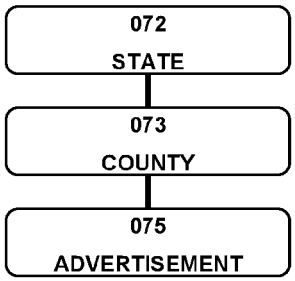

Figure 78
Reference
Figures: 17, 18, Block: 005
Figures: 17 to 20, Block: 006
Figures: 18, 20, Block: 007
Figures: 17 to 20, Block: 008
Figures: 17 to 20, Block: 009

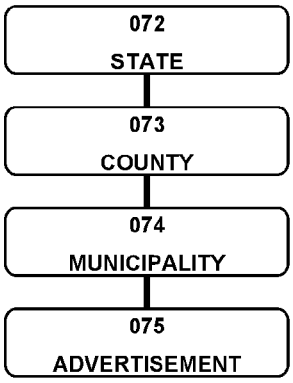

Figure 79
Reference
Figures: 17, 18, Block: 005
Figures: 17 to 20, Block: 006
Figures: 18, 20, Block: 007
Figures: 17 to 20, Block: 008
Figures: 17 to 20, Block: 009

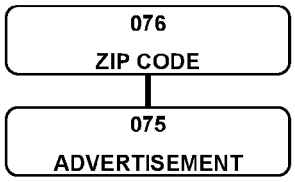

Reference
Figure: 11, Node: 114

Reference
Figure: 11, Node: 115

Reference
Figures: 83 to 86, Block: 006

Reference
Figures: 83 to 86, Block: 006

Reference
Figures: 83 to 86, Block: 006

Reference
Figure: 11, Node: 103
Figure: 82, Block: 081

Reference
Figure: 12, Node: 120

Reference
Figure: 12, Node: 121

Reference
Figure: 92 to 95, Block: 006

Reference
Figure: 92 to 95, Block: 006

Reference
Figure: 92 to 95, Block: 006

Reference
Figure: 12, Node: 104
Figure: 91, Node: 087

Reference
Figure: 2, Node: 107

Figure 103
Reference
Figure: 3, Node: 203
Figure: 69 and 71
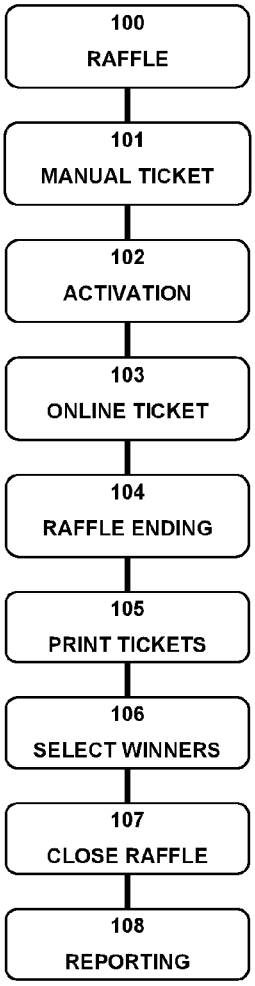
Figure 104
Reference
Figure: 3, Node: 203
Figure: 69, 70, and 71
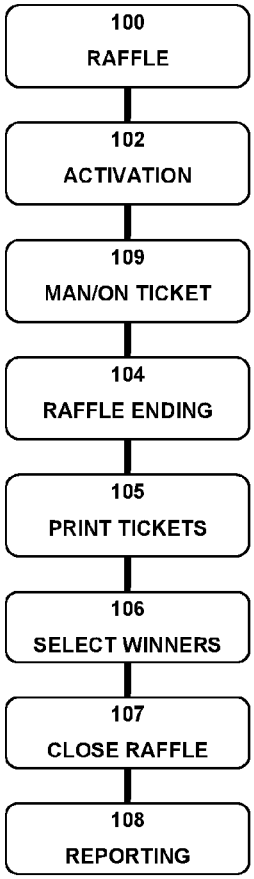
Figure 105
Reference
Figure: 3, Node: 203
Figure: 69
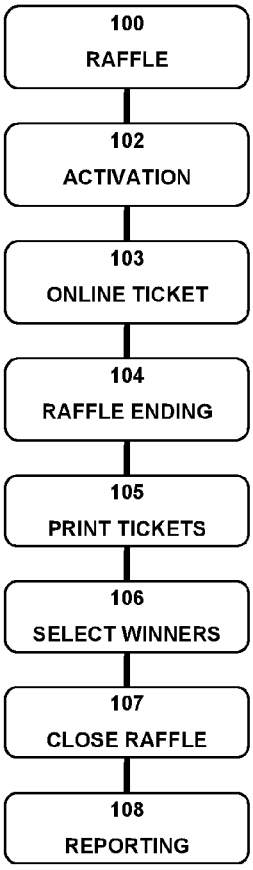

Figure 106
Reference
Figure: 3, Node: 203
Figure: 70
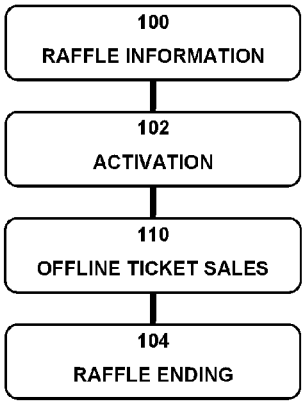
Figure 107
Reference
Figures: 64 to 68
Figure: 103 to 106, Block: 100
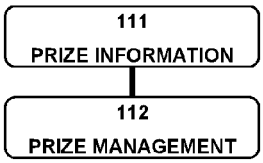
Figure 108
Reference
Figure: 68
Figure: 103 to 106, Block: 100
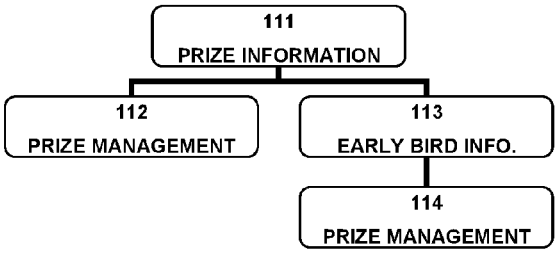

Reference
Figure: 103 to 106, Block: 100

Reference
Figure: 103 to 106, Block: 100

Reference
Figure: 103 to 106, Block: 100

Reference
Figure: 103 to 106, Block: 100

Reference
Figure: 103 to 106, Block: 100

Reference
Figure: 103 to 106, Block: 100

Reference
Figure: 103, Block: 101
Figure: 104, Block: 109

Reference
Figure: 3, Node: 203

Reference
Figure: 3, Node: 203

Reference
Figure: 3, Node: 206

Reference
Figure: 3, Node: 206

Reference
Figure: 3, Node: 206

Reference
Figure: 3, Node: 206

Reference
Figure: 3, Node: 206

Reference
Figure: 128, Block: 143

Reference
Figure: 128, Block: 143

Reference
Figure: 128, Block: 143

Reference
Figure: 6, Node: 503

SYSTEM, METHOD, AND APPARATUS FOR THE ELECTRONIC OPERATION, MANAGEMENT, SPONSORSHIP, ADVERTISING, PROMOTION, MARKETING, AND REGULATION OF GAMES OF CHANCE ON A NETWORK

CLAIM OF PRIORITY

This application claims priority as a continuation application to U.S. patent application Ser. No. 14/510,412 (allowed), filed on Oct. 9, 2014; which is a continuation application to U.S. patent application Ser. No. 13/743,649 (now U.S. Pat. No. 8,900,056 as of Dec. 2, 2014), filed on Jan. 17, 2013; which is a continuation application to U.S. patent application Ser. No. 13/281,477 (now U.S. Pat. No. 8,382,588 as of Feb. 26, 2013), filed on Oct. 26, 2010, which is a continuation of U.S. patent application Ser. No. 11/593,696 (now U.S. Pat. No. 8,066,565 as of Nov. 29, 2011), filed on Nov. 7, 2006, which claims priority to U.S. provisional patent application Ser. No. 60/735,264, filed on Nov. 10, 2005.

FIELD OF INVENTION

The present invention is directed to an internet system that allows individuals to conduct and play games of chance.

BACKGROUND OF THE INVENTION

In the United States of America the conduct, operation, management, and regulation of games of chance are governed by diverse jurisdictional laws, statutes, rules, and regulations. Federal, State, County and Municipal laws, statutes, rules, and regulations govern games of chance for specific regions, and levels of legal jurisdiction, creating a vast diversity in the legality of games of chance across jurisdictional boundaries.

Prior to this system, this has been a major obstacle that has made operating and managing games of chance on a network, particularly the Internet, illegal under a multitude of governing jurisdictions within the United States of America due to the lack of ability to control access to, and participation in, games of chance on the Internet. The Internet has historically given users the ability to access and participate in games of chance easily without restriction, control, or limits placed on accessibility set by applicable governing laws, statutes, rules, and regulations that apply to games of chance.

There are many games of chance operating on the Internet today, most of which operate illegally within not only in the United States of America, but in other countries and across their boundaries as well. These games of chance are accessible by participants without any regional, jurisdictional, or residential controls, filters, or limitations on participation or access, nor is there any electronic regulatory system, method or apparatus in place to monitor games of chance activity on the Internet which spans a multitude of jurisdictions and geographical locations. Games of chance prior to this invention have operated without consideration of the legality and legitimacy of governmental boundaries, and the applicable laws, statues, rules, and regulations that apply to the conduct, operation, and management of games of chance within these boundaries on the Internet which provides virtually unrestricted global reach.

A raffle is a game of chance which is defined as a lottery in which a number of persons buy chances to win a prize.

Although there are many entities offering the sale of raffle tickets using the Internet, none limit their sales by geography or the jurisdictional boundaries of governing laws, statutes, rules, and regulations. These raffles currently operate illegally when consumers purchase raffle tickets on the Internet in an area where the entity conducting the raffle is not allowed to sell, or consumers are not allowed to purchase, raffle tickets under governing jurisdictional laws, statutes, rules, and regulations. The methods and processes used by these other systems are common to the ordinary sale of goods on the Internet and lack the proper filters and controls to help ensure lawful participation in a raffle. These systems may rely on agreements to enforce legal requirements, but do nothing to actually stop participation or limit the reach and accessibility of raffles with regard to user or participant location or residency on the Internet.

Because raffles are specific to charitable and non-profit organizations by the laws, statutes, rules, and regulations within the United States of America, only charitable and non-profit entities may conduct, operate, and manage raffles, and participants may only purchase raffles tickets for raffles conducted by a charitable or non-profit entity that has been authorized to conduct a raffle within the boundaries of the United States of America. The only form of a raffle which is able to be conducted by a for-profit entity in the United States of America is a no purchase necessary sweepstakes type game of chance where entrants may participate without having to purchase a chance to win a prize.

SUMMARY OF THE INVENTION

Prior to this system, there has been no regional, location, or residency filter or access control system to restrict a person from outside the authorized access area from accessing and participating in games of chance as may be required by governing jurisdictions, nor has there been a system that enables the regulation of such activity on the Internet. The invention enables games of chance operation or participation to be conducted within specified regions, jurisdictions, locations, or boundaries. This invention also enables games of chance and participants to abide by and follow diverse jurisdictional laws for the operation of games of chance determined by location and age. This is done by establishing permission, exclusion, or restriction criteria and conditions, and then determining if user's meet these conditions to determine eligibility. For example, if state law only allows the operation of a game of chance in five counties, then only users within those five counties will be able to access or participate in the game of chance. If there is a municipality in one of these five counties that does not allow the operation of the game of chance, this municipality can be excluded or restricted so participants within this municipality will not be able to access or participate in the game of chance. The permission, exclusion, or restriction capabilities of this invention can be specified by permitting, excluding, or restricting locations to target, limit, or extend user access or participation. For example, if there are twenty five counties in a state and you are allowing access or participation to fifteen counties, you are able to either permit the state and exclude or restrict ten of the twenty five counties within the state, or you may alternatively permit fifteen counties within the state. The age of the user is also taken into consideration for the user's location and the governing jurisdiction of the game of chance. Governing jurisdictions may have minimum age requirements for participants of games of chance which determine the eligibility of its residences to participate in games of chance, and the minimum age required for a game of chance to allow participation. For example, if a user is in the State of New York and New York requires its residences to be at least eighteen years of age to participate in a game of chance, then users from the State of New York must meet this condition. If the governing jurisdiction of the game of chance is the State of Nevada, and Nevada requires participants for the game of chance to be at least twenty one years of age, then users from the State of New York will not be able to participate unless they are at least twenty one years of age. The permission, exclusion, or restriction methods and processes are able to be applied to any game of chance which requires determining user eligibility derived from location and age. Although this invention has been applied to raffles as a preferred game of chance, it should not be construed to limit its application to other games of chance.

In a preferred embodiment, the present invention provides a system, methods and an apparatus for the conduct, operation, management, sponsorship, advertising, promotion, and regulation of raffles electronically using an electronic network.

This system comprises of an open network, a system that is open and available to the public at large, and a closed loop network, a system for which each user must be a registered member, through which users are able to operate, manage, sponsor, advertise, participate in, promote, and regulate games of chance. The system resides on a computer on a network that is accessible by other computers on a network. The system is accessible over the Internet. This system comprises a number of user interfaces comprising a number of components and a relational data structure which produce controls and filters that limit the accessibility, participation, advertising, promotion, and regulation of games of chance. System users are grouped as follows:

| User Groups and Types | User Group Description |
|---|---|
| 1. Visitor | Non-Member Users of the System |
| 2. Participant | Member Participants in Games of Chance |
| 3. Organization | Member Entities Operating and Managing Games of Chance |
| 4. Sponsor | Member Entities Sponsoring Games of Chance |
| 5. Advertiser | Member Entities Advertising to Users |
| 6. Regulator | Member Entities Regulating Games of Chance |
| a) Federal Regulator | (Federal Government) |
| b) State Regulator | (State Government) |
| c) County Regulator | (County/Parish Government) |
| d) Municipal Regulator | (City/Towne/Village Government) |
| 7. Account Manager | Membership Account Managers |
| 8. Affiliate | Member Entities Affiliated with Members of the Organization User Group |
| 9. Administrator | Master Administrators for the System |

Each user group accesses the system through various graphical user interfaces to perform tasks which relate to the system for each individual group. Each interface is interconnected to the system by and through a relational or non-relational data structure. The system interfaces filter, control and limit access to only relevant portions of the data structure. Users download system interfaces on to a computer and access open network interfaces freely or access closed loop network interfaces as registered members or users of the system requiring user login. Only registered members or users are able to access closed loop network interfaces or closed loop network sections of system interfaces, and each user group is able to only access the interface, or sections of an interface, for the user's specific user group or user permissions.

The invention comprises permission, exclusion, and restriction methods which are the foundation of the system. The permission, exclusion, and restriction methods compare user location, residency, and age to the permitted, excluded, and restricted locations of operation and the minimum age required for each game of chance to determine user eligibility, access, and participation. The permission, exclusion, and restriction criteria comprise state, county, municipality, and age variables to determine user eligibility, access, and participation. Permission, exclusion, and restriction methods may also be used to target specific markets for advertising and games of chance participation.

User location and residency initialization methods establish, store, or retrieve information about a user's state, county, municipality, and/or age. This stored information is compared to the permit, exclusion, and restriction information stored for games of chance. The information for each user's state, county, and municipality, is compared to the state, county, and municipality permission, exclusion, and restriction information for games of chance to determine user accessibility, eligibility and participation authorization for games of chance. User accessibility, eligibility, and participation for games of chance are determined by the following conditions:

1) "The game of chance is permitted in the user's State" and "the State permission is a State-wide permission or the State does not require permission to operate a game of chance" or;

2) "The game of chance is permitted in the user's County" and "the County permission is a County-wide permission or the County does not require permission to operate a game of chance" or;

3) "The game of chance is permitted in the user's Municipality" or;

4) "The game of chance is permitted in the user's State, County, and Municipality" or;

5) "The game of chance is permitted in the user's State" and "The game of chance is permitted in the user's County or the County permission is a County-wide permission or the County does not require permission to operate a game of chance"

6) And with all of the above conditions, games of chance will not be displayed or accessible to users where the user's State, County or Municipality is excluded, restricted, or denied permission.

7) In addition to the above criteria and conditions, user age validation and verification methods are imposed on user access, eligibility, or participation. Age validation occurs at various points within the system and its methods and processes. One method utilizes the user's State, County, and Municipality to identify the required age to participate in games of chance for the user's location and residency. Another method utilizes the State, County, and Municipality of the governing jurisdiction of the games of chance to identify the required age to access or participate in games of chance. Access to or participation in games of chance is denied if the user does not meet the minimum age requirement to participate in the game of chance as governed by the jurisdiction from which the game of chance is issued permission to operate, or if the user does not meet the minimum age requirement to participate in a game of chance as governed by the jurisdiction of the user's location or residency.

The graphical user interfaces, application programming interfaces, and data structures for the insertion, retrieval, extraction, and manipulation of interrelated data, textual information, and graphical information from local and remote computers, networks, and storage sources, along with the unique State, County, and Municipal identifiers, user age verification, and the access control loops are the foundation of the system.

FIGURE DESCRIPTIONS

FIG. 1 is a radial diagram which illustrates a preferred embodiment of the system architecture, topology, and structure comprising elements as described infra. FIG. 1 comprises FIGS. 14 to 16.

FIG. 2 comprises FIGS. 10, 11, 12, 13, and FIGS. 17 to 79.

FIG. 3 comprises FIGS. 103 to 122.

FIG. 4 comprises FIGS. 123 to 125.

FIG. 5 comprises FIGS. 126 and 127

FIG. 6 comprises FIGS. 128 to 134.

FIG. 7 comprises FIG. 8.

FIG. 9 comprises FIGS. 135 and 137.

FIG. 10 comprises FIGS. 80 and 81.

FIG. 11 comprises FIGS. 82 to 90.

FIG. 12 comprises FIGS. 91 to 99.

FIG. 13 comprises FIGS. 100 to 102.

FIG. 14 is a block diagram which illustrates a sample interface distribution architecture, network topology, and network access structure of the apparatus as described infra, comprising elements as described infra. FIG. 14 comprises Blocks 001 to 004.

FIG. 15 is a block diagram which illustrates a sample interface distribution architecture, network topology, and network access structure of the apparatus as described infra, comprising elements as described infra. FIG. 15 comprises Blocks 001 to 004.

FIG. 16 is a block diagram which illustrates a sample interface distribution architecture, network topology, and network access structure of the apparatus as described infra, comprising elements as described infra. FIG. 16 comprises Blocks 001 to 004.

FIG. 17 comprises Blocks 005, 006, 008, and 009.

FIG. 18 comprises Blocks 005, 006, 007, 008, and 009.

FIG. 19 comprises Blocks 006, 008, and 009.

FIG. 20 comprises Blocks 006, 007, 008, and 009.

FIG. 22 comprises Blocks 010, 011, and 012.

FIG. 23 comprises Blocks 010, 013, 014, and 015.

FIG. 24 comprises Blocks 016, 017, 018, and 019.

FIG. 25 comprises Blocks 020 and 021.

FIG. 26 comprises Block 022.

FIG. 27 comprises Block 023.

FIG. 28 comprises Blocks 024, 025, and 026.

FIGS. 29 to 34 and FIGS. 50 to 55 comprise Blocks 027, 028, 029, 030, 031, 033, 034, 035, 036, and 037.

FIGS. 35 to 49 comprise Blocks 007, 027, 028, 029, 030, 031, 032, 033, 034, 035, 036, and 037.

FIG. 56 comprises Blocks 038 and 039.

FIGS. 57 to 63 comprise Blocks 040, 041, 042, 043, 044, 045, 046, 047, 048, 049, and 050.

FIG. 64 is a block diagram which illustrates a raffle prize type structural component of the apparatus as described infra. FIG. 64 comprises Block 051.

FIG. 65 is a block diagram which illustrates a raffle prize type structural component of the apparatus as described infra. FIG. 65 comprises Block 052.

FIG. 66 is a block diagram which illustrates a raffle prize type structural component of the apparatus as described infra. FIG. 66 comprises Block 053.

FIG. 67 is a block diagram which illustrates a raffle prize type structural component of the apparatus as described infra. FIG. 67 comprises Block 054.

FIG. 68 is a block diagram which illustrates a raffle prize type structural component of the apparatus as described infra. FIG. 68 comprises Block 055.

FIGS. 69 to 71 are block diagrams which illustrate participation method structural components of the apparatus as described infra. FIGS. 69 to 71 comprise Blocks 056, 057, and 058.

FIG. 72 comprises Blocks 059, 060, 061, 062, 063, and 064.

FIG. 73 comprises Blocks 059, 062, 063, 064, 065, and 066.

FIG. 74 comprises Blocks 067, 068, 069, and 070.

FIG. 75 comprises Blocks 067, 071, 068, 069, and 071.

FIGS. 76 to 79 are block diagrams which illustrate sample advertisement display processes of the apparatus as described infra. FIGS. 76 to 79 comprise Blocks 072, 073, 074, 075, and 076.

FIG. 80 comprises Blocks 077 and 078.

FIG. 81 comprises Blocks 077, 079, and 080.

FIG. 82 comprises Blocks 081 and 082.

Figure 83:
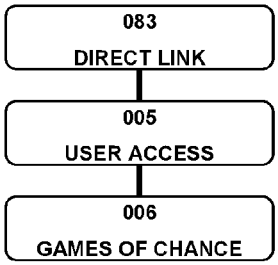
Figure 85:
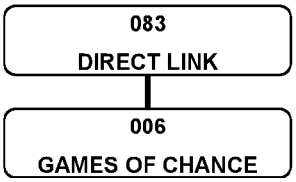

FIGS. 83 and 85 are block diagrams which illustrate sample direct link processes of the apparatus as described infra. FIGS. 83 and 85 comprise Blocks 083, 005, and 006.

Figure 84:
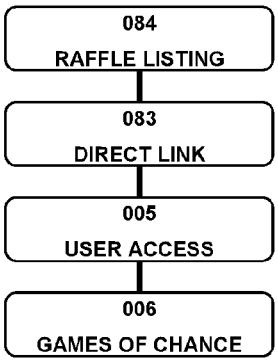
Figure 86:
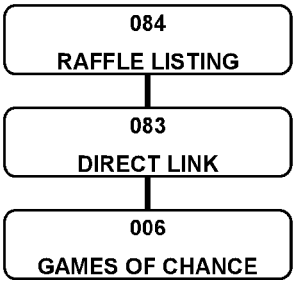

FIGS. 84 and 86 are block diagrams which illustrate sample listing direct link processes of the apparatus as described infra. FIGS. 84 and 86 comprise Blocks 083, 084, 005, and 006.

Figure 87:
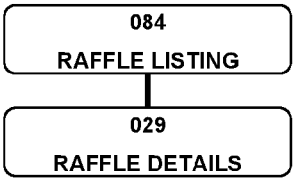
Figure 88:
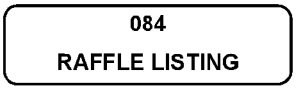
Figure 89:
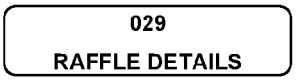

FIGS. 87 to 89 are block diagrams which illustrate sample direct link games of chance access processes of the apparatus as described infra. FIGS. 87 to 89 comprise Blocks 084 and 029.

Figure 90:
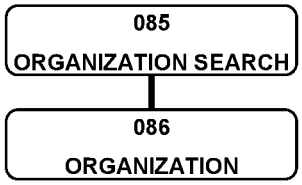

FIG. 90 is a block diagram which illustrates a sample organization directory search process of the apparatus as described infra. FIG. 90 comprises Blocks 085 and 086.

Figure 91:
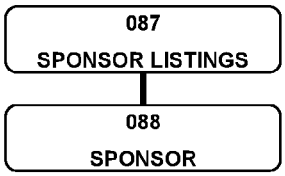

FIG. 91 is a block diagram which illustrates a sample sponsor directory process of the apparatus as described infra. FIG. 91 comprises Blocks 087 and 088.

Figure 92:
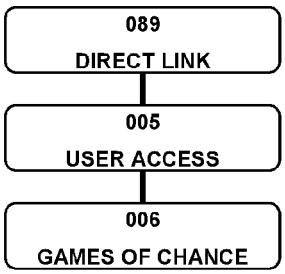
Figure 94:
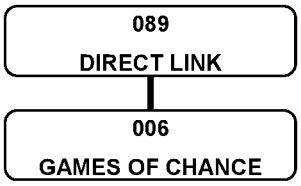

FIGS. 92 and 94 are block diagrams which illustrate sample direct link processes of the apparatus as described infra. FIGS. 92 and 94 comprise Blocks 089, 005, and 006.

Figure 93:
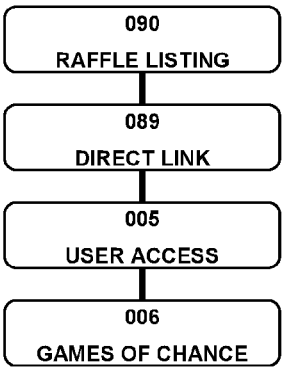
Figure 95:
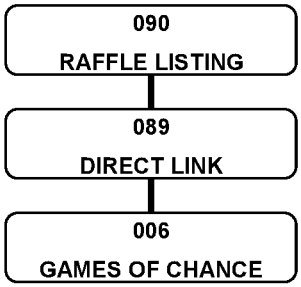

FIGS. 93 and 95 are block diagrams which illustrate sample listing direct link processes of the apparatus as described infra. FIGS. 93 and 95 comprise Blocks 090, 089, 005, and 006.

Figure 96:
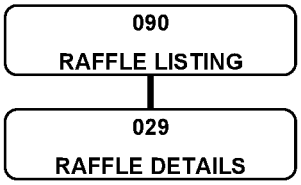
Figure 97:
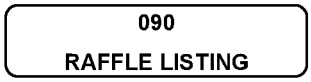
Figure 98:
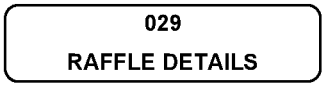

FIGS. 96 to 98 are block diagrams which illustrate sample direct link games of chance access processes of the apparatus as described infra. FIGS. 96 to 98 comprise Blocks 090 and 029.

Figure 99:
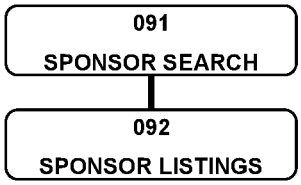

FIG. 99 is a block diagram which illustrates a sample sponsor directory search process of the apparatus as described infra. FIG. 99 comprises Blocks 091 and 092.

Figure 100:
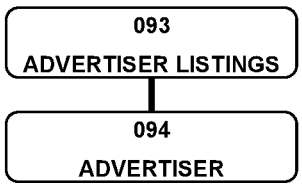

FIG. 100 is a block diagram which illustrates a sample advertiser directory process of the apparatus as described infra. FIG. 100 comprises Blocks 093 and 094.

Figure 101:
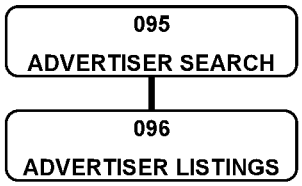
Figure 21:
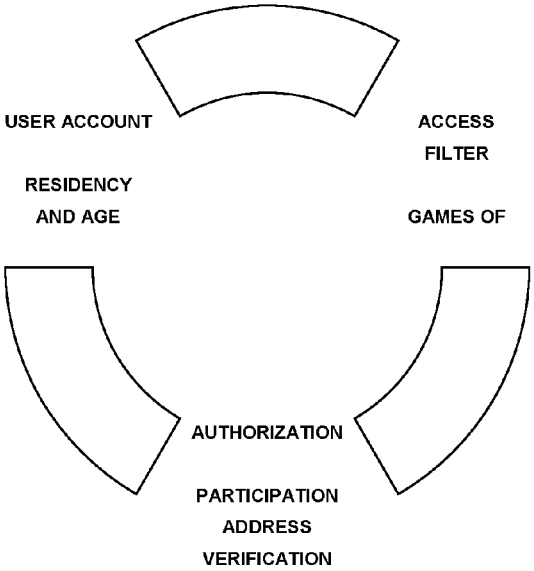
FIG. 21 is a cycle diagram which illustrates a sample games of chance access control loop as described infra, comprising elements as described infra.
Figure 22:
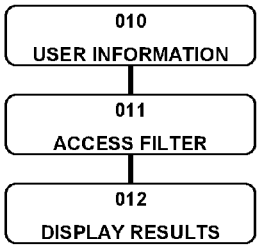
FIG. 22 is a block diagram which illustrates a sample games of chance access filter and document access process of the apparatus as described infra, comprising elements as described infra.
Figure 23:
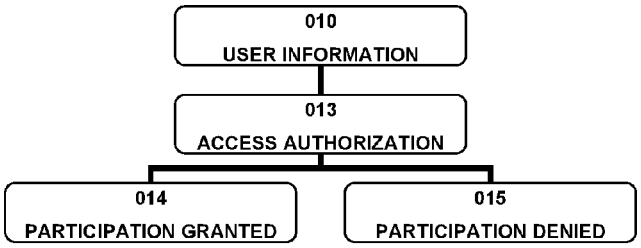
FIG. 23 is a block diagram which illustrates a sample games of chance access authorization and document access process of the apparatus as described infra, comprising elements as described infra.
Figure 24:
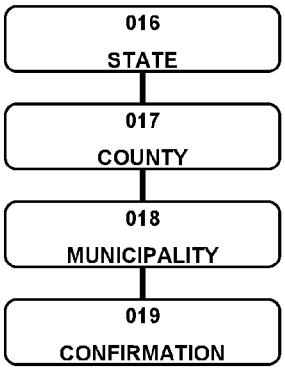
FIG. 24 is a block diagram which illustrates a sample user residency initialization or establishment process of the apparatus as described infra.
Figure 25:
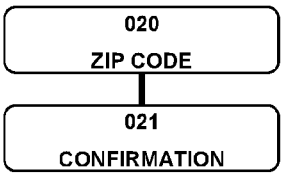
FIG. 25 is a block diagram which illustrates a sample user residency initialization or establishment process of the apparatus as described infra.
Figure 26:
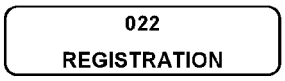
FIG. 26 is a block diagram which illustrates a sample user residency initialization or establishment process of the apparatus as described infra.
Figure 27:
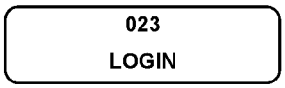
FIG. 27 is a block diagram which illustrates a sample user residency initialization or establishment process of the apparatus as described infra.
Figure 28:
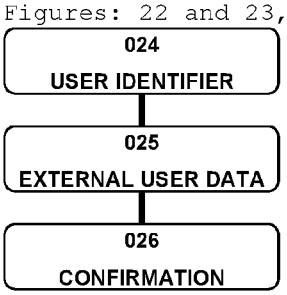
FIG. 28 is a block diagram which illustrates a sample user residency initialization or establishment process of the apparatus as described infra.
Figure 29:
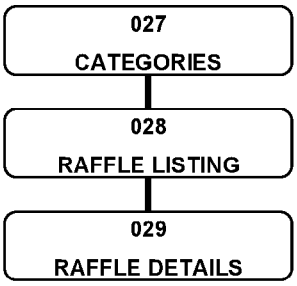
FIGS. 29 to 34 and FIGS. 50 to 55 are block diagrams which illustrate samples of games of chance searching and browsing processes of the apparatus which produce variable display results derived from user information, input, or selection as described infra.
Figure 30:
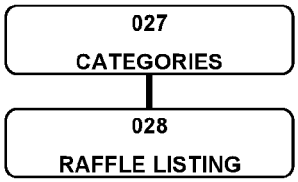
Figure 31:
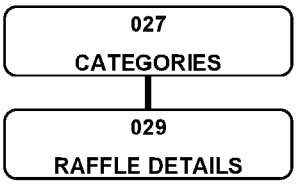
Figure 32:
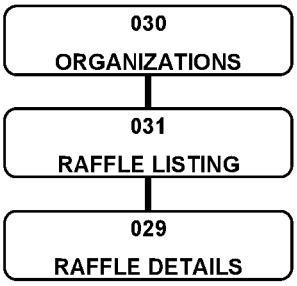
Figure 33:
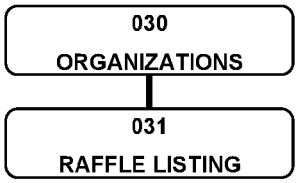
Figure 34:
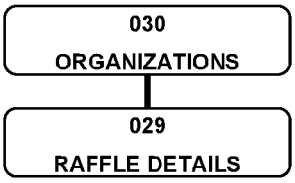

FIG. 101 is a block diagram which illustrates a sample advertiser directory search process of the apparatus as described infra. FIG. 101 comprises Blocks 095 and 096.

Figure 102:
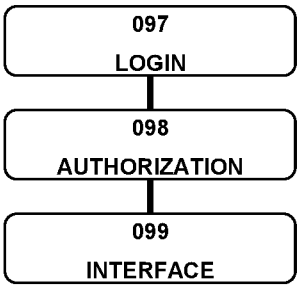
Figure 109:
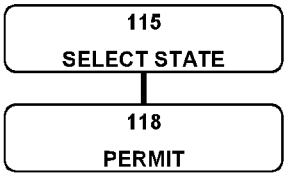
Figure 110:
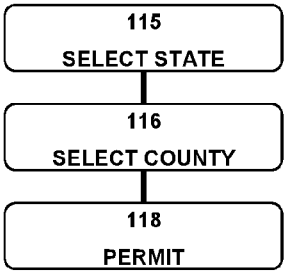
Figure 111:
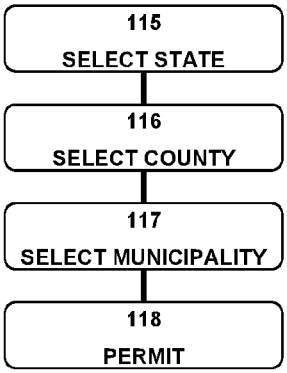
Figure 112:
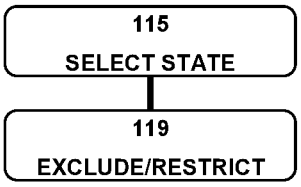
Figure 113:
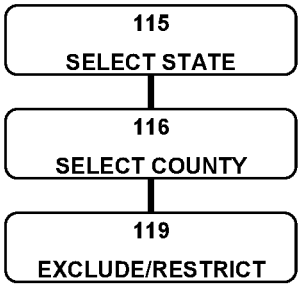
Figure 114:
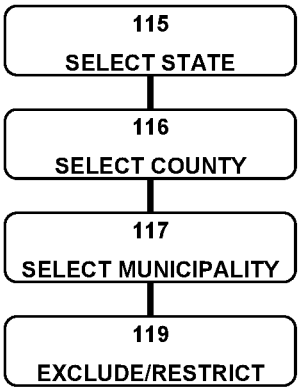

FIG. 102 is a block diagram which illustrates a sample user account access process of the apparatus as described infra. FIG. 102 comprises Blocks 097, 098, and 099.

FIGS. 103 to 106 are block diagrams which illustrate sample games of chance operation and management processes of the apparatus as described infra. FIGS. 103 to 106 comprise Blocks 100, 101, 102, 103, 104, 105, 106, 107, 108, 109, and 110.

FIGS. 107 and 108 are block diagrams which illustrate sample games of chance prize and drawing management processes of the apparatus as described infra. FIGS. 107 and 108 comprise Blocks 111, 112, 113, and 114.

FIGS. 109 to 114 are block diagrams which illustrate sample games of chance permission and exclusion processes of the apparatus as described infra. FIGS. 109 to 114 comprise Blocks 115, 116, 117, 118, and 119.

Figure 115:
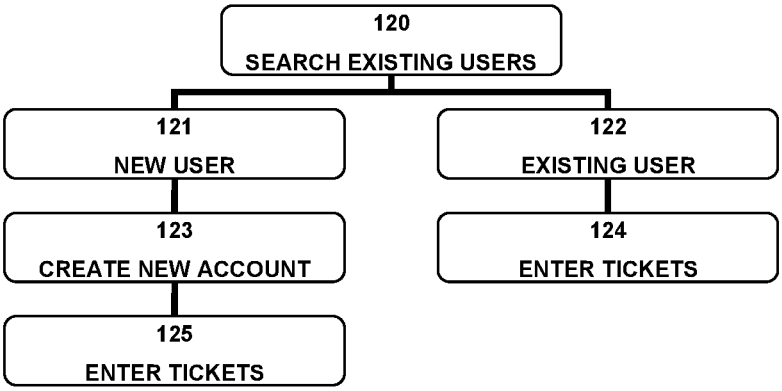

FIG. 115 is a block diagram which illustrates a sample manual ticket sales entry process of the apparatus as described infra. FIG. 115 comprises Blocks 120, 121, 122, 123, 124, and 125.

Figure 116:
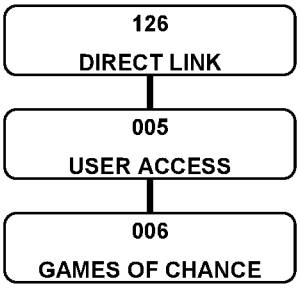
Figure 117:
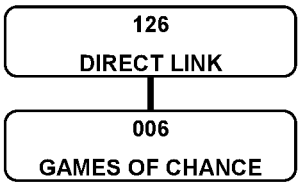
Figure 118:
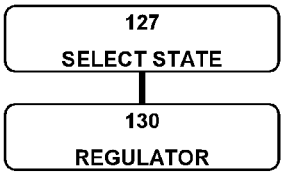
Figure 119:
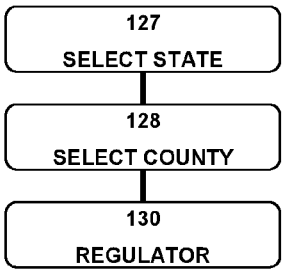
Figure 120:
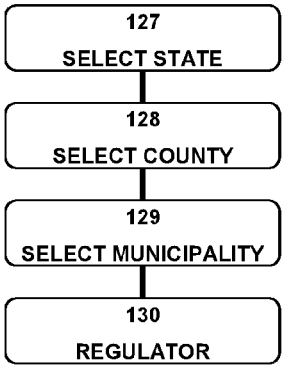
Figure 121:
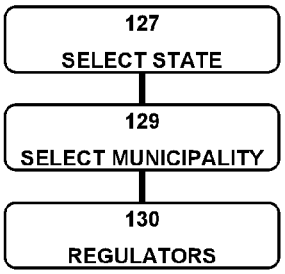
Figure 122:
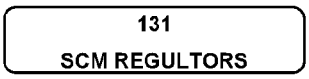

FIGS. 116 and 117 are block diagrams which illustrate sample games of chance direct link processes of the apparatus as described infra. FIGS. 116 and 117 comprise Blocks 126, 005, and 006.

FIGS. 118 to 122 to 114 are block diagrams which illustrate sample regulator directory and regulatory information access processes of the apparatus as described infra. FIGS. 118 to 122 comprise Blocks 127, 128, 129, 130, and 131.

Figure 123:
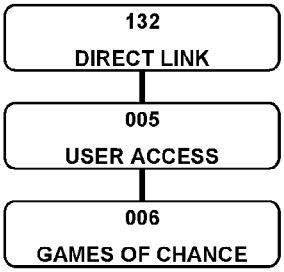
Figure 124:
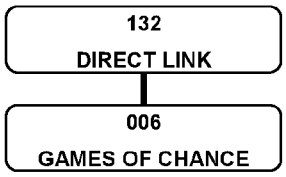

FIGS. 123 and 124 are block diagrams which illustrate sample games of chance direct link processes of the apparatus as described infra. FIGS. 123 and 124 comprise Blocks 132, 005, and 006.

Figure 125:
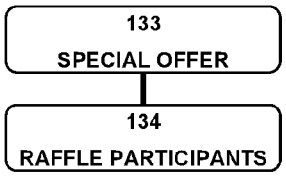

FIG. 125 is a block diagram which illustrates a sample sponsor target marketing process of the apparatus as described infra. FIG. 125 comprises Blocks 133, and 134.

Figure 126:
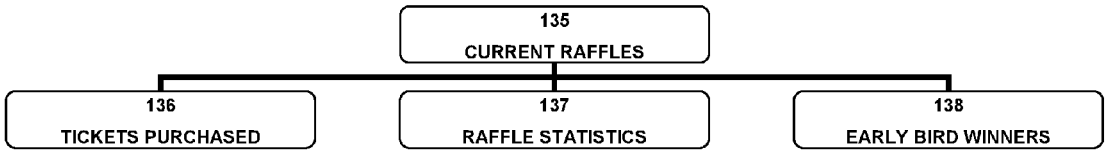

FIG. 126 is a block diagram which illustrates a sample current participation management process of the apparatus as described infra. FIG. 126 comprises Blocks 135, 136, 137, and 138.

Figure 127:
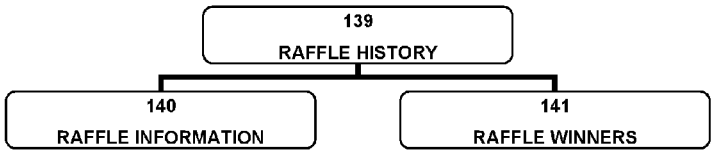

FIG. 127 is a block diagram which illustrates a sample participation history reporting process of the apparatus as described infra. FIG. 127 comprises Blocks 139, 140, and 141.

Figure 128:
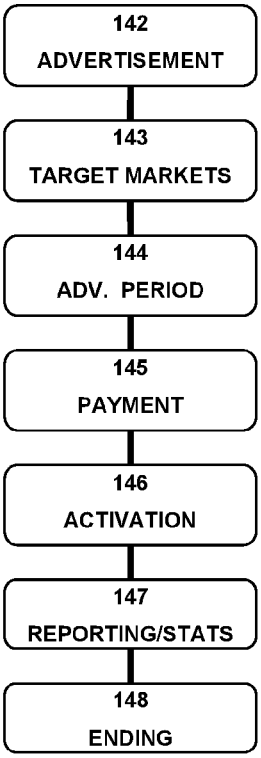
Figure 129:
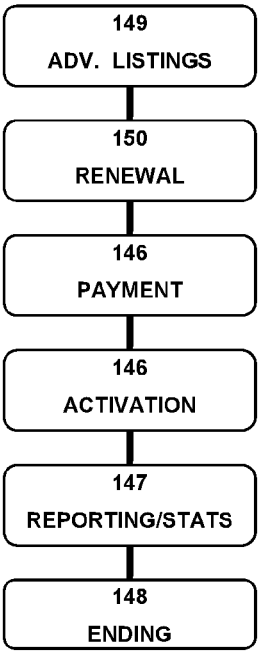
Figure 130:
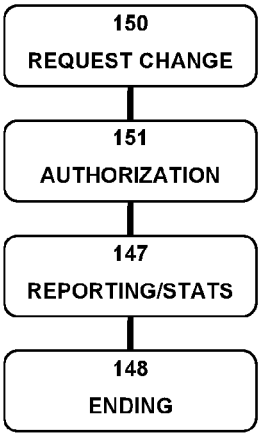

FIGS. 128 to 130 are block diagrams which illustrate sample advertising processes of the apparatus as described infra. FIGS. 128 and 130 comprise Blocks 142, 143, 144, 145, 146, 147, 148, 150, and 151.

Figure 131:
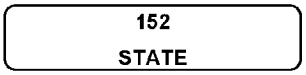
Figure 132:
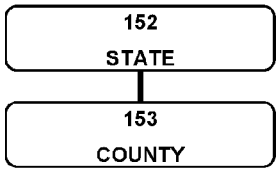
Figure 133:
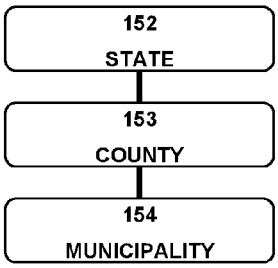

FIGS. 131 to 133 are block diagrams which illustrate sample advertisement market targeting processes of the apparatus as described infra. FIGS. 131 and 133 comprise Blocks 152, 153, and 154.

Figure 134:
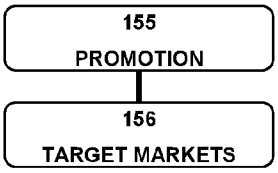

FIG. 134 is a block diagram which illustrates a sample advertiser target marketing process of the apparatus as described infra. FIG. 134 comprises Blocks 155, and 156.

Figure 135:
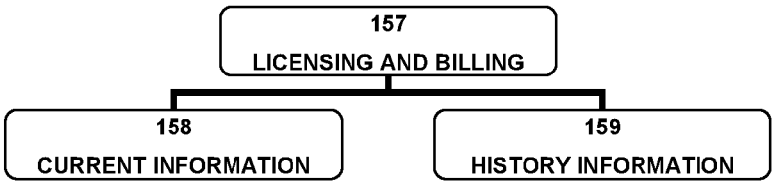

FIG. 135 is a block diagram which illustrates a sample affiliate licensing and billing process of the apparatus as described infra. FIG. 135 comprises Blocks 156, 158, and 159.

Figure 136:
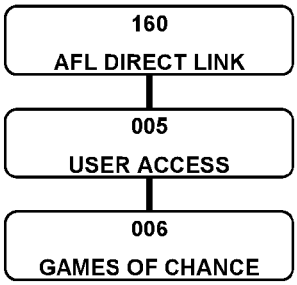
Figure 137:
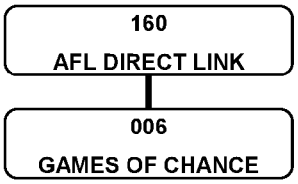

FIGS. 136 to 137 are block diagrams which illustrate sample direct link processes of the apparatus as described infra. FIGS. 136 and 137 comprise Blocks 160, 005, and 006.

BLOCK DESCRIPTIONS

Block 001 comprises a user or client computer used to access the system or download system documents.

Block 002 comprises an intermediary internet service provider which provides a connection between the user or client computer and a server or network of computers.

Block 003 comprises system interfaces, control panels, and documents which are served as complete components which reside on a server or partial components which reside on a plurality of servers which may reside on either side or within intermediary internet service provider computers, servers, or networks.

Block 004 comprises a database or a plurality of databases which store system and user information and data.

Block 005 is described infra, which establishes or retrieves user or participant information, and games of chance information to determine access filtering and/or access authorization.

Block 006 is described infra, which displays games of chance and advertising.

Block 007 is described infra.

Block 008 is described infra.

Block 009 is described infra.

Block 010 is described infra, which comprises user or participant location and/or age information.

Block 011 is described infra which filters game of chance information results using the conditions stated infra.

Block 012 comprises the display of games of chance information as described infra.

Block 013 is described infra which determines user or participant eligibility and access to games of chance using the conditions stated infra.

Block 014 comprises the determination a user or participant is eligible to participate in a game of chance as determined by the conditions as described infra.

Block 015 comprises the determination a user or participant is not eligible to participate in a game of chance as determined by the conditions as described infra.

Block 016 comprises a user's State as described infra.

Block 017 comprises a user's County as described infra.

Block 018 comprises a user's Municipality as described infra.

Block 019 comprises confirmation of a user's State, County and Municipality as described infra.

Block 020 comprises a user's ZIP or Postal Code as described infra.

Block 021 comprises confirmation of a user's State, County and Municipality as described infra.

Block 022 comprises a user's registration information as described infra.

Block 023 comprises a user's login information as described infra.

Block 024 comprises a user's identifier as described infra.

Block 025 comprises a user's the retrieval of user information from an external source using the user's identifier as described infra.

Block 026 comprises confirmation of a user's State, County and Municipality as described infra.

Block 027 is described infra.

Block 028 is described infra.

Block 029 is described infra.

Block 030 is described infra.

Block 031 is described infra.

Block 032 is described infra.

Block 033 comprises organization categories as described infra.

Block 034 comprises organization listings resulting from Block 033 as described infra.

Block 035 is described infra.

Block 036 comprises organization listings comprising categories as described infra.

Block 037 comprises category listings resulting from Block 036 as described infra.

Block 038 comprises categories as described infra.

Block 039 comprises sub-categories as described infra.

Block 040 comprises the alpha-numeric search option comprising numbers and/or letters of an alphabet as described infra.

Block 041 comprises organization listings resulting from Block 040 as described infra.

Block 042 comprises the organization name search option as described infra.

Block 043 comprises organization listings resulting from Block 042 as described infra.

Block 044 comprises the organization description search option as described infra.

Block 045 comprises organization listings resulting from Block 044 as described infra.

Block 046 comprises the organization by location search option as described infra.

Block 047 comprises organization listings resulting from Block 046 as described infra.

Block 048 comprises the organization by state location search option comprised in Block 047 as described infra.

Block 049 comprises the organization by county location search option comprised in Block 047 as described infra.

Block 050 comprises the organization by municipality location search option comprised in Block 047 as described infra.

Block 051 is described infra.

Block 052 is described infra.

Block 053 is described infra.

Block 054 is described infra.

Block 055 is described infra.

Block 056 is described infra.

Block 057 is described infra.

Block 058 is described infra.

Block 059 comprises the submittal of an online participation transaction as described infra.

Block 060 comprises the placement of a hold on the desired number of tickets to be purchased or requested as described infra.

Block 061 comprises the response if the desired number of tickets to be purchased or requested is not available as described infra.

Block 062 comprises transaction processing and address verification as described infra.

Block 063 comprises transaction approval, successful transaction completion, and ticket receipt as described infra.

Block 064 comprises failure of a ticket purchase transaction which removes the hold placed on the desired number of tickets as described infra.

Block 065 comprises evaluating the number of tickets available upon submission of the participation request, and the placement of a hold on the desired number of tickets to be purchased or requested as described infra. Block 066 comprises the response if no tickets are available as described infra.

Block 067 is described infra, which establishes or retrieves user or participant information, and games of chance information.

Block 068 comprises address verification as described infra.

Block 069 comprises address verification approval as described infra.

Block 070 comprises access authorization or address verification failure as described infra.

Block 071 comprises access authorization as described infra.

Block 072 comprises an evaluation of a user's, participant's, or visitor's State to determine advertisements to display as described infra.

Block 073 comprises an evaluation of a user's, participant's, or visitor's County to determine advertisements to display as described infra.

Block 074 comprises an evaluation of a user's, participant's, or visitor's Municipality to determine advertisements to display as described infra.

Block 075 comprises the display of advertisements matching the State, County, or Municipality of a user, visitor, or participant as described infra.

Block 076 comprises an evaluation of a user's, participant's, or visitor's ZIP or Postal Code to retrieve the State, County, and Municipality for the ZIP or Postal Code and determine advertisements to display as described infra.

Block 077 is described infra.

Block 078 is described infra.

Block 079 is described infra.

Block 080 is described infra.

Block 081 comprises listings of member organizations as described infra, and the results of an organization listing search as described infra.

Block 082 comprises organization information for an organization selected by a user from the organization listing search results comprising infra.

Block 083 is described infra.

Block 084 is described infra.

Block 085 is described infra.

Block 086 comprises the organization listings search results from Block 085 as described infra.

Block 087 comprises listings of member sponsors as described infra, and the results of a sponsor listing search as described infra.

Block 088 comprises sponsor information for a sponsor selected by a user from the sponsor listing search results comprising infra.

Block 089 is described infra.

Block 090 is described infra.

Block 091 is described infra.

Block 092 comprises the sponsor listings search results from Block 091 as described infra.

Block 093 comprises listings of member advertisers as described infra, and the results of an advertiser listing search as described infra.

Block 094 comprises advertiser information for an advertiser selected by a user from the advertiser listing search results.

Block 095 is described infra.

Block 096 comprises the advertiser listings search results from Block 095 as described infra.

Block 097 is described infra.

Block 098 comprises either access authorization as described infra, or account access authentication where the user is identified if the user exists, and the user is either granted or denied access to an interface.

Block 099 is described infra.

Block 100 is described infra.

Block 101 is described infra.

Block 102 is described infra.

Block 103 is described infra.

Block 104 is described infra.

Block 105 is described infra.

Block 106 is described infra.

Block 107 is described infra.

Block 108 is described infra.

Block 109 is described infra.

Block 110 is described infra.

Block 111 is described infra.

Block 112 is described infra.

Block 113 is described infra.

Block 114 is described infra.

Block 115 comprises permitting or excluding participation within a State as described infra.

Block 116 comprises permitting or excluding participation within a County as described infra.

Block 117 comprises permitting or excluding participation within a Municipality as described infra.

Block 118 comprises inserting permitted States, Counties, or Municipalities into a database for the game of chance as described infra.

Block 119 comprises inserting excluded States, Counties, or Municipalities into a database for the game of chance as described infra.

Block 120 is described infra. Block 121 comprises entering new participant information as described infra.

Block 122 comprises retrieving existing participant information as described infra.

Block 123 comprises creating a new participant account as described infra.

Block 124 comprises creation of participant tickets within the database for an existing participant as described infra.

Block 125 comprises creation of participant tickets within the database for a new participant as described infra.

Block 126 is described infra.

Block 127 comprises the selection of a State to access regulator information for the selected State as described infra.

Block 128 comprises the selection of a County to access regulator information for the selected County as described infra.

Block 129 comprises the selection of a Municipality to access regulator information for the selected Municipality as described infra.

Block 130 comprises the resulting regulator listings and regulatory information for regulators as described infra.

Block 131 comprises a combination of Blocks 127 to 129, which enables organizations to access regulator information for State regulators, County regulators within the selected State, and Municipal Regulators within the selected State within a complete state-wide regulatory listing comprising regulators and regulator information as described infra.

Block 132 is described infra.

Block 133 is described infra.

Block 134 is described infra.

Block 135 comprises a participant's current games of chance participation information listing as described infra.

Block 136 comprises a participant's ticket information for current games of chance participation as described infra.

Block 137 comprises a participant's current games of chance participation statistical information as described infra.

Block 138 comprises early bird drawing winner information for a participant's current games of chance participation as described infra.

Block 139 comprises a participant's past games of chance participation information listing as described infra.

Block 140 comprises a participant's past games of chance participation information details for selected games of chance as described infra.

Block 141 comprises winner information for a participant's past games of chance participation as described infra.

Block 142 is described infra.

Block 143 is described infra.

Block 144 is described infra.

Block 145 is described infra.

Block 146 is described infra.

Block 147 comprises advertisement statistics and reporting as described infra.

Block 148 comprises the expiration of advertisements as described infra.

Block 149 comprises advertisement listings as described infra.

Block 150 comprises advertisement renewal or a request for changes to active advertisements which may require authorization by a system administrator as described infra.

Block 151 comprises authorization for requested advertisement changes for active advertisements which may require authorization by a system administrator as described infra.

Block 152 comprises selecting a targeted State for which to display an advertisement to users, visitors, or participants from the selected State as described infra.

Block 153 comprises selecting a targeted County for which to display an advertisement to users, visitors, or participants from the selected County as described infra.

Block 154 comprises selecting a targeted Municipality for which to display an advertisement to users, visitors, or participants from the selected Municipality as described infra.

Block 155 comprises the configuration, creation and submittal of targeted advertising as described infra.

Block 156 comprises the distribution of targeted marketing materials or information to targeted markets as described infra.

Block 157 comprises an affiliate licensing and billing summary listing comprising affiliate games of chance information and affiliate merchant information as described infra.

Block 158 comprises information for games of chance currently being promoted by an affiliate comprising statistical and current merchant information as described infra.

Block 159 comprises information for games of chance previously promoted by an affiliate comprising statistical and merchant information as described infra.

Block 160 comprises affiliate direct link as described infra.

DETAILED DESCRIPTION

The method and apparatus of the present invention comprise a system defined by determinants derived from various user input, settings, filters, controls, and variables which dynamically populate location filter and control variables within the system to allow or disallow access to games of chance, listings, and advertising. User controls and filters enable games of chance operated and managed over a network to abide by and follow diverse laws, statutes, rules, and regulations across single and multiple jurisdictions. This system is applicable to games of chance where permits, licensing, and other government approval, restrictions, and regulations are based on governing jurisdiction and user location, residency, and age.

In a preferred embodiment, the apparatus is in the form of Internet-based downloadable programmed applications, electronic documents, and electronic files operating on multiple networks, computers, operating programs, and electronic document browsers. The apparatus has pages on the World Wide Web, allowing users to provide information through interfaces of conventional web browser software such as Internet Explorer, manufactured by Microsoft Corporation. The apparatus documents comprise computer programming languages that dynamically populate content and code variables. Each document or page contains links to other documents or pages which the user may select to transverse. Those skilled in the art will realize the system, and its contents and documents, are able to be created using a variety of programming languages, client side programming, server side programming, or scripting. Those skilled in the art will also realize the functionality, documents, and contents are able to be distributed or served, by or through, a plurality of network architectures or topologies.

System Architecture

The system architecture of a preferred embodiment of the apparatus and method of the present invention is illustrated with reference to FIGS. 1 to 9. As shown in FIG. 1, the apparatus of the present invention comprises Main User Interface 100, Organization Account Interface 200, Sponsor Account Interface 300, Participant Account Interface 400, Advertiser Account Interface 500, Regulator Account Interface 600, Affiliate Account Interface 700, Account Manager Account Interface 800, and System Administrator Account Interface 900 (collectively the "nodes"). Each node is connected to a data structure. Each interface is the input and output gateways for communication with a database or multiple databases.

It is an object of the present invention to provide methods, processes, procedures, and an apparatus to operate, manage, sponsor, advertise, participate in, promote, and regulate games of chance, and to provide location and age controls that limit or extend access to users.

It is another object of the present invention to provide a single channel or venue through which multiple entities can operate, manage, sponsor, advertise, participate in, promote, and regulate games of chance, and to provide location and age controls that limit or extend access to users. Those skilled in the art will also realize that the system can be configured and structured to provide multiple channels or venues, or be structured as a distributed application for independent use.

With reference to FIG. 14, in one embodiment the interface files or documents reside or execute on a server that is accessed by users through an intermediary ISP or network.

With reference to FIG. 15, in a second embodiment the interface files or documents reside or execute on a user, or client, computer and access a remote data source through an intermediary ISP or network.

With reference to FIG. 16, in a third embodiment, the interfaces are divided into various parts with interface files or documents that reside or execute on user, or client, computers, servers, and ISP or network machines interconnected through an intermediary ISP or network.

While the above embodiments describe distributions of system files, documents, and code, those skilled in the art will realize that the functionality can be distributed over a plurality of computers and networks including but not limited to user computers, client computers, ISP computers, servers, network computers, workgroups, wide area networks, local area networks, telecommunication networks, or any other network of computers.

With reference to FIG. 1, in one embodiment the central data structure comprises a single database. The central database stores information to be accessed and used by system interfaces.

With reference to FIG. 1, in a second embodiment the data structure comprises multiple databases. Each database stores information to be accessed and used by system interfaces With reference to FIG. 1, Node 100, visitors access the system via the Main User Interface. The Main User Interface comprises Games of Chance Interface, Membership Interface, Organization Directory Interface, Sponsor Directory Interface, Advertiser Directory Interface, Political Directory Interface, Member Account Login Interface, and other sections and components for informational purposes such as information about the business, contact information, user manuals, user agreements, news, press, and other sections added to provide user's with information about the system and the business entity operating or administering the system.

System and Interface Accessibility

This system comprises an open network, a system that is open and available to the public at large, and a closed loop network, a system for which each user must be a registered member. The system resides on a computer on a network which is accessible by other computers on a network. The system is accessible via the Internet. This system is comprised of a number of user interfaces comprising a number of components, a data structure, and methods, processes, components, and functions which produce controls and filters that limit or extend eligibility, accessibility, participation, advertising, promotion, and regulation of games of chance. System users are grouped as follows:

| User Groups and Types | User Group Description |
|---|---|
| 1) Visitor | Non-Member Users of the System |
| 2) Participant | Participants in Games of Chance |
| 3) Organization | Entities Operating and Managing Games of Chance |
| 4) Sponsor | Entities Sponsoring Games of Chance |
| 5) Advertiser | Entities Advertising to Users |
| 6) Regulator | Entities Regulating Games of Chance |
| a) Federal Regulator | (Federal Government) |
| b) State Regulator | (State Government) |
| c) County Regulator | (County/Parish Government) |
| d) Municipal Regulator | (City/Towne/Village Government) |
| 7) Account Manager | Account Managers |
| 8) Affiliate | Entities Affiliated with Members of the Organization User Group |
| 9) Administrator | Master Administrators for the System |

In a preferred embodiment, with reference to FIGS. 1 to 9, each user group accesses the system through various graphical user interfaces to perform tasks which relate to the system for each individual group. Each interface is connected to a database. System interfaces filter, control, limit, and extend access to only relevant portions of the data structure. Users download system interfaces on to a computer and access open network interfaces freely or access closed loop network interfaces as registered members or users of the system requiring user login and authentication. Only registered members or users are able to access closed loop network interfaces or the closed loop network sections of system interfaces, and each user group is able to only access the interface, or sections of an interface, for the user's specific user group. Each member user has an identifier to identify the user by the system and relate or connect relational or non-relational data. Each interface enables system configuration utilities to format and structure data derived from user input. Data and information entered into the system dynamically formats or populates content, forms, form objects, and code variables. Dependant on the existence of data and information, the systems code shows, hides, displays, lists, or formats information. Data and information input into the system either through data entry or data selection also dynamically populates code variables used in the access and authorization criteria and conditions described in supra paragraphs, as well as other components, methods, and processes of the system.

In a preferred embodiment, with reference to FIGS. 1 to 9, each system interface is accessible by users via the internet. Each of these interfaces comprises functional nodes.

Figure 2:
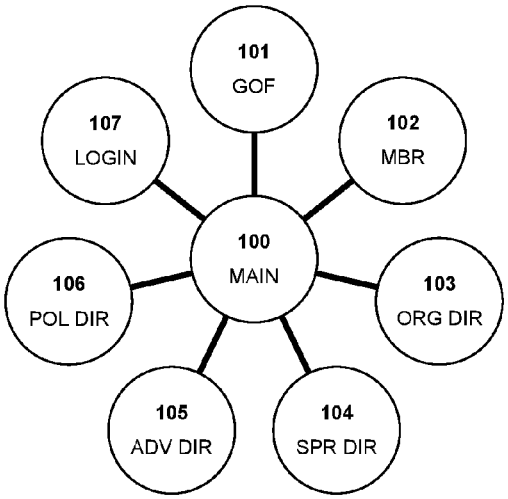
FIG. 2 is a radial diagram which illustrates a sample interface architecture, topology, and structure of the Main User Interface comprising elements as described infra.

As shown in FIG. 2, the apparatus of the present invention comprises Games of Chance Interface 101, Membership Interface 102, Organization Directory Interface 103, Sponsor Directory Interface 104, Advertiser Directory Interface 105, Political Directory Interface 106, and Member Account Login Interface 107 (collectively the "nodes").

Figure 10:
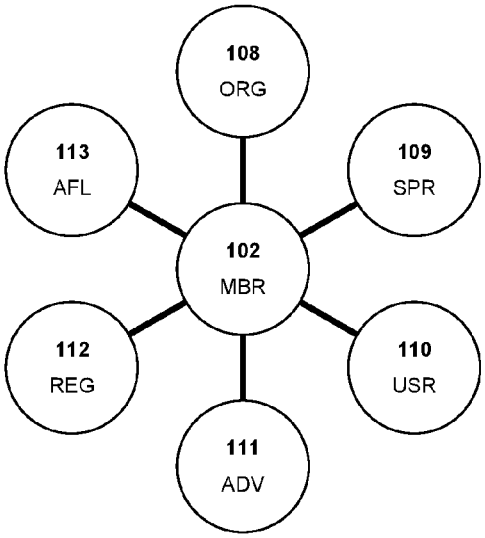
FIG. 10 is a radial diagram which illustrates a sample interface architecture, topology, and structure of the Membership Registration Interface comprising elements as described infra.
Figure 80:
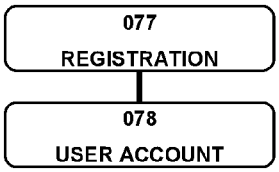
FIG. 80 is a block diagram which illustrates a sample user registration process of the apparatus as described infra.
Figure 81:
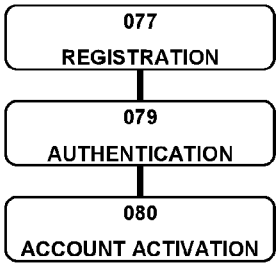
FIG. 81 is a block diagram which illustrates a sample user registration and registrant authentication process of the apparatus as described infra.

As shown in FIG. 10, the apparatus of the present invention comprises Organization Membership Registration Interface 108, Sponsor Membership Registration Interface 109, Participant Membership Registration Interface 110, Advertiser Membership Registration Interface 111, Regulator Membership Registration Interface 112, and Affiliate Membership Registration Interface 113 (collectively the "nodes").

Figure 11:
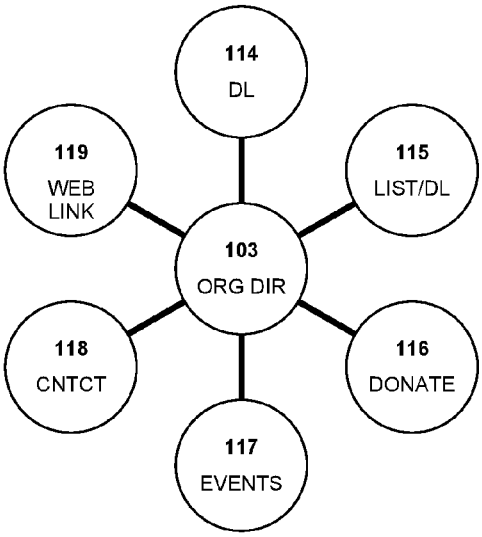
FIG. 11 is a radial diagram which illustrates a sample interface architecture, topology, and structure of the Organization Directory Interface comprising elements as described infra.
Figure 82:
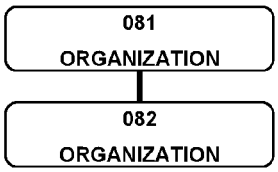
FIG. 82 is a block diagram which illustrates a sample organization directory process of the apparatus as described infra.

As shown in FIG. 11, the apparatus of the present invention comprises Direct Link Interface 114, Game of Chance Listing and Direct Link Interface 115, Donation Interface 116, Event Interface 117, Contact Interface 118, and Link Interface 119 (collectively the "nodes").

Figure 12:
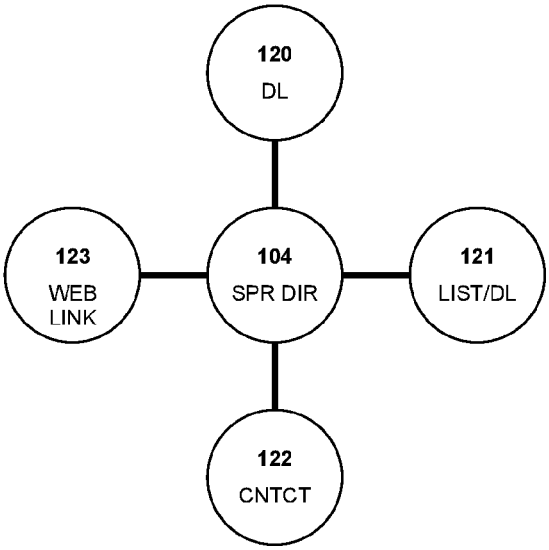
FIG. 12 is a radial diagram which illustrates a sample interface architecture, topology, and structure of the Sponsor Directory Interface comprising elements as described infra.

As shown in FIG. 12, the apparatus of the present invention comprises Direct Link Interface 120, Game of Chance Listing and Direct Link Interface 121, Contact Interface 122, and Link Interface 123 (collectively the "nodes").

Figure 13:
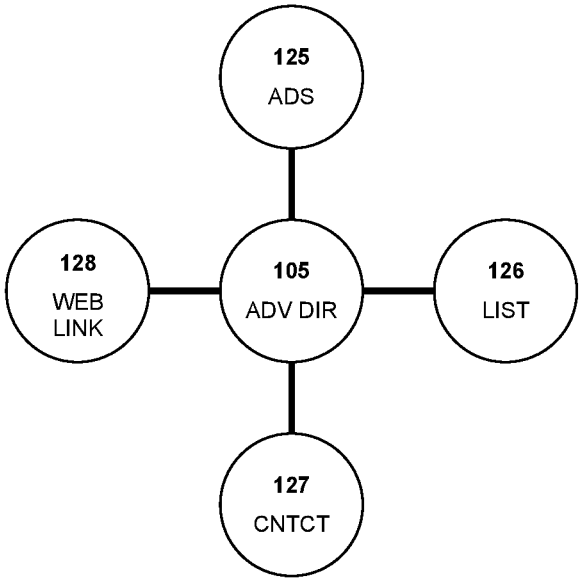
FIG. 13 is a radial diagram which illustrates a sample interface architecture, topology, and structure of the Advertiser Directory Interface comprising elements as described infra.

As shown in FIG. 13, the apparatus of the present invention comprises Advertisement Interface 125, Beneficiary Listing Interface 126, Contact Interface 127, and Link Interface 128 (collectively the "nodes").

Figure 3:
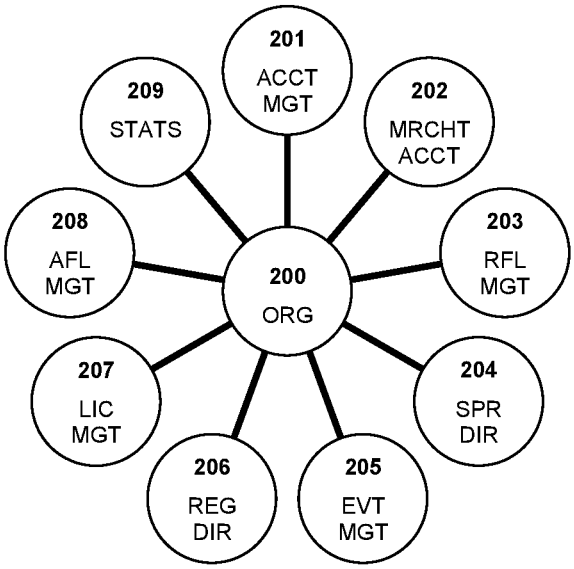
FIG. 3 is a radial diagram which illustrates a sample interface architecture, topology, and structure of the Organization Account Interface comprising elements as described infra.

As shown in FIG. 3, the apparatus of the present invention comprises Account Management Interface 201, Merchant Account Management Interface 202, Games of Chance Management Interface 203, Sponsor Directory Interface 204, Event Management Interface 205, Regulator Directory Interface 206, Licensing Management Interface 207, Affiliate Management Interface 208, and Statistical Analysis Interface 209 (collectively the "nodes").

Figure 4:
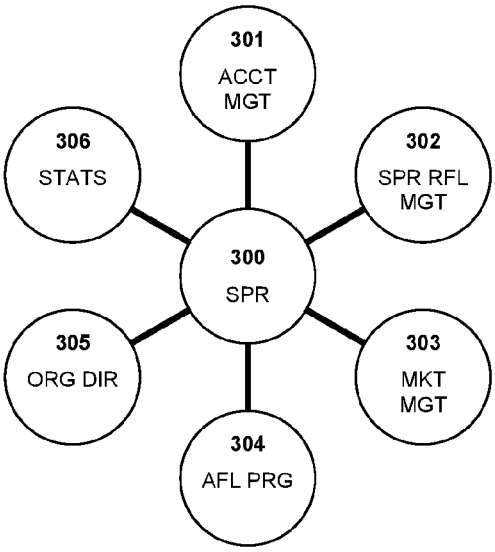
FIG. 4 is a radial diagram which illustrates a sample interface architecture, topology, and structure of the Sponsor Account Interface comprising elements as described infra.

As shown in FIG. 4, the apparatus of the present invention comprises Account Management Interface 301, Sponsored Games of Chance Management Interface 302, Promotional Interface 303, Affiliate Program Management Interface 304, Organization Directory Interface 305, and Statistical Analysis Interface 306 (collectively the "nodes").

Figure 5:
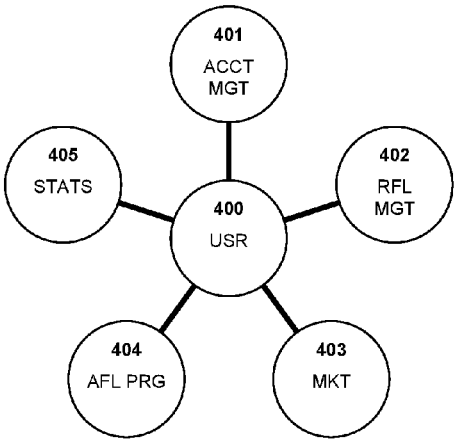
FIG. 5 is a radial diagram which illustrates a sample interface architecture, topology, and structure of the Participant Account Interface comprising elements as described infra.

As shown in FIG. 5, the apparatus of the present invention comprises Account Management Interface 401, Games of Chance Participation Management Interface 402, Promotional Interface 403, Affiliate Program Management Interface 404, and Statistical Analysis Interface 405 (collectively the "nodes").

Figure 6:
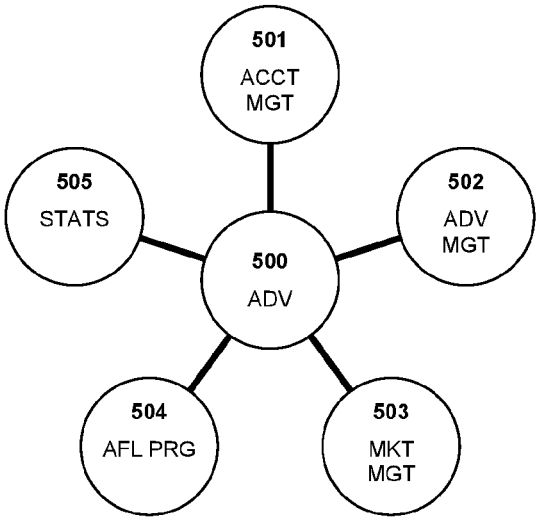
FIG. 6 is a radial diagram which illustrates a sample interface architecture, topology, and structure of the Advertiser Account Interface comprising elements as described infra.

As shown in FIG. 6, the apparatus of the present invention comprises Account Management Interface 501, Advertisement Management Interface 502, Promotional Interface 503, Affiliate Program Management Interface 504, and Statistical Analysis Interface 505 (collectively the "nodes").

Figure 7:
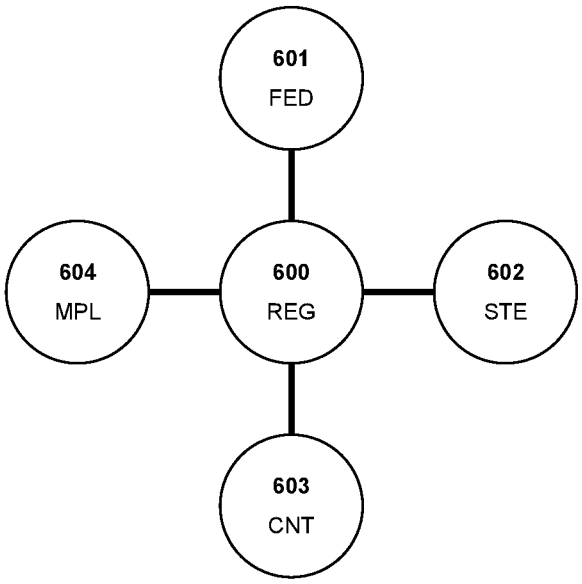
FIG. 7 is a radial diagram which illustrates a sample interface architecture, topology, and structure of the Regulator Account Interface comprising elements as described infra.

As shown in FIG. 7, the apparatus of the present invention comprises Federal Regulator Interface 601, State Regulator Interface 602, County Regulator Interface 603, and Municipal Regulator Interface 604 (collectively the "nodes").

Figure 8:
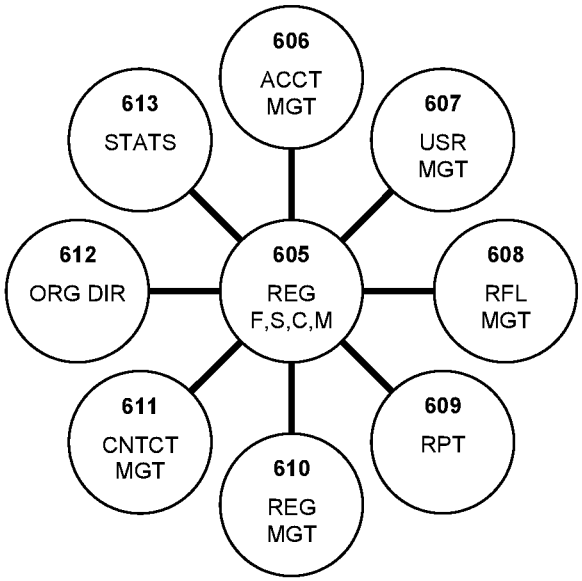
FIG. 8 is a radial diagram which illustrates a sample interface architecture, topology, and structure of the Regulator Account Interface comprising elements as described infra.

As shown in FIG. 8, the apparatus of the present invention comprises Account Management Interface 606, Account User Management Interface 607, Games of Chance Regulation Interface 608, Regulatory Reporting Interface 609, Regulatory Management Interface 610, Communication and Contact Management Interface 611, Organization Directory Interface 612, and Statistical Analysis Interface 613 (collectively the "nodes").

Figure 9:
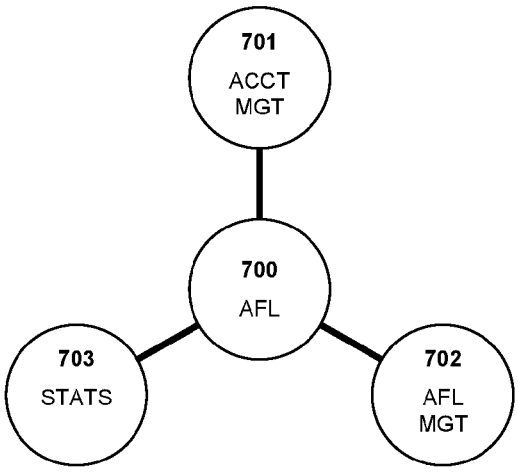
FIG. 9 is a radial diagram which illustrates a sample interface architecture, topology, and structure of the Affiliate Account Interface comprising elements as described infra.

As shown in FIG. 9, the apparatus of the present invention comprises Account Management Interface 701, Affiliate Program Management Interface 702, and Statistical Analysis Interface 703 (collectively the "nodes").

Top Level Interface Descriptions

FIG. 1, Node 100 and FIG. 2: Main User Interface

The Main System Interface comprises interfaces accessible to visitors and interfaces accessible only to registered members. The Main System Interface comprises the games of chance participation interface where users are able to access and participate in games of chance, view directories, and access user accounts.

FIG. 1, Node 200 and FIG. 3: Organization Account Interface

The Organization Account Interface comprises interfaces accessible only to registered member users operating and managing games of chance.

FIG. 1, Node 300 and FIG. 4: Sponsor Account Interface

The Sponsor Account Interface comprises interfaces accessible only to registered member users sponsoring games of chance, and/or promoting products and services to users, and/or promoting games of chance as affiliates.

FIG. 1, Node 400 and FIG. 5: Participant Account Interface

The Participant Account Interface comprises interfaces accessible only to registered member users participating in games of chance, and/or promoting games of chance as affiliates.

FIG. 1, Node 500 and FIG. 6: Advertiser Account Interface

The Advertiser Account Interface comprises interfaces accessible only to registered member users conducting advertising in the Main System Interface, and/or promoting products and services to users, and/or promoting games of chance as affiliates.

FIG. 1, Node 600 and FIGS. 7 and 8: Regulator Account Interface

The Regulator Account Interface comprises interfaces accessible only to registered member users regulating games of chance.

FIG. 1, Node 700 and FIG. 9: Affiliate Account Interface

The Affiliate Account Interface comprises interfaces accessible only to registered member users promoting games of chance as affiliates.

FIG. 1, Node 800: Account Manager Account Interface

The Account Manager Account Interface comprises interfaces accessible only to registered member users providing prospecting, system sales and support, and technical assistance to member users. The structure, methods, processes and apparatus of the Account Manager Account Interface are proprietary trade secrets and are not disclosed publicly.

FIG. 1, Node 900: System Administrator Account Interface

The System Administrator Account Interface comprises interfaces accessible only to users administering, managing, or configuring the system. The structure, methods, processes and apparatus of the System Administrator Account Interface are proprietary trade secrets and are not disclosed publicly.

FIG. 2, Node 101: Games of Chance Interface

The Games of Chance Interface comprises methods and processes for the operation of games of chance and the participation in games of chance by users. The Games of Chance Interface also comprises additional advertising, marketing, promotional, and sponsorship activities conducted by member organizations, sponsors, advertisers, and affiliates.

The invention comprises permission, exclusion, and restriction methods which are the foundation of the system. The permission, exclusion, and restriction methods compare user location, residency, and age to the permitted, excluded, and restricted locations of operation and the minimum age required for each game of chance to determine user eligibility, access, and participation. The permission, exclusion, and restriction criteria comprise state, county, municipality, and age variables to determine user eligibility, access, and participation. Permission, exclusion, and restriction information and data comprising user location, residency, and age are also able to be used to target specific markets for various forms of advertising and promote games of chance participation.

Accessibility, Authorization, and Participation Criteria and Conditions

User location and residency initialization methods establish, store, or retrieve information about a user's state, county, municipality, and/or age. This stored information, in the form of identifiers, is compared to the permit, exclusion, and restriction information stored for games of chance. The information for each user's state, county, and municipality, is compared to the state, county, and municipality permission, exclusion, and restriction information for games of chance to determine user accessibility, eligibility and participation authorization for games of chance. User accessibility, eligibility, and participation for games of chance are determined by the following conditions:

1) "The game of chance is permitted in the user's State" and "the State permission is a State-wide permission or the State does not require permission to operate a game of chance" or;

2) "The game of chance is permitted in the user's County" and "the County permission is a County-wide permission or the County does not require permission to operate a game of chance" or;

3) "The game of chance is permitted in the user's Municipality" or;

4) "The game of chance is permitted in the user's State, County, and Municipality" or;

5) "The game of chance is permitted in the user's State" and "The game of chance is permitted in the user's County or the County permission is a County-wide permission or the County does not require permission to operate a game of chance"

6) And with all of the above conditions, games of chance will not be displayed or accessible to users where the user's State, County or Municipality is excluded, restricted, or denied permission.

7) In addition to the above criteria and conditions, user age validation and verification methods are imposed on user access, eligibility, or participation. Age validation occurs at various points within the system and its methods and processes. One method utilizes the user's State, County, and Municipality to identify the required age to participate in games of chance for the user's location and residency. Another method utilizes the State, County, and Municipality of the governing jurisdiction of the games of chance to identify the required age to access or participate in games of chance. Access to or participation in games of chance is denied if the user does not meet the minimum age requirement to participate in the game of chance as governed by the jurisdiction from which the game of chance is issued permission to operate, or if the user does not meet the minimum age requirement to participate in a game of chance as governed by the jurisdiction of the user's location or residency.

Establishing and Initializing User Location and Residency to Compare to Game of Chance Permission, Exclusion, or Restriction Criteria and Conditions to Determine Access or Authorization for Eligibility and Participation.

In one embodiment, query, search, listing, and display results are filtered by the conditions stated infra. Using the criteria infra, only information for games of chance that meet these conditions will be displayed to a particular user (collectively the "access filter"). The access filter establishes or determines user eligibility.

In a second embodiment, accessing participation, listing, display, and purchasing sections are controlled by user login, registration, participation, or purchasing methods and processes that utilize the criteria and conditions described in paragraph to authorize information access, participation, or purchasing for users that meet these conditions for games of chance (collectively the "access authorization"). The access authorization establishes or determines user eligibility.

In one embodiment, user location and residency initialization occurs when a user selects or enters the State, County, and Municipality of their residency from option lists, menus, link listing, or any type of form object that will allow the user to make a selection, series of selections, or enter information. The identifiers for the user's State, County, and Municipal selection or information are stored and processed by the system which retrieves information and data from a database for games of chance that meet the permission, exclusion, and restriction criteria and conditions, as described infra, for the user's State, County, and Municipality using the access filter or access authorization as described infra. This process can occur on a single page or transverse multiple pages.

In a second embodiment, user location and residency initialization occurs when the user provides a ZIP or Postal Code to the system. The system then retrieves the identifiers for the State, County, and Municipality matching the user's ZIP or Postal Code from a database. The identifiers for the user's State, County, and Municipality are stored and processed by the system which retrieves information and data from a database for games of chance that meet the permission, exclusion, and restriction criteria and conditions, as described infra, for the user's State, County, and Municipality using the access filter or access authorization as described infra. This process can occur on a single page or transverse multiple pages.

In a third embodiment, user location and residency initialization occurs when the user accesses the system by providing a username and password. The system then retrieves the identifiers for the State, County, Municipality, and Age of the user from a database. This information is then processed by the system which retrieves information and data from a database for games of chance that meet the permission, exclusion, and restriction criteria and conditions, as described infra, for the user's State, County, and Municipality using the access filter or access authorization as described infra. This embodiment is available only after the user has registered and created a system user membership account as described infra.

In a fourth embodiment, users register to become members creating a system user membership account, as described infra, and provide the State, County, Municipality, and ZIP or Postal Code information for the user's location, residency, as well as the user's date of birth or age. Before registration can be executed, the user's age is compared to the minimum required age for the jurisdiction governing the user's location or residency. If the minimum age requirement is not met, user registration is denied. If the minimum age requirement is met, user registration is granted. Upon user login to access games of chance listings, participation, purchasing, and payment sections, methods, or processes of the system, as described infra, the user's identifiers for location, State, County, Municipality, and/or Age is retrieved from a database. This information is compared to the permit, exclusion, and restriction criteria and/or minimum age requirement for a game of chance to determine if access to or participation in a game of chance is to be granted or denied using the criteria and conditions as described infra, and access filter or access authorization as described infra.

In a fifth embodiment, user location, residency, and age initialization occurs when the user accesses the system by providing an identifier which is used to retrieve user information from an external system or data source which contains the user's location, residency, and age information. The system then retrieves the identifiers for the user's State, County, Municipality, and Age from a database. This information is then processed by the system which retrieves information and data from a database for games of chance that meet the permission, exclusion, and restriction criteria and conditions, as described in supra paragraph, for the user's State, County, and Municipality using the access filter or access authorization as described infra.

In these embodiments, the legal gaming age for the user's unique location or residency identifiers are retrieved from a database. This information is used to verify age requirements for games of chance and membership registration authorization. Users are required to be of legal gaming age for the State, County, and Municipality in which they reside in order to become a registered member and user of the system. Users are required to be of the required legal gaming age of the jurisdiction governing the authority of an entity to conduct, operate, and manage a game of chance in order to participate in the game of chance. Users are restricted access to games of chance if the user's age does not meet the minimum legal gaming age requirement of the jurisdiction governing the game of chance. This is used in the access filter or access authorization processes as described infra. As described infra, the minimum age requirement for user location or residency is also retrieved from a data source and the user may be required to agree to be of legal gaming age for the State, County, and Municipality selected or entered by the user representing the user's location or residency before the user is able to proceed. This is optional, but preferred as an added legal precaution. A form of electronic signature can be applied to represent user agreement to the validity of information provided. Users are given the ability to reselect or re-enter this information. In reference to infra, additional access authorization as described infra will be required to validate user information and authorize participation, maintaining an access control loop as described infra. This additional access authorization step can be placed within or between and step or section comprising games of chance domains, listings, or participation.

Those skilled in the art will also realize that user location or residency can be extended to include permission, exclusion, and restriction criteria and conditions that include Country information, data, and identifiers to give the system global reach. Although an object of the system is to provide methods and processes to operate, manage, sponsor, advertise, participate in, and regulate games of chance, and to provide location and age controls that limit or extend access to users within a single county, it should not be construed to limit the system's ability to be configured to include country information. Adding country information requires adding an additional tier of location information to the criteria and conditions as described infra. This may also require adding additional territorial, provincial, regional, or other jurisdictional divides for various countries to maintain accurate access filtration or access authorization as described infra. This can then be applied to the methods and processes as described infra. The conditions and criteria, as described infra, can be configured to include additional countries by inserting country level criteria into these conditions to determine if participation or access is permitted, excluded, or restricted for a country, if permission is country-wide, or if no permission is required to operate the game of chance by a country. This then tiers down to evaluate sub-levels of jurisdiction within a specified country as described infra. The current application of this invention is to cover jurisdictions or locations within the United States of America, but may be extended to cover additional jurisdictions, locations, regions, countries, or territories.

Controls for Maintaining the Integrity of Access or Authorization Criteria and Conditions In a preferred embodiment, an access control loop is created. User registration and membership is required to participate in a game of chance or purchase a chance to win a prize for any raffle. User account information can be altered only in the Participant Account Interface. Alterations made to a user's State, County, Municipality, or ZIP or Postal Code will establish new identifiers to be stored for these variables. The authentication, authorization, participation, and purchasing sections of each interface dynamically populate identifiers and user account information into forms and form objects as read only or hidden variables, and can not be altered outside of the Participant Account Interface. This requires users to exit and re-enter system interfaces to make alterations to user information and data. This loop around between the Participant Account Interface, and games of chance listings, access, participation, and purchasing sections of interfaces, maintain the integrity of the access filter and access authorization as described infra. Upon exiting the Participant Account Interface, the new user information and identifiers are used in the access filter and access authorization, as described infra, to determine user eligibility for the games of chance. Dependent on alterations made to user data and information, previously accessible games of chance may no longer be accessible by the user. This eliminates the user's ability to alter account information to gain access to, and participate in, games of chance for which the user is excluded or restricted. Since the user's financial transaction address and residency information is dynamically populated into participation and payment forms from a database or data store, and can not be changed in the participation or payment forms or form objects, altering user information in the Participant Account Interface to access excluded or restricted games of chance will cause the electronic financial transaction to fail during external user verification or authentication. The transaction authorization process conducted by a transaction authorization gateway will be declined if the user's address information is passed to the gateway's address verification system (AVS) from this inventions database, data stores, participation forms, or purchasing forms if the user's account information does not match the user's financial account holder information in the external financial institution's systems. This will defeat the purpose of a user gaining access to a restricted or excluded game of chance. User data and information must be accurate and match both, the game of chance access conditions and criteria as described infra, as well as the user's data and information required for successful transaction processing and billing. Altering user data and information by providing incorrect data and information causes the system to deny participation or purchasing. This access control loop prevents unauthorized participation in games of chance. The user needs to provide correct user data and information throughout the entire system, methods, and processes to access games of chance, and complete participation and transactions for which the user is permitted by the system.

In another embodiment, an access control loop is created using user information provided at the time of purchase or participation. The user's State, County, Municipality, and Age information is entered into a purchase form and submitted to be processed. Upon submission, the system evaluates the user's information to determine if participation in the game of chance is permitted, excluded, or restricted using an access authorization as described infra. If permitted, the system allows the user's information to be passed to the transaction authorization gateway which verifies the user's address information. If the gateway's address verification process is successful, the transaction is allowed to proceed. If either the access authorization or address verification processes fail, the user is denied participation in the game of chance.

In a preferred embodiment, the registration process establishes variables or identifiers within the system for a user's State, County, Municipality and Age for participation and purchasing sections of the system that can only be edited or altered from the Participant Account Interface. These variables are dynamically populated into all games of chance participation or purchase forms, and can not be altered or changed within these forms. This user information is used in the access filter or access authorization processes as described infra. In reference to infra, users may provide State, County, and Municipal information that does not match the State, County, and Municipality information of the user's membership account. Upon attempting to access the participation section or making a participation attempt, the access authorization, as described infra, and the access control loop, as described infra, will catch the data discrepancy and deny access or participation.

User login for games of chance information access, participation and purchasing sections of the system retrieves user account information from a database which is used for access authorization as described infra.

The methods and apparatus of this invention utilize the above embodiments throughout the system to filter results or authorize access and/or participation. Users are given any one or more options to establish or initialize user residency and location dependant on the point of access or the section of the system. Since establishing user residency, location, and age is an essential object of the system, the availability of this user information supports system components, features, and functionality that utilize this information to perform a multitude of unique functions, processes, and tasks.

Establishing Permission, Exclusion, or Restriction Criteria, for Locations and Residencies, for Games of Chance In a preferred embodiment, organizations operating and managing games of chance are able to input State, County, and/or Municipality data into the system's database using the Organization Account Interface to target markets for the advertising of games of chance and establish identifiers for games of chance permission, exclusion, and restriction criteria and conditions as described infra.

In one embodiment, organizations operating and managing games of chance establish permission, exclusion, and restriction criteria and information for the organization to be used for all games of chance operated and managed by the organization. This does not require organizations to provide permission, exclusion, or restriction information for each individual game of chance.

In a second embodiment, organizations operating and managing games of chance establish permission, exclusion, and restriction criteria and information for each individual game of chance operated and managed by the organization. This provides organizations with the ability to segment and target a diversity of locations for each of the organization's games of chance. Each of the organization's games of chance can be offered to different locations. This requires organizations to provide permission, exclusion, or restriction information for each individual game of chance separately.

In a third embodiment, the permission, exclusion, or restriction criteria for games of chance are established by the system rather than organizations operating and managing games of chance. This does not require organizations operating and managing games of chance to enter the permission, exclusion, or restriction information for each individual game of chance or the permission, exclusions, or restriction criteria for the organization as described infra. The permission, exclusion, or restriction criteria are derived from the location of the organization and the governing jurisdiction of the organization to determine the conditions of operation for any given organization and its games of chance.

In a fourth embodiment, the permission, exclusion, or restriction criteria for games of chance are established for each jurisdictional location by a system administrator. The permission, exclusion, and restriction criteria are entered for each and every State, County, and Municipality. The system then uses the location and governing jurisdiction of the organization to determine the permission, exclusion, or restriction criteria for the organization's State, County, and Municipality to determine the conditions of operation for any given organization and its games of chance.

In a fifth embodiment, the permission, exclusion, or restriction criteria for games of chance are established for each jurisdictional location by each jurisdictional regulator. The permission, exclusion, and restriction criteria are entered for each and every State, County, and Municipality by their perspective regulators. The system then uses the location of the organization to determine the permission, exclusion, or restriction criteria for the organization's State, County, and Municipality to determine the conditions of operation for any given organization and its games of chance.

Searching and Browsing Games of Chance

Games of chance can either be categorized by prize category, prize sub-category, organization, or sponsor (collectively "domains"). Any combination of one or more of these domains can be utilized to target, limit, or extend listing, search, or navigation results for games of chance. Prize categories or prize sub-categories may be replaced with any type of category or sub-category label or subject. For example, categories and/or sub-categories may comprise types of games, therefore category and/or sub-category listings would comprise listings of types of games.

In one embodiment, games of chance are categorized by prize. Users select a prize category to view information for raffles within the selected category.

In a second embodiment, all prize categories are displayed. Selecting a prize category displays all of the games of chance currently operating in the selected prize category as described infra.

In a third embodiment, only prize categories that contain games of chance that meet the criteria and conditions described infra are displayed. Selecting a prize category displays all of the games of chance currently operating in the selected category as described infra.

In a forth embodiment, games of chance are categorized by prize categories and prize sub-categories. Users select a prize category to view prize sub-categories, and then select a prize sub-category to view information for games of chance within the selected prize sub-category.

In a fifth embodiment, all prize categories are displayed. When a prize category is selected, all prize sub-categories are displayed. Selecting a prize sub-category displays all games of chance currently operating in the selected prize category as described infra.

In a sixth embodiment, all prize categories are displayed. When a prize category is selected, only prize sub-categories that contain games of chance that meet the criteria and conditions described infra are displayed. Selecting a prize sub-category displays all games of chance currently operating in the selected prize sub-category as described infra.

In a seventh embodiment, only prize categories that contain prize sub-categories that contain games of chance that meet the criteria and conditions described infra are displayed. When a prize category is selected, only prize sub-categories that contain games of chance that meet the criteria and conditions described infra are displayed. Selecting a prize sub-category displays all games of chance currently operating in the selected prize sub-category as described infra.

In an eighth embodiment, games of chance are categorized by organizations operating games of chance. Users select a specific organization to view information for games of chance operated by selected organization.

In a ninth embodiment, games of chance are categorized by organizations operating games of chance. Users are able to search for games of chance operated by specific organizations by searching organization names, descriptions, alpha-numeric characters, subject categories, subject sub-categories, or organization location, state, county, and/or municipality. Any one or all of these search methods are available to the user.

In a tenth embodiment, games of chance are categorized by organizations operating games of chance. Users are able to search for games of chance operated by specific organizations by searching organization names, descriptions, alpha-numeric characters, subject categories, subject sub-categories, or organization location, state, county, and/or municipality. Any one or all of these search methods are available to the user. Search results produce a listing of all organizations that meet the search criteria. Users then choose an organization to view games of chance information specific to the selected organization. This displays all of the games of chance currently operated by the selected organization as described infra.

In an eleventh embodiment, games of chance are categorized by organizations operating games of chance. Users are able to search for games of chance operated by specific organizations by searching organization names, descriptions, alpha-numeric characters, subject categories, subject sub-categories, or organization location, state, county, and/or municipality. Any one or all of these search methods are available to the user. Search results produce a listing of organizations operating games of chance that meet the criteria and conditions described infra. Users select a specific organization to view information for games of chance operated by selected organization. This displays all games of chance currently operated by the selected organization as described infra.

In one embodiment, game of chance listing, search, or navigation results display information for all games of chance contained within the selected prize category or prize sub-category.

In a second embodiment, games of chance listing, search, or navigation results display information only for games of chance contained within selected prize category or prize sub-category that meet the criteria and conditions described infra.

In a third embodiment, the games of chance listing, search, or navigation results display information for all games of chance that are operated by the selected organization.

In a forth embodiment, the games of chance listing, search, or navigation results display information only for games of chance that are operated by the selected organization that meet the criteria and conditions described infra.

Prize category and prize sub-category display listings as described infra may comprise a count of the expected listing, search, or navigation results, category image, sub-category image, category name, sub-category name, category description, or sub-category description information. This information is optional and utilized to enhance user experience.

Organization categorization display listings as described infra may comprise a count of the expected listing, search, or navigation results, organization logo or image, organization name, organization description, organization location, organization's state, organization's county, or organization's municipality information. This information is optional and utilized to enhance user experience.

While all of the above embodiments describe combinations and distributions of games of chance within various domains and processes, those skilled in the art will realize that a plurality of domains can be utilized to categorize, segment, divide, target, distribute, enhance, limit, or extend listing, search, or navigation results for games of chance or organizations operating games of chance, and are subject to preference. The utilization of the criteria and conditions, access filter, or access authorization methods and processes as described infra in conjunction with listing, search, or navigational domains or domain results comprise unique methods and processes of this invention.

Games of Chance Information and Listings

In a preferred embodiment, games of chance comprise raffles. Raffle information may comprise Raffle Identifier, Prize Identifiers, Organization Identifier, Sponsor Identifiers, Participant Identifiers, State Identifiers, County Identifiers, Municipal Identifiers, Single Prize Raffle Identifier, Choice Prize Raffle Identifier, Multiple Prize Raffle Identifier, Mega Prize Raffle Identifier, Early Bird Drawing Identifiers, Prize Group Identifiers, Drawing Identifiers, Raffle Title, Raffle Description, Raffle Images, Name of the Organization Operating the Raffle, Organization Logos or Images, Raffle Sponsors, Raffle Sponsor Logos or Images, Raffle Sponsor Advertisements, Prizes, Prize Images, Prize Sponsors, Prize Sponsor Logos or Images, Prize Sponsor Advertisements, Ticket Price, Raffle Value, Prize Value, Tickets Being Sold, Tickets Remaining, Raffle Start Date, Raffle End Date, Required Age to Participate in the Raffle, Prize Quantities, Prize Descriptions, Prize Item Option, Prize Cash Value Option, Prize Cash Towards Purchase Option, Early Bird Drawing Information, Early Bird Prize Information, Permitted States, Permitted Counties, Permitted Municipalities, Permit or License Numbers, Excluded States, Excluded Counties, Excluded Municipalities, Restricted States, Restricted Counties, Restricted Municipalities, Drawing Locations, Drawing Dates, Drawing Times, Drawing Location Driving Directions, Shipping and Delivery Information, Raffle Rules, and whether images are Actual Images or Not Actual Images. The raffle's permitted, excluded, and restricted location information comprises States, Counties, and Municipalities, and jurisdictional permit or licensing information for the raffle's governing jurisdictions. The permit or licensing information comprises the license or permit number issued by the governing jurisdiction for the raffle, and permit or licensing coverage area information if the permit or license has state-wide or county-wide coverage, or no permit or license is required if a permit or license is not required for the permitted jurisdiction. The raffle's permitted, excluded, and restricted States, Counties and Municipalities are the variables used in the conditions, as described infra, to compare user location and residency information to determine access, authorization, and participation, and are used to determine eligibility, access, or participation for the access filter or access authorization as described infra. The raffle information is structured dependant upon the raffle prize type as described infra. Raffle information is entered into the system and a data store through the Organization Account Interface where organizations operate and manage their games of chance. Raffle information may also comprise information for the organization operating and managing the raffle as described infra, and information for sponsors of the raffle or prizes as described infra.

Summarized game of chance listing results comprise portions of the information as described infra. This allows smaller amounts of information to be displayed for each game of chance, which allows a larger number of games of chance to be listing in less space. The summarized game of chance listing is a display of query and search results as described infra.

Detailed game of chance listing results comprise more detailed information about the selected game of chance as described infra. The detailed game of chance listing is a display of the results for a particular game of chance selected by a user as described infra.

Game of chance information, as described infra, comprises required and optional information. This information can be displayed or listed as described infra in any combination including or excluding any of the game of chance information, as described infra.

Sorting, Ordering, or Displaying Results

Raffle listings as described infra are able to be listed, sorted, and ordered by a user as follows; List All Raffles, List Online Raffles, List Offline Raffles, View Selected Number Per Page, Order Listing By Organization Ascending, Order Listing By Organization Descending, Order Listing By End Date Ascending, Order Listing By End Date Descending, Order Listing By Raffle Value Ascending, Order Listing By Raffle Value Descending, Order Listing By Ticket Price Ascending, Order Listing By Ticket Price Descending, Order Listing By Tickets Being Sold Ascending, Order Listing By Tickets Being Sold Descending, Order Listing By Tickets Remaining Ascending, or Order Listing By Tickets Remaining Descending. When a user alters the listing, sorting, and ordering of results as described in this paragraph, the raffle information results remain as originally described infra. The listings results are limited per page, re-ordered, or re-sorted to match the user's selected preference. Sorting and ordering listing results by Organization is only available for listings resulting from infra.

Targeted Advertisements and Advertisement Donation Beneficiaries

Listing, search, or navigation results may also comprise advertisements from member advertisers. These advertisements are displayed dependant on a user's State, County, and/or Municipality. Advertisers post advertisements within the Advertiser Account Interface. During the process of posting advertisements, advertisers select or enter the States, Counties, and/or Municipalities to permit or target the viewing of each advertisement. This enables advertisers to target the audience of an advertisement dependant on user location or residency in a similar manner as games of chance are permitted, excluded, or restricted to users, only advertisers need not exclude or restrict areas or locations, nor have the option to provide permit or licensing information since this information is not needed for posting advertisements. Excluding or restricting areas or locations is strictly optional to enable greater targeting capabilities. Advertisers are also able to configure a standard set of target areas or locations to be used for all of the advertisers advertising to bypass providing target market area or location information for each individual advertisement. Targeted advertising requires user location or residency initialization methods to establish user location or residency prior to enabling targeted advertisements to be displayed to targeted audiences. This is unique to this invention since establishing and utilizing user location or residency information is an essential part of various methods and processes of the apparatus. Without first establishing the location or residency of users, this form of target marketing is not possible.

In one embodiment of targeted advertising as described infra, a beneficiary of a donation is displayed for each advertisement. Advertisers are able to select a member user to receive a donation comprising a portion of the amount spent on the advertisement or some other fixed amount. As each advertisement is displayed, the beneficiary of the donation is also displayed.

In a second embodiment of targeted advertising beneficiary as described infra, a portion of the amount spent on the advertisement, or some other fixed amount, can be donated to a random member user, or given away as a prize, rather than a donation, to a member user. The system is able to randomly select a user from a database to name as the beneficiary for the advertisement. The beneficiary would then be able to be notified by the system of their being selected as the beneficiary, and given information for the advertisement, advertiser, and amount to be received.

Types of Raffles

The apparatus of this invention supports single prize raffles, choice prize raffles, multiple prize raffles, and mega prize raffles as described infra.

Single prize raffles comprise a single prize, a single drawing in which a single winning ticket is drawn, and a single winner.

Choice prize raffles comprise multiple prizes where only one prize will be selected to be received by the winning ticket holder, a single drawing in which a single winning ticket is drawn, and a single winner.

Multiple prize raffles comprise multiple prizes, multiple drawings in which a winning ticket is drawn for each individual prize, and multiple winners.

Mega prize raffles comprise a combination of infra. Mega prize raffles comprise multiple prize groups where each prize group may comprise a single prize drawing as described infra or a choice prize drawing as described infra. For example, the raffle may comprise a first prize drawing, a second prize drawing, and a third prize drawing where the first prize drawing comprises a choice of one of three prizes where only one winning ticket will be drawn for first prize and only one of the three prizes will be selected to be received by the winner, while the second and third place drawings comprise one prize each where one winning ticket will be drawn for second prize and one winning ticket will be drawn for third prize, and the second and third prize winners will receive the designated second and third prizes. The overall structure is a multiple prize raffle which may comprise prize levels comprising either a single prize or a choice of prizes.

Multiple prize raffles and mega prize raffles, as described infra, support early bird drawings. Early bird drawings occur when early bird ticket sales amount or early bird drawing dates have been reached. Early bird drawings occur prior to the main raffle drawing and comprise single prize raffle, choice prize raffle, and multiple prize raffle groups. Early bird drawings are raffles within a raffle that occur prior to the main raffle drawing.

Early bird drawings for multiple prize raffles comprise one prize for each early bird drawing. Multiple prize raffles can comprise of one or more early bird drawings.

Early bird drawings for mega prize raffles comprise prize groups that contain a single prize, a choice of one of multiple prizes, or multiple prizes for each early bird drawing. Mega prize raffles can comprise one or more early bird drawings each containing one or more raffle prize groups. Early bird drawings for mega prize raffles can be structured like mega prize raffles as described infra, but with different drawing ticket sales amounts and/or drawing dates.

Single prize listings comprise information for a single prize.

Choice prize listings comprise information for multiple prizes of which only one prize will be selected to be received by the winning ticket holder.

Multiple prize listings comprise information for multiple prizes and drawings including information for early bird prizes and drawings.

Mega prize listings comprise information for multiple prize groups and multiple prize group drawings including information for early bird prize groups and drawings.

Early bird drawing listings comprise information for early bird prizes and drawings.

Users are able to select the "new search" option to return to the search and browsing categorization domains to transverse other domains containing games of chance. This allows the system to maintain the user's location, residency, and age information and avoids the need for the user to reestablish this information for the access filter as described infra. This option is available within summary and detail games of chance listings.

Users are also able to email games of chance information to others. The system contains an email form that allows users to send games of chance information to single or multiple email addresses. This option is available within games of chance summary and detail listings.

User Participation

Games of chance participation occurs when users purchase or request a chance to win a game of chance. Chances to win can either be purchased or requested without purchase either online, offline, or both online and offline. The majority of games of chance require participants to purchase chances to win, although purchasing chances to win may not be required in some cases, such as with a sweepstakes type of game of chance where there is no purchase necessary to participate or win.

Offline participation occurs when a chance to win a game of chance is not purchased or requested using online payment or participation methods and processes.

Online participation occurs when a chance to win a game of chance is purchased or requested using online payment or participation methods and processes.

Online and offline participation occur when a chance to win a game of chance can be purchased or requested both online and offline as described infra.

In one embodiment, user information is dynamically populated into participation, purchasing, and transaction forms and form objects from a database.

In a second embodiment, user information is manually entered into participation, purchasing, and transaction forms and form objects by the user.

In a third embodiment, sales or participating sales locations where a chance to win a game of chance can be purchased or requested are displayed and listed.

Online participation comprises games of chance information as described infra, information for the organization operating or managing the game of chance as described infra, and purchase or participation forms comprising participant information, as described infra, or a request for participant information. Purchase or participation forms may also comprise the number of tickets to purchase or request, the amount of the total purchase, the option to purchase or request the remaining tickets if the desired amount is no longer available as described infra, additional participant information, and participant's payment information if payment is required to receive a chance to win a game of chance. Participant information is entered or populated into the purchase or participation form as described infra. Online participation information may vary or be required as necessary for participation or transaction processing dependant on access authorization, transaction authorization gateway, AVS, and payment processing requirements.

In one embodiment, participants are required to agree to the rules for the game of chance in order to be able to participate by applying their electronic signature. For example, this can be done by requiring the participant to check a check box indicating the participant has read and agrees to the rules for the game of chance.

Offline participation comprises offline participation information for the game of chance. Offline participation information comprises games of chance information, as described infra, information for the organization operating or managing the game of chance as described infra, and purchase or participation location information, as described infra, such as the Location Name, Location Address, Location State, Location County, Location Municipality, Location ZIP or Postal Code, Location Telephone Number, Location Facsimile Number, Location Email Address, and Location Website URL. Users are also able to receive driving directions to any of the sales or participating sales locations by entering the user's address information in a form, and submitting the form to receive driving directions to the selected location. If user login, as described infra, is required before accessing the participation section of the system, the user's address information can be dynamically populated into the driving direction request form automatically.

Each organization operating games of chance has their own merchant account and payment authorization gateway. Merchant account and transaction authorization gateway information for the organization operating each specific game of chance for processing sales and accepting donations is dynamically populated into financial transaction processes and sections of the system. This allows multiple organizations to accept payments and donations using their own merchant accounts and transaction authorization gateways through a single channel or venue.

Games of chance that have sold or delivered all available chances to win are listed as sold out and no additional chances to win can be purchased or requested.

When a game of chance surpasses its scheduled end date, no additional chances to win can be purchased or requested.

Sales cap protection prevents participants from purchasing or requesting more tickets than available for sale. The available number of tickets for sale is determined by subtracting tickets sold from the maximum number of tickets offered for sale. Sales cap protection prevents users from selecting or entering a number greater than the number of tickets available. Participants are not able to enter or select a number of tickets to purchase or request that is greater than the number of tickets remaining. For example, if only ten tickets are remaining, the system will not allow a participant to select or enter a value greater than ten.

Sales cap closeout protection prevents participants from purchasing more tickets than available for sale when the sales cap protection, as described infra, enables a participant to select or enter a value for the number of tickets to purchase that is no longer available since the purchase or participation form was first accessed. Purchasing tickets online requires availability to be confirmed prior to processing transactions to prevent selling more tickets than the maximum number of tickets offered for sale. This can occur when a limited number of tickets are remaining and multiple users attempt to purchase a combined number of tickets greater than what is available. The sales cap protection, as described infra, only prevents the user from selecting or entering a number of tickets to purchase or request that is greater than the number of remaining tickets at the time the purchasing or participation form is first accessed. From the time the participation section was first accessed to the time the user actually submits the purchasing or participation form for processing, the number of remaining tickets may have diminished due to tickets purchased or requested by other users during that time frame. This is especially critical when the number of tickets purchased or requested by other users reduces the available number of tickets to less than the number of tickets a single user is attempting to purchase. Sales cap closeout protection prevents over selling tickets by first confirming availability of the selected or entered number of tickets upon user submission of the purchasing or participation form, then placing a hold on the number of tickets requested if available tickets, next the purchase transaction is processed, and finally the sale of the tickets is completed. If the transaction fails, the hold is taken off of the tickets and the tickets are made available for purchase once again. The availability of the tickets and the number of tickets to hold while the transaction is being processed is determined by either user selection, input, or the number of tickets remaining dependent on the embodiment chosen by the ticket purchaser or participant as described infra, and can be applied to the sale of any number of types of tickets or any limited quantity items.

In one embodiment, sales cap closeout protection can be set to either evaluate the purchase of a set number of tickets or evaluate the purchase of a number of tickets equal to or less than a set number of tickets. In this embodiment a user is able to either purchase the number of tickets selected or entered, or if the number of tickets attempted to be purchased is no longer available, purchase all remaining tickets available.

In a second embodiment, sales cap closeout protection can be set to either purchase the number of tickets selected or entered, or if the number of tickets selected or entered is no longer available, do not purchase any tickets.

Participating in games of chance may require users to agree to rules of the game before transactions may occur.

In one embodiment, participants are required to agree to the rules of the game before the user is able to submit the participation, purchase, or payment form for processing. This agreement may comprise the participant applying their electronic signature. For example, this can be done by requiring the participant to check a check box indicating the participant has read and agrees to the rules for the game of chance.

In another embodiment, participants are not required to agree to the rules of the game before the user is able to submit the participation, purchase, or payment form for processing.

Participation Confirmation, Receipts, and Raffle Tickets

Raffle ticket information is stored in a database upon completion of the purchasing or participation process. This ticket information is then utilized to generate printable tickets comprising raffle information as described infra, organization information as described infra, sponsor information as described infra, participant information as described infra, and a unique ticket number and/or a ticket sequence number as described infra. Ticket information also comprises text or notice requirements by governing jurisdictions as described infra.

Ticket purchase receipts comprise raffle information, as described infra, organization information as described infra, participant information as described infra, and transaction information comprising the Transaction Result, Transaction Identification Number, Number of Ticket Purchased or Received, Total Amount of the transaction, and information returned from a transaction authorization gateway. Participants are able to print this receipt or print the tickets purchased or received for the game of chance selected.

Raffle tickets comprise two parts, the participant part and the drawing part. The participant and drawing parts of a raffle ticket comprises ticket information as described infra. The participant part of a raffle ticket comprises additional text or notices as described infra. The participant part of a raffle ticket may also act as a receipt for the purchase of each raffle ticket. The drawing part of the raffle ticket is a form of raffle ticket stub that is used to conduct a raffle drawing to determine the winner of a drawing or prize. Raffle ticket drawings may be conducted physically as in a traditional manual raffle drawing, or electronically using an algorithm to randomly select tickets or winners.

Raffle Ticket Numbering and Sequencing

The creation of unique raffle ticket numbers is performed by combining the unique identification numbers of the organization operating the raffle, the raffle, the participant, and the participant's ticket. The methods for generating unique ticket numbers are described infra. Any one of these embodiments can be utilized to generate unique ticket numbers. Including the unique identifier for the organization operating the raffle within the ticket number is optional, but preferred for more detailed ticket identification purposes.

In a preferred embodiment, the unique raffle ticket number appears as 1-2-3-4 with the first number comprising the unique identification number of the organization operating and managing the game of chance, the second number comprising the unique identification number of the game of chance, the third number comprising the unique identification number of the participant or ticket holder, and the fourth number comprising a variable comprising that represents or identifies each unique ticket. For example, if the user purchased three tickets for a particular game of chance, the ticket numbers would appear as 1-2-3-A, 1-2-3-B, 1-2-3-C, where A, B, and C are unique identification numbers for each particular ticket purchased for a particular game of chance. The unique identification numbers comprise unique identifiers created by a database, such as a SQL Database, and database software, such as Microsoft SQL Server manufactured by Microsoft Corporation, which create unique identifiers for each data set record. Combining these unique identifiers in the format described will always create unique and identifiable ticket numbers. The identifiers described above can be placed in any order or delimited with any delimiter to produce a unique and identifiable ticket number.

In one embodiment, the variable that represents each unique ticket identification number as described infra, comprises the unique identification number for the data set record of the ticket. For example, if the user purchased three tickets for a particular game of chance, the ticket numbers would appear as follows; 1-2-3-109, 1-2-3-418, 1-2-3-519. The unique identification numbers for the tickets, "109," "418," and "519," comprise unique identifiers created by a database, such as a SQL Database, and database software, such as Microsoft SQL Server manufactured by Microsoft Corporation, which creates a unique identifier for each data set record.

In a second embodiment, the variable that represents each unique ticket identifier as described infra, comprises the ticket count number for the number of tickets purchased by the user for a particular game of chance. For example, if the user purchased three tickets for a particular raffle the ticket numbers would appear as follows; 1-2-3-1, 1-2-3-2, 1-2-3-3. Using the ticket count numbers, "1," "2," and "3," in place of the unique data set record identification number created by a database still creates a unique ticket number when combined with the other unique identification numbers as described infra. This provides a method to easily view and track the number of tickets held by a participant for any given game of chance.

In a third embodiment, the variable that represents each unique ticket identifier as described infra, comprises the ticket sequence number for a particular game of chance, as described infra. For example, if the user purchased three tickets for a particular game of chance the ticket numbers would be appear follows; 1-2-3-10, 1-2-3-11, 1-2-3-12. Using the ticket sequence numbers, "10," "11," and "12," in place of the unique data set record identification number created by a database still creates a unique ticket number when combined with the other unique identification numbers as described infra. This provides a method to easily view and track the number of tickets held by a participant for any given game of chance.

Raffle ticket sequencing generates a sequence number for each ticket beginning at the number one and counting upwards in increments of one until the last ticket is reached. Governing jurisdictions or regulators of games of chance may require tickets or ticket numbers to be sequenced in this manner.

In one embodiment, sequenced ticket numbers, or ticket sequence numbering, are generated upon raffle activation as described infra.

In a second embodiment, sequenced ticket numbers, or ticket sequence numbering, are generated when drawing tickets are generated as described infra.

Required Text or Notices for Raffle Tickets

Certain text or notices may be required to be displayed on each raffle ticket sold dependant on the governing jurisdiction of the organization operating the raffle, the governing jurisdiction of the raffle, or the governing jurisdiction of the participant's location and residency. Text or notice information is retrieved from a data source for the governing State, County, and/or Municipality as they exist within the system's data source.

In one embodiment, the required text to be displayed on each ticket sold is determined by the location of the organization operating the raffle.

In a second embodiment, the required text to be displayed on each ticket sold is determined by the governing jurisdiction of the raffle.

In a third embodiment, the required text to be displayed on each ticket sold is determined by the location and residency of the participant or ticket holder.

Participant Printing of Raffle Tickets

Participants are able to print their tickets upon the successful completion of the ticket purchase transaction or participation process. Participants are also able to print their raffle tickets from the Participant Account Interface, as described infra.

Games of Chance Interface Topologies and Variations

Figure 17:
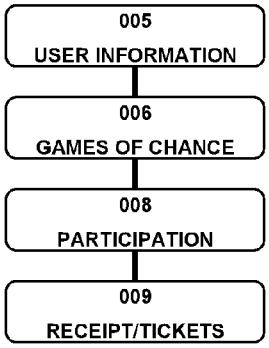
FIG. 17 is a block diagram which illustrates a sample games of chance access and participation process topology and document access structure of the apparatus as described infra, comprising elements as described infra.

As shown in FIG. 17, one embodiment of the process topology for FIG. 2, Node 101, Games of Chance Interface, at the broadest level comprises first establishing user location, residency, and age as described infra. Then the access filter is applied as described infra. Next games of chance are categorized and displayed as described infra. Finally participation in games of chance occurs as described infra. User registration for participation may or may not be utilized dependant on which embodiments have been configured to be used by the system.

Figure 18:
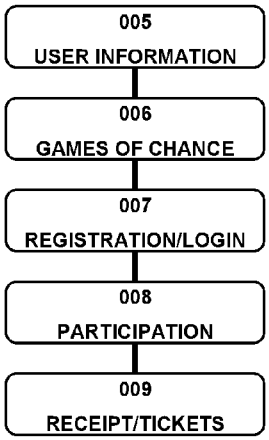
FIG. 18 is a block diagram which illustrates a sample games of chance access and participation process topology and document access structure of the apparatus as described infra, comprising elements as described infra.

As shown in FIG. 18, a second embodiment of the process topology for FIG. 2, Node 101, Games of Chance Interface, at the broadest level comprises first establishing user location, residency, and age as described infra. Any one or more of these methods for establishing user location, residency, or age is used. Once user location, residency and age are established the access filter is applied as described infra. This is the preferred embodiment because it enables listing and display results to be filtered with the access filter from the beginning of the process. This enables users to view only relevant information for their location, residency, and age prior to attempting to participate in a game of chance. Next games of chance are categorized and displayed as described infra. Next access authorization is applied as described infra. If the user is already a registered member, the user is able login to access the participation section. If the user is not a registered member, the user is able to register. Upon completing participant registration the access authorization checks eligibility and either takes the user directly to the participation section for the game of chance or takes the user to an error handler to notify the user he/she is not eligible to participate in the selected game of chance. Finally participation in games of chance occurs as described infra.

Figure 19:
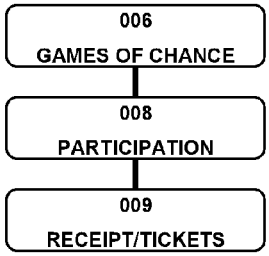
FIG. 19 is a block diagram which illustrates a sample games of chance access and participation process topology and document access structure of the apparatus as described infra, comprising elements as described infra.

As shown in FIG. 19, a third embodiment of the process topology for FIG. 2, Node 101, Games of Chance Interface, at the broadest level comprises first games of chance are categorized and displayed as described infra. Next access authorization can be applied as described infra. If the user is already a registered member, the user is able to login to access the participation section. If the user is not a registered member, the user is able to register. Upon completing participant registration the access authorization checks eligibility and either takes the user directly to the participation section for the game of chance or takes the user to an error handler to notify the user he/she is not eligible to participate in the selected game of chance. User registration for participation may or may not be utilized dependant on which embodiments have been configured to be used by the system. Finally participation in games of chance occurs as described infra.

Figure 20:
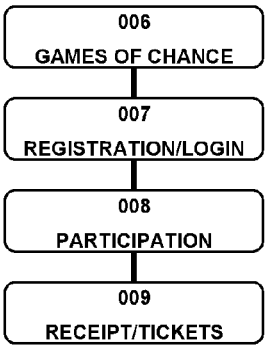
FIG. 20 is a block diagram which illustrates a sample games of chance access and participation process topology and document access structure of the apparatus as described infra, comprising elements as described infra.

As shown in FIG. 20, a fifth embodiment of the process topology for FIG. 2, Node 101, Games of Chance Interface, at the broadest level comprises first games of chance are categorized and displayed as described infra. Next access authorization can be applied as described infra. If the user is already a registered member, the user is able to login to access the participation section. If the user is not a registered member, the user is able to register. Upon completing participant registration the access authorization checks eligibility and either takes the user directly to the participation section for the game of chance or takes the user to an error handler to notify the user he/she is not eligible to participate in the selected game of chance. Finally participation in games of chance occurs as described infra.

While all of the above embodiments describe combinations and distributions of methods and processes, those skilled in the art will realize that the functionality is able to be distributed over a plurality of methods and processes. The primary dependency of the system for operating and managing games of chance is as described infra. The placement of access control points for the control of user access as described infra are variable dependent on the architectural preference of processes and are able to be configured by system administrators from within the System Administrator Account Interface.

Although the system as a whole in the preferred embodiment focuses on raffles as the game of chance, the core of the system, as described infra, can be applied to determine user accessibility, eligibility, and participation for a plurality of conventional and non-conventional games of chance or lotteries. Other components of this invention comprise methods for providing input data to be used by processes and logical determinants as described infra, as well as methods to utilize user input, information, and data necessary to the processes, as described infra, to provided additional functionality. This invention comprises components and interfaces which create a centralized venue for gaming activity. Those skilled in the art will also realize the functionality can be distributed over a plurality of computers, servers, internet service providers, domains, websites, and web pages. Distributing the functionality in such a manner may enable entities to operating and managing games of chance independently. Nothing in the system's architecture should be construed to limit methods, processes, and functionality to a single venue even though it is the preferred embodiment of the apparatus.

FIG. 18, Block 007 and FIG. 20, Block 007, the registration and login processes establish variables or identifiers within the system for the user's state, county, municipality, and age which are able to be edited or altered only from the Participant Account Interface. These variables are dynamically populated into all participation forms and can not be altered or changed in these forms.

Figure 35:
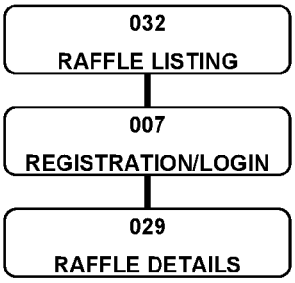
FIGS. 35 to 49 are block diagrams which illustrate samples of games of chance searching and browsing processes of the apparatus which produce variable display results derived from user information, input, or selection as described infra.
Figure 36:
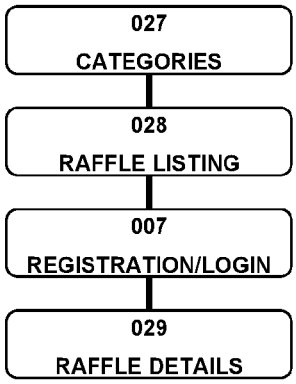
Figure 37:
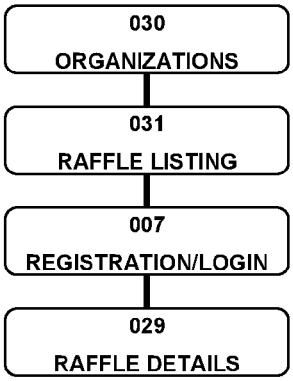
Figure 38:
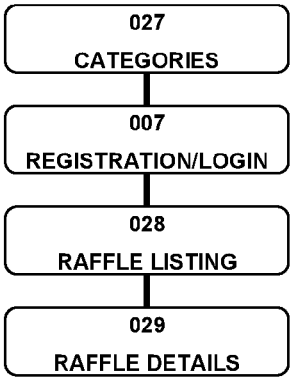
Figure 39:
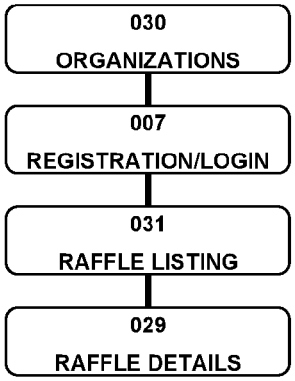
Figure 40:
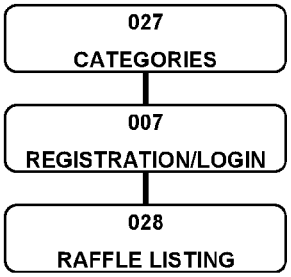
Figure 41:
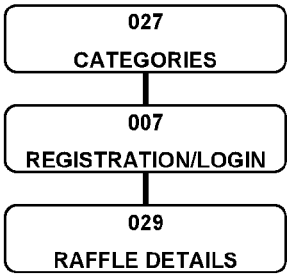
Figure 42:
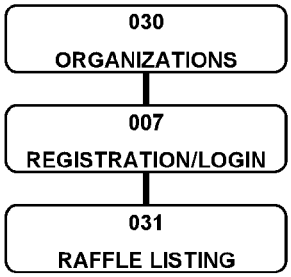
Figure 43:
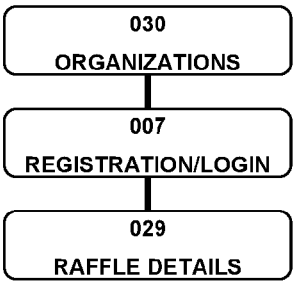
Figure 44:
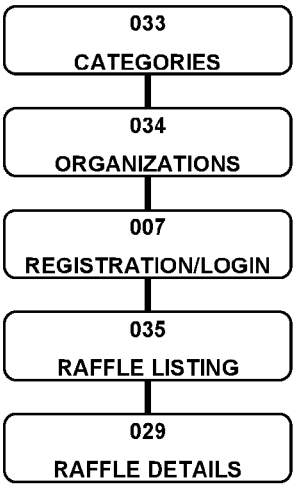
Figure 45:
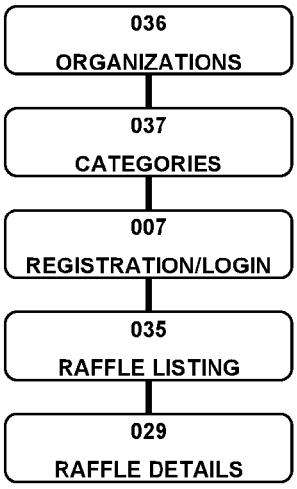
Figure 46:
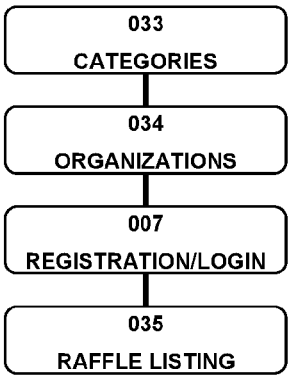
Figure 47:
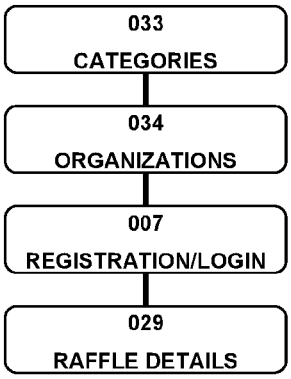
Figure 48:
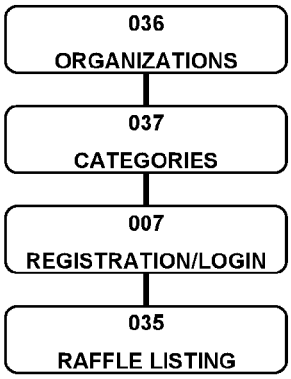
Figure 49:
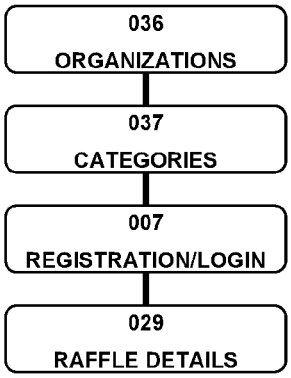
Figure 50:
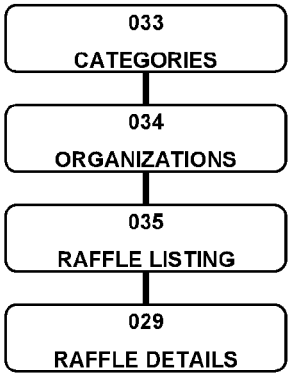
Figure 51:
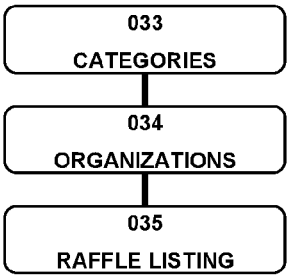
Figure 52:
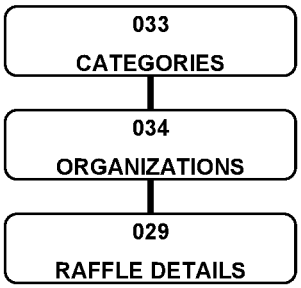
Figure 53:
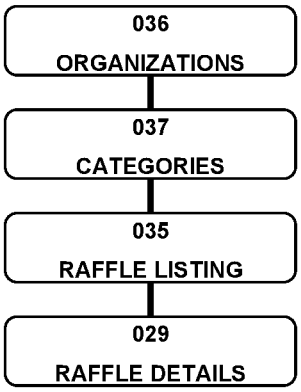
Figure 54:
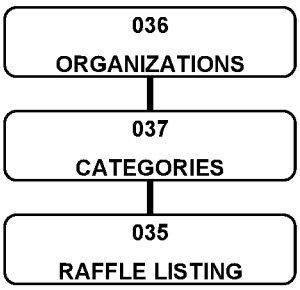
Figure 55:
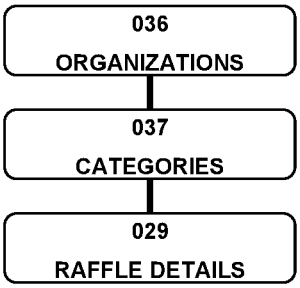
Figure 56:
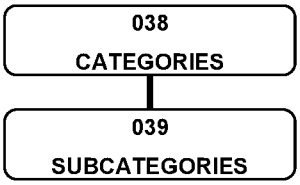
FIG. 56 is a block diagram which illustrates a sample games of chance searching and browsing process of the apparatus which enables categories to be further defined by sub-categories to target games of chance searching and browsing by more specific information as described infra.
Figure 57:
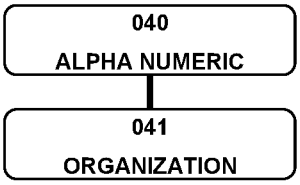
FIGS. 57 to 63 are block diagrams which illustrate samples of games of chance searching and browsing processes of the apparatus which produce variable display results derived from user organization or sponsor search criteria, input, or selection as described infra.
Figure 58:
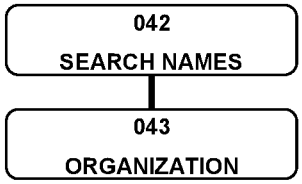
Figure 59:
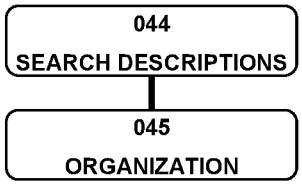
Figure 60:
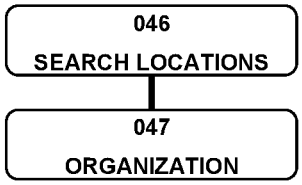
Figure 61:
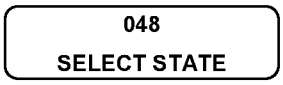
Figure 62:
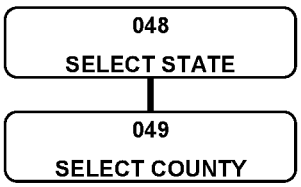
Figure 63:
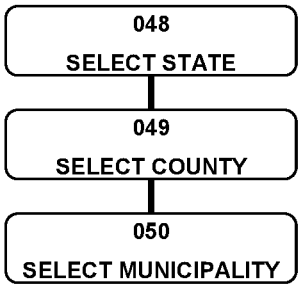
Figure 72:
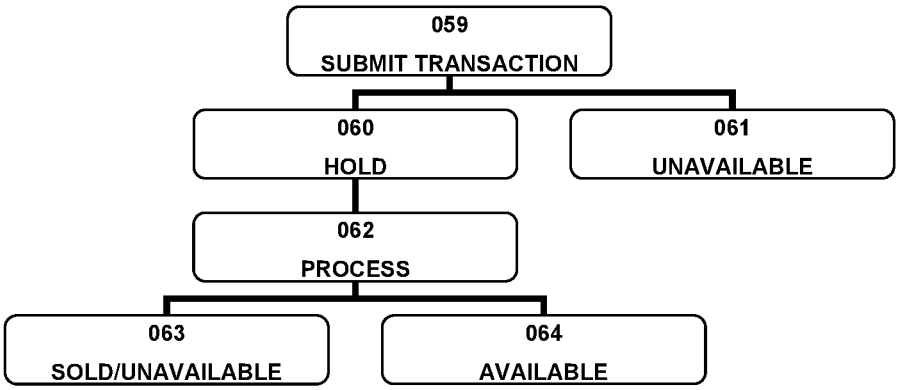
FIG. 72 is a block diagram which illustrates a sample ticket sales cap protection process of the apparatus as described infra.
Figure 73:
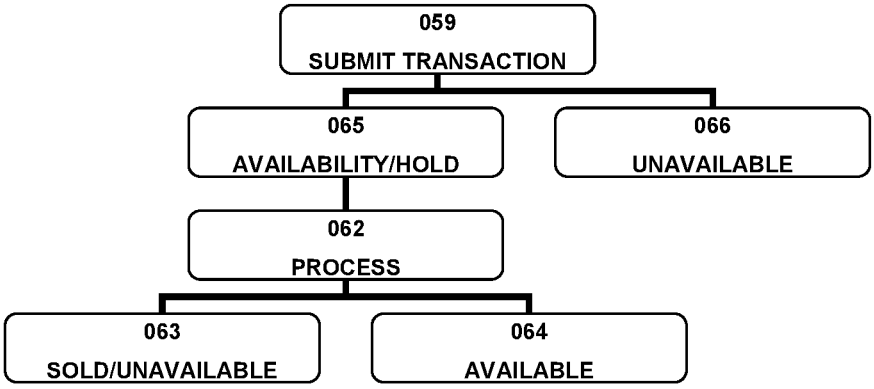
FIG. 73 is a block diagram which illustrates a sample ticket sales cap closeout protection process of the apparatus as described infra.
Figure 74:
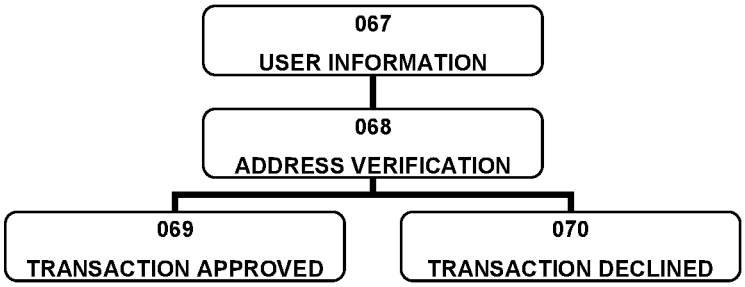
FIG. 74 is a block diagram which illustrates a sample address verification process of the apparatus as described infra.
Figure 75:
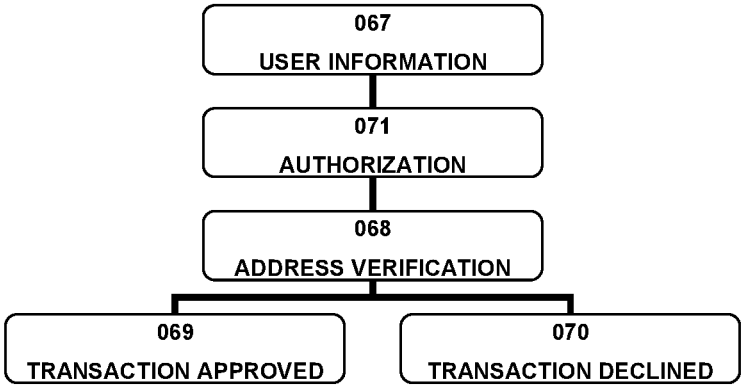
FIG. 75 is a block diagram which illustrates a sample address verification process of the apparatus as described infra.

With reference to FIG. 17, Block 006 and FIG. 19, Block 006, the user registration or login describe above may be placed anywhere within the Games of Chance block processes. This is shown in FIG. 35, Block 007; FIG. 36, Block 007; FIG. 37, Block 007; FIG. 38, Block 007; FIG. 39, Block 007; FIG. 40, Block 007; FIG. 41, Block 007; FIG. 42, Block 007; FIG. 43, Block 007; FIG. 44, Block 007; FIG. 45, Block 007; FIG. 46, Block 007; FIG. 47, Block 007; FIG. 48, Block 007; and FIG. 49, Block 007.

In a preferred embodiment as described infra, FIG. 2, Node 101 first requires users to establish their location, residency, and age as described infra. Next the data results for categories, sub-categories, or organization searches and listings are filtered by the criteria and conditions as described infra and displayed to the user. Next games of chance listings are filtered by the criteria and conditions as described infra and displayed to the user for the selected path chosen by the user. Then when a user selects a game of chance in which to participate, the user is required to either login or register, as described infra, to initiate an access control loop as described infra. This checks user eligibility for the game of chance selected. Once authorized the user accesses the appropriate participation process for the game of chance and completes the participation process.

FIG. 2, Node 102: Membership Registration Interface

Membership Interface comprises methods and processes for membership and user registration. Registrants input information into registration forms establishing user information to be utilized by the system. This information is then inserted into a database or file system structure. Once registration and membership is approved, users will have access to their appropriate member account interfaces to manage and administer their accounts. The system retrieves user information as needed or requested by the system to populate dynamic variables into computer code, dynamic web pages, dynamic content, forms, form objects, strings of code, and calculations or algorithms. Unique identifiers are created for each registered user and each individual data record set to distinguish between users to enable multiple users within the same user group to use the system and its interfaces independently.

FIG. 10, Node 108: Organization Membership Registration

In order for an organization or entity to operate and manage games of chance, the organization must first become a registered member and user of the system. Only registered organizations are able to access Organization Account Interfaces for their user account.

Registration comprises entering organization information into a registration form or forms. The membership registration form comprises the Organization Membership Agreement, Registrant First Name, Registrant Last Name, Registrant Title, Registrant Email Address, Registrant Password, Registrant Password Confirmation, Security Question, Security Question Answer, Organization Name, Organization Identification Number, Organization Address, Organization State, Organization County, Organization Municipality, Organization ZIP or Postal Code, Organization Telephone, Organization Facsimile, Organization Profile, Organization Website URL, Organization Logo or Images, Organization Email Addresses, and Organization Electronic Signature.

In one embodiment, the organization's account is activated upon submittal of the registration form, and the registration data has been inserted into a database or file system structure.

In a second embodiment, the organization's account is pending activation upon submittal of the registration form, and the registration data has been inserted into a database. Once the organization's information has been inserted into a database, the registrant is provided with a facsimile cover sheet that comprises dynamically populated "to" and "from" information, or some other method for requesting entity or registrant proof information. The organization's account is pending activation until the organization provides copies of corporate documentation or proof of identity for the organization and the registrant. Once proof of identity has been established and confirmed, the organization's account is activated and the registrant is able to login and access the Organization Account Interface for their user account.

Upon registration submittal and insertion of user data into a database, each entity and registrant is assigned a unique identifier. Upon activation, this unique identifier is utilized by the system and its code as variables of functions and processes to identify users for a multitude of tasks, functions, processes, and controls allowing the system to operate dynamically.

The relevance of the registration process is the collection of user data and information to be used by the system to dynamically populate content and code variables for various documents, pages, functions, methods, and processes. Registration also enables the system to comprise a closed loop network which controls user access to interfaces and their components. An object of the registration processes is to not only collect user data and information, but to collect location information to establish State, County, and Municipality identifiers to determine regulatory and operational requirements, determine governing jurisdictions, and enable system controls and functions to operate. Registration also allows multiple users within specified user groups to utilize the system through a single channel or venue while maintaining autonomy, yet pooling resources such as the tremendous cross marketing benefits.

FIG. 10, Node 109: Sponsor Membership Registration

In order for a sponsor or entity to sponsor games of chance, the sponsor must first become a registered member and user of the system. Only registered sponsors are able to access Sponsor Account Interfaces for their user account.

Registration comprises entering sponsor information into a registration form or forms. The membership registration form comprises the Sponsor Membership Agreement, Registrant First Name, Registrant Last Name, Registrant Title, Registrant Email Address, Registrant Password, Registrant Password Confirmation, Security Question, Security Question Answer, Sponsor Name, Sponsor Identification Number, Sponsor Address, Sponsor State, Sponsor County, Sponsor Municipality, Sponsor ZIP or Postal Code, Sponsor Telephone, Sponsor Facsimile, Sponsor Profile, Sponsor Website URL, Sponsor Logo or Images, Sponsor Advertisements, Sponsor Email Addresses, and Sponsor Electronic Signature.

In one embodiment, the sponsor's account is activated upon submittal of the registration form, and the registration data has been inserted into a database or file system structure.

In a second embodiment, the sponsor's account is pending activation upon submittal of the registration form, and the registration data has been inserted into a database. Once the sponsor's information has been inserted into a database, the registrant is provided with a facsimile cover sheet that comprises dynamically populated "to" and "from" information, or some other method for requesting entity or registrant proof information. The sponsor's account is pending activation until the sponsor provides copies of corporate documentation or proof of identity for the sponsor and the registrant. Once proof of identity has been established and confirmed, the sponsor's account is activated and the registrant is able to login and access the Sponsor Account Interface for their user account.

Upon registration submittal and insertion of user data into a database, each entity and registrant is assigned a unique identifier. Upon activation, this unique identifier is utilized by the system and its code as variables of functions and processes to identify users for a multitude of tasks, functions, processes, and controls allowing the system to operate dynamically.

The relevance of the registration process is the collection of user data and information to be used by the system to dynamically populate content and code variables for various documents, pages, functions, methods, and processes. Registration also enables the system to comprise a closed loop network which controls user access to interfaces and their components. An object of the registration processes is to not only collect user data and information, but to collect location information to establish State, County, and Municipality identifiers to determine regulatory and operational requirements, determine governing jurisdictions, and enable system controls and functions to operate. Registration also allows multiple users within specified user groups to utilize the system through a single channel or venue while maintaining autonomy.

FIG. 10, Node 110: Participant Membership Registration

In order for a user or entity to participate in games of chance, the user must first become a registered member and user of the system. Only registered participants are able to access Participant Account Interfaces for their user account.

Registration comprises entering participant information into a registration form or forms. The membership registration form comprises the Participant Membership Agreement, Registrant First Name, Registrant Last Name, Registrant Email Address, Registrant Password, Registrant Password Confirmation, Security Question, Security Question Answer, Participant Address, Participant State, Participant County, Participant Municipality, Participant ZIP or Postal Code, Participant Telephone, Participant Facsimile, Participant Date of Birth, Participant Age, Participant Email Notification Subscription, and Participant Electronic Signature.

The participant's account is activated upon submittal of the registration form, and the registration data has been inserted into a database or file system structure.

Upon registration submittal and insertion of user data into a database, each entity and registrant is assigned a unique identifier. This unique identifier is utilized by the system and its code as variables of functions and processes to identify users for a multitude of tasks, functions, processes, and controls allowing the system to operate dynamically.

The relevance of the registration process is the collection of user data and information to be used by the system to dynamically populate content and code variables for various documents, pages, functions, methods, and processes. Registration also enables the system to comprise a closed loop network which controls user access to interfaces and their components. An object of the registration processes is to not only collect user data and information, but to collect location information to establish State, County, Municipality, and Age identifiers to determine regulatory and operational requirements, determine governing jurisdictions, enable system controls and functions to operate, and provide input variables for the access filter and access authorization controls and conditions as described infra. Registration also allows multiple users within specified user groups to utilize the system through a single channel or venue while maintaining autonomy. Registered participants who choose to receive information by subscribing to the Participant Email Notification Subscription will be notified of games of chance permitted for their location and eligibility upon activation of games of chance, games of chance activity information for games of chance in which the participant has participated, special offers from sponsors sponsoring games of chance in which the participant is participating, special offers from advertisers advertising to the participant's location, and notification of winners for games of chance in which the participant has participated.

FIG. 10, Node 111: Advertiser Membership Registration

In order for an advertiser or entity to advertise to users, the advertiser must first become a registered member and user of the system. Only registered advertisers are able to access Advertiser Account Interfaces for their user account.

Registration comprises entering advertiser information into a registration form or forms. The membership registration form comprises the Advertiser Membership Agreement, Registrant First Name, Registrant Last Name, Registrant Title, Registrant Email Address, Registrant Password, Registrant Password Confirmation, Security Question, Security Question Answer, Advertiser Name, Advertiser Identification Number, Advertiser Address, Advertiser State, Advertiser County, Advertiser Municipality, Advertiser ZIP or Postal Code, Advertiser Telephone, Advertiser Facsimile, Advertiser Profile, Advertiser Website URL, Advertiser Logo or Images, Advertiser Advertisements, and Advertiser Electronic Signature.

In one embodiment, the advertiser's account is activated upon submittal of the registration form, and the registration data has been inserted into a database or file system structure.

In a second embodiment, the advertiser's account is pending activation upon submittal of the registration form, and the registration data has been inserted into a database. Once the advertiser's information has been inserted into a database, the registrant is provided with a facsimile cover sheet that comprises dynamically populated "to" and "from" information, or some other method for requesting entity or registrant proof information. The advertiser's account is pending activation until the advertiser provides copies of corporate documentation or proof of identity for the advertiser and the registrant. Once proof of identity has been established and confirmed, the advertiser's account is activated and the registrant is able to login and access the Advertiser Account Interface for their user account.

Upon registration submittal and insertion of user data into a database, each entity and registrant is assigned a unique identifier. Upon activation, this unique identifier is utilized by the system and its code as variables of functions and processes to identify users for a multitude of tasks, functions, processes, and controls allowing the system to operate dynamically.

The relevance of the registration process is the collection of user data and information to be used by the system to dynamically populate content and code variables for various documents, pages, functions, methods, and processes. Registration also enables the system to comprise a closed loop network which controls user access to interfaces and their components. An object of the registration processes is to not only collect user data and information, but to collect location information to establish State, County, and Municipality identifiers to determine operational requirements and enable system controls and functions to operate.

FIG. 10, Node 112: Regulator Membership Registration

In order for a regulator or entity to regulate games of chance, the regulator must first become a registered member and user of the system. Only registered regulators are able to access Regulator Account Interfaces for their user account.

Registration comprises entering regulator information into a registration form or forms. The membership registration form comprises the Regulator Membership Agreement, Registrant First Name, Registrant Last Name, Registrant Title, Registrant Email Address, Registrant Password, Registrant Password Confirmation, Security Question, Security Question Answer, Regulator Name, Regulator Identification Number, Regulator Address, Regulator State, Regulator County, Regulator Municipality, Regulator ZIP or Postal Code, Regulator Telephone, Regulator Facsimile, Regulator Profile, Regulator Website URL, Regulator Logo or Images, Regulator Email Addresses, and Regulator Electronic Signature.

In one embodiment, the regulator's account is activated upon submittal of the registration form, and the registration data has been inserted into a database or file system structure.

In a second embodiment, the regulator's account is pending activation upon submittal of the registration form, and the registration data has been inserted into a database. Once the regulator's information has been inserted into a data store, the registrant is provided with a facsimile cover sheet that comprises dynamically populated "to" and "from" information, or some other method for requesting entity or registrant proof information. The regulator's account is pending activation until the regulator provides copies of corporate documentation or proof of identity for the regulator and the registrant. Once proof of identity has been established and confirmed, the regulator's account is activated and the registrant is able to login and access the Regulator Account Interface for their user account.

Upon registration submittal and insertion of user data into a database, each entity and registrant is assigned a unique identifier. Upon activation, this unique identifier is utilized by the system and its code as variables of functions and processes to identify users for a multitude of tasks, functions, processes, and controls allowing the system to operate dynamically.

The relevance of the registration process is the collection of user data and information to be used by the system to dynamically populate content and code variables for various documents, pages, functions, methods, and processes. Registration also enables the system to comprise a closed loop network which controls user access to interfaces and their components. An object of the registration processes is to not only collect user data and information, but to collect location information to establish State, County, Municipality, and Age identifiers to determine regulatory and operational requirements, determine governing jurisdictions, enable system controls and functions to operate, and establish regulatory boundaries.

FIG. 10, Node 113: Affiliate Membership Registration

In order for an affiliate or entity to promote games of chance, the affiliate must first become a registered member and user of the system. Only registered affiliates are able to access Affiliate Account Interfaces for their user account.

Registration comprises entering affiliate information into a registration form or forms. The membership registration form comprises the Affiliate Membership Agreement, Registrant First Name, Registrant Last Name, Registrant Title, Registrant Email Address, Registrant Password, Registrant Password Confirmation, Security Question, Security Question Answer, Affiliate Name, Affiliate Identification Number, Affiliate Address, Affiliate State, Affiliate County, Affiliate Municipality, Affiliate ZIP or Postal Code, Affiliate Telephone, Affiliate Facsimile, Affiliate Profile, Affiliate Website URL, Affiliate Logo or Images, Affiliate Advertisements, Affiliate Email Addresses, and Affiliate Electronic Signature.

In one embodiment, the affiliate's account is activated upon submittal of the registration form, and the registration data has been inserted into a database or file system structure.

In a second embodiment, the affiliate's account is pending activation upon submittal of the registration form, and the registration data has been inserted into a database. Once the affiliate's information has been inserted into a database, the registrant is provided with a facsimile cover sheet that comprises dynamically populated "to" and "from" information, or some other method for requesting entity or registrant proof information. The affiliate's account is pending activation until the affiliate provides copies of corporate documentation or proof of identity for the affiliate or the registrant. Once proof of identity has been established and confirmed, the affiliate's account is activated and the registrant is able to login and access the Affiliate Account Interface for their user account.

Upon registration submittal and insertion of user data into a database, each entity and registrant is assigned a unique identifier. Upon activation, this unique identifier is utilized by the system and its code as variables of functions and processes to identify users for a multitude of tasks, functions, processes, and controls allowing the system to operate dynamically.

The relevance of the registration process is the collection of user data and information to be used by the system to dynamically populate content and code variables for various documents, pages, functions, methods, and processes. Registration also enables the system to comprise a closed loop network which controls user access to interfaces and their components. An object of the registration processes is to not only collect user data and information, but to collect location information to establish State, County, Municipality, and Age identifiers to determine regulatory and operational requirements, determine governing jurisdictions, and enable system controls and functions to operate. The relevance to this information is due to regulatory requirements that may limit who are eligible to promote or sell chances to win a game of chance.

FIG. 2, Node 103: Organization Directory Interface

The Organization Directory Interface comprises methods and processes for displaying information about registered member organizations. The Organization Directory Interface enables users to view information for each organization, games of chance operated by the organization, and organization events. Users are also able to make donations to the organization, visit the organization's website when available, and contact the organization. The Organization Directory Interface comprises a directory of information for registered member organizations. Content for the Organization Directory Interface is derived from the registration process information, as described infra, and components of the Organization Directory Interface as described infra.

Users are able to search for organizations by searching organization names, descriptions, alpha-numeric characters, subject categories, subject sub-categories, or organization location, state, county, and/or municipality, or view a listing of all registered member organizations. Any one or all of these search methods are available to the user. Search results produce listings of all organizations that meet the search criteria. Users then select an organization to view a directory website, page, or listing for the selected organization which comprise information about the organization, its activities, and information and components as described infra. The Organization Directory Interface and its pages are dynamically generated through the use of data variables from a database comprising organization information as well as user input. Users are able to navigate and transverse the Organization Directory Interface through links and buttons.

FIG. 11, Node 114: Direct Link Interface

The Direct Link Interface allows a user to directly access games of chance operated and managed by a specific organization from an organization's individual Organization Directory Interface website, page, or listing, and bypasses the games of chance categorization and organization search processes as described infra. The code for the Direct Link Interface link can also be copied and pasted into pages contained in external websites or pages to drive traffic to games of chance operated by specific organizations as described infra. The code for the Direct Link Interface link contains the unique identifier for a specific organization to be used to determine which games of chance to display.

In one embodiment, users click on a link or button which goes to the location or residency initialization process, as described infra. Once the location, residency, and age of the user have been established, a listing of games of chance operated by the organization is displayed as described infra.

In a second embodiment, users click on a link or button which takes users to a listing of games of chance operated by the organization that is displayed as described infra.

The system uses the unique identifier of the organization to determine and retrieve games of chance listing information specific to the organization of interest. This enables the system to target and direct users to specific games of chance by bypassing unnecessary browsing, and drives traffic directly to games of chance operated by a particular organization.

FIG. 11, Node 115: Games of Chance Listing and Direct Link Interface

The Games of Chance Listing and Direct Link Interface is a combination of a games of chance listing comprising a listing of games of chance operated by an organization, and the Direct Link Interface as described infra. A listing of the games of chance operated by the organization is displayed along with direct access to the games of chance contained within this listing as described infra.

FIG. 11, Node 116: Donation Interface

The Donation Interface allows users to make donations to registered member organizations. The Donation Interface comprises organization information as described infra, and a donation form or forms. The donation form, or forms, requests transaction information from users comprising the Donor's First Name, Donor's Last Name, Donor's Address, Donor's State, Donor's County, Donor's Municipality, Donor's ZIP or Postal Code, Donor's Email Address, Donation Amount, and donor's payment information.

The donation form, or forms, is dynamically populated with the organization's merchant account and transaction authorization gateway information. This avoids aggregation of funds and allows donations to be made directly to the merchant account of a specific organization while allowing the system to operate dynamically.

Upon completion of payment, donor information is stored in a database for access by the Organization Account Interface and a confirmation of the transaction is displayed to the donor.

FIG. 11, Node 117: Event Interface

The Event Interface allows organizations to post event information. The Event Interface comprises organization information, as described infra, a searchable event calendar, and an event listing comprising event information.

Event information comprises the event title or heading, event data, event description, event location, event start time, event end time, event contact information, event notices, event reservation information, event ticket sales locations, and/or event ticket price.

Users are able to search for past, current, and future events operated by an organization by browsing the event calendar. The event calendar allows users to browse dates by days, months, and/or years. Dates that contain events are highlighted to notify users that an event is listed for a date. Users can click on highlighted dates to view event information for the date selected.

Event listings comprises event information, as described infra, a reservation form, and/or an event ticket purchase form. By default, the next event to occur chronologically is displayed first. Using the event calendar, as described infra, enables a user to navigate events.

In one embodiment, if an event requires reservations, a reservation form is displayed and made accessible to the user. The event attendee reservation form information comprises the Attendee's First Name, Attendee's Last Name, Attendee's Address, Attendee's State, Attendee's County, Attendee's Municipality, Attendee's ZIP or Postal Code, Attendee's Telephone Number, Attendee's Facsimile Number, Attendee's Email Address, and Number of Attendee's Guests. The organization operating the event may also choose to implement a maximum ticket sales amount and utilize the sales cap and over sales closeout protection processes as described infra to limit the number of seats available for the event. In this embodiment raffle ticket sales are replaced by reservation or event tickets within the Event Interface.

Upon submittal of the reservation form, the attendee will receive confirmation of reservation and a printable attendance ticket comprising attendee information and event information as described infra. Attendee information is stored in a database for access by the Organization Account Interface.

In a second embodiment, if an event requires the purchase of an attendance ticket, a ticket purchase form is displayed and made accessible to the user. The event ticket purchase form information comprises the Attendee's First Name, Attendee's Last Name, Attendee's Address, Attendee's State, Attendee's County, Attendee's Municipality, Attendee's ZIP or Postal Code, Attendee's Telephone Number, Attendee's Facsimile Number, Attendee's Email Address, Number of Tickets to be Purchased, Total Purchase Amount, and Attendee's ticket purchase payment information. The organization operating the event may also choose to implement a maximum ticket sales amount and utilize the sales cap and over sales closeout protection processes as described infra to limit the number of seats available for the event. In this embodiment raffle ticket sales are replaced by reservation or event tickets within the Event Interface.

Upon submittal of the event ticket purchase form, the attendee will receive confirmation of purchase and printable attendance tickets comprising attendee information and event information as described infra. Attendee information is stored in a database for access by the Organization Account Interface.

FIG. 11, Node 118: Contact Interface

In addition to providing organization contact information as described infra, the Contact Interface enables users to contact organizations via an email form which is dynamically populated with the organization's information and email address. Users provide their Name, Email Address, Email Subject, and Email Message in a contact form. Upon submittal, the message is sent to the designated email address of the organization.

FIG. 11, Node 119: Link Interface

The Link Interface enables users to click on a link or button to view an external website for the organization. The organization's website URL is dynamically populated into the code for the link or button.

FIG. 2, Node 104: Sponsor Directory Interface

The Sponsor Directory Interface comprises methods and processes for displaying information about registered member sponsors. The Sponsor Directory Interface enables users to view information for each sponsor and games of chance sponsored by the sponsor. Users are also able to visit the sponsor's website when available, and contact the sponsor. The Sponsor Directory Interface comprises a directory of information for registered member sponsors. Content for the Sponsor Directory Interface is derived from the registration process information as described infra and components of the Sponsor Directory Interface as described infra.

Users are able to search for sponsors by searching sponsor names, descriptions, alpha-numeric characters, subject categories, subject sub-categories, or sponsor location, state, county, and/or municipality, or view a listing of all registered member sponsors. Any one or all of these search methods are available to the user. Search results produce listings of all sponsors that meet the search criteria. Users then select a sponsor to view a directory website, page, or listing for the selected sponsor which comprise information about the sponsor, its activities, and information and components as described infra. The Sponsor Directory Interface and its pages are dynamically generated through the use of data variables from a database comprising sponsor information as well as user input. Users are able to navigate and transverse the Sponsor Directory Interface through links and buttons.

FIG. 12, Node 120: Direct Link Interface

The Direct Link Interface for the Sponsor Directory Interface is identical to the Direct Link Interface as described infra, only the organization unique identifier is replaced with the sponsor unique identifier and games of chance sponsored by the sponsor are displayed rather than games of chance operated by an organization. Games of chance sponsored by a sponsor may comprise games of chance operated by multiple organizations rather than an individual organization.

FIG. 12, Node 121: Games of Chance Listing and Direct Link Interface

The Games of Chance Listing and Direct Link Interface for the Sponsor Directory Interface is identical to the Games of Chance Listing and Direct Link Interface as described infra, only games of chance sponsored by the sponsor are listed rather than games of chance operated by an organization and the Direct Link Interface utilizes the unique identifier for the sponsor rather than the organization as described infra.

FIG. 12, Node 122: Contact Interface

In addition to providing contact information as described infra, the Contact Interface enables users to contact sponsors via an email form that is dynamically populated with the sponsor's information and email address. Users provide their Name, Email Address, Email Subject, and Email Message in a contact form. Upon submittal, the message is sent to the designated email address of the sponsor.

FIG. 12, Node 123: Link Interface

The Link Interface enables users to click on a link or button to view an external website for the sponsor. The sponsor's website URL is dynamically populated into the code for the link or button.

FIG. 2, Node 105: Advertiser Member Directory Interface

The Advertiser Directory Interface comprises methods and processes for displaying information about registered member advertisers. The Advertiser Directory Interface enables users to view information for each advertiser, advertisements from the advertiser, and organizations receiving donations from, or the support of, the advertiser through donations originating from the advertiser's advertisements. Users are also able to visit the advertiser's website when available, and contact the advertiser. The Advertiser Directory Interface comprises a directory of information for registered member advertisers. Content for the Advertiser Directory Interface is derived from the registration process information as described infra and components of the Advertiser Directory Interface as described infra.

Users are able to search for advertisers by searching advertiser names, descriptions, alpha-numeric characters, subject categories, subject sub-categories, or advertiser location, state, county, and/or municipality, or view a listing of all registered member advertisers. Any one or all of these search methods are available to the user. Search results produce a listing of all advertisers that meet the search criteria. Users then select an advertiser to view a directory website, page, or listing for the selected advertiser which comprise information about the advertiser, its activities, and information and components as described infra. The Advertiser Directory Interface and its pages are dynamically generated through the use of data variables from a data store comprising advertiser information as well as user input. Users are able to navigate and transverse the Advertiser Directory Interface through links and buttons.

FIG. 13, Node 125: Advertisement Interface

The Advertisement Interface displays all active advertisements that have been posted by an advertiser. These advertisements may be rotated in an interval displaying each advertisement one at a time.

FIG. 13, Node 126: Beneficiary Listing Interface

The Beneficiary Listing Interface comprises a listing of organizations that have been chosen by the advertiser to receive a portion of the advertising expenditure in the form of a donation. When an advertiser purchases advertising, the advertiser is required to select an organization to be a beneficiary of a portion of the advertising cost. For example, if an advertiser spends one hundred dollars on advertising through the system, a fixed currency amount or a percentage of the one hundred dollars will be donated to the selected organization. The Beneficiary Listing Interface is a listing of all of the organizations that the advertiser has chosen to receive this donation and benefited from the advertiser's advertising.

FIG. 13, Node 127: Contact Interface

In addition to providing contact information as described infra, the Contact Interface enables users to contact advertisers via an email form that is dynamically populated with the advertiser's information and email address. Users provide their Name, Email Address, Email Subject, and Email Message in a contact form. Upon submittal, the message is sent to the designated email address of the advertiser.

FIG. 13, Node 128: Link Interface

The Link Interface enables users to click on a link or button to view an external website for the advertiser. The advertiser's website URL is dynamically populated into the code for the link or button.

FIG. 1, Node 200 and FIG. 3: Organization Account Interface

The Organization Account Interface enables organizations to operate and manage games of chance, manage organization account information, and acts as a control panel for organizational interfaces and components.

FIG. 3, Node 201: Account Management Interface

The Account Management Interface comprises methods, processes, forms, and form objects for the management of organization information as described infra. Organizations are able to edit their registration or membership information from this section, including uploading advertiser logos or images to a server.

The Account Management Interface also enables organizations to add, edit or delete users of the Organization Account Interface for their organization, and assign access permissions to their users which determine which interface, or sections of interfaces, or components of the Organization Account Interface each user is able to access.

FIG. 3, Node 202: Merchant Account Management Interface

The Merchant Account Management Interface enables organizations to setup and manage their own individual merchant account and transaction authorization gateway. This interface comprises merchant and gateway account applications, financial management tools, dynamic reports, payment method information for licensing and billing by the system owner, licensing and billing information, and support for single or multiple merchant and gateway accounts.

Merchant Account Setup

The first step is to apply for a merchant account and transaction authorization gateway. Applications comprise downloadable and printable applications that can be submitted to merchant account and gateway providers, as well as an electronic application system which enables organizations to submit electronic applications that are dynamically populated with organization information as described infra. For the electronic application, the organization may be required to input financial information for submittal to merchant account and gateway providers such as depository account information.

In one embodiment, the system utilizes a single merchant account and a single transaction authorization gateway provider. The electronic and non-electronic applications are standardized and comprise standardized rates and fees for all member organizations. Organizations are able to select the methods of payment to accept for games of chance participation and donations.

In a second embodiment, the system utilizes multiple merchant account and multiple transaction authorization gateway providers. The electronic and the non-electronic applications are specific to each individual provider. The organization selects the desired provider to access the appropriate account application. The merchant account and gateway rates or fees may in some cases be standardized for particular providers for all member organizations, while in other cases rates or fees may be determined per application or organization account for other providers. Organizations are able to select the methods of payment to accept for games of chance participation and donations.

In one embodiment, each individual merchant account and transaction authorization gateway provider offers a standardized set of rates and fees to all member organizations. These rates and fees can be entered into a database for the organization as described infra.

In a second embodiment, each individual merchant account and transaction authorization gateway provider offers rates and fees to member organizations on an individual application or account basis. These rates and fees are entered into a database for the organization as described infra.

Once the organization has submitted their merchant account and gateway applications, and the applications have been approved, the merchant account and gateway information can be entered into the system to setup the transaction processing information that is dynamically populated into participation, transaction, and payment form variables for the organization's games of chance, donations, and events.

The merchant account and gateway information comprises rates, fees, store identifiers, merchant identifiers, transaction identifiers, or other identifiers, files, or information necessary for processing electronic transactions and accepting payments.

Rate and fee information comprises discount rates, transaction fees, gateway fees, merchant fees, AVS fees, and other surcharges or fees charged or collected by merchant account and gateway providers for processing transactions and verifying the address of participants, buyers, or donors.

In one embodiment, the rates and fees, as described infra, are automatically entered into a database for the organization.

In a second embodiment, the rates and fees, as described infra, are manually entered into a database by the organization.

Once all of the required merchant account and gateway information has been entered into the system, the organization is able to accept payment for games of chance participation, donations, and event attendance.

The Merchant Account Interface comprises merchant account and transaction authorization gateway management components, payment method information management for licensing and billing as described infra, activation or deactivation of the organization's Donation Interface as described infra, licensing and billing summaries, and financial reporting for games of chance and donation transaction activity.

Licensing and Billing

Dependant on the business model, the organization may be charged a licensing fee for use of the system. A "Licensing Billing System" enables organizations to be charged a licensing fee in the form of a flat rate for a specified period of time, or a percentage of revenue billed over increments of time.

In one embodiment, a billing cycle begins upon activation of a game of chance. The billing cycle establishes a time period for which usage of the system will be billed. Billing can occur over a single billing cycle or multiple billing cycles.

In a second embodiment, a billing cycle begins upon activation of the organization's account as described infra. The billing cycle establishes a time period for which usage of the system will be billed.

The Licensing Billing System can be configured to bill at the beginning or end of a period of time established by a billing cycle.

In one embodiment, if the licensing fee is a flat rate for a period of time, the licensing billing can occur at the beginning or end of a billing cycle.

In a second embodiment, if the licensing fee is a percentage of revenue, the licensing billing occurs at the end of a billing cycle after an accurate account of revenue can be determined for a billing cycle.

Billing cycles are listed in licensing billing summary listings. Summary listings for billing cycles comprise billing cycle start and end dates, the billing cycle status, and the amount accrued or due. Billing cycles can be either listed by billing cycle dates, games of chance, or both. The Licensing Billing System can be configured in a preferred embodiment to bill licensing fees per game of chance, and list billing cycles for each individual game of chance.

Billing cycle status is represented as current, due tomorrow, due today, past due, or the billing cycle can be represented as sold out if the game of chance has sold out, or differed to the next billing cycle if the amount accrued is below a set amount for a billing cycle.

Details for billing cycles are accessible from billing cycle summary listings when a user selects the billing cycle to view. Billing cycle details comprise information as described infra, status of whether the bill has been paid, status of whether the bill has been differed to the next billing cycle and the amount of the deferment, status of whether an attempt to pay a bill has failed, status of whether the bill is late and the late fee amount, late payment date if the bill was late, and total charges for the billing cycle.

Billing cycle histories can also be accessed from billing cycle summary listings. Billing cycle histories comprise listings of billing cycle details, as described infra, for billing cycles as described infra.

Billing cycle methods of payment are established by the organization through the Merchant Payment section of the Merchant Account Interface. The Merchant Payment section comprises information for the organizations preferred method of payment for licensing fees. These payment methods comprise credit card, debit card, electronic check, electronic transfer, or other electronic methods of payment or non-electronic methods of payment. Upon a billing cycle becoming due, organizations are able to make payments via the Merchant Payment section. Past due billing cycles are assessed late fees and billing cycles that have accrued less than a set amount of licensing fees may be differed to the next billing cycle without accruing any late penalties.

The Reporting section of the Merchant Account Interface comprises reporting tools for games of chance and donation transaction activity. To access reports organizations select the type of report to view. The organization can select to view reports for games of chance or donations. Once a selection is made the organization selects a reporting period by selecting or entering the start date and end date for the desired reporting period. Organizations are then able to view reports for the selected or entered period.

Merchant Account Interface raffle reports comprise the Number of Tickets Sold, Revenue, Transaction Fees, Processing Fees, Rates, Surcharges, Payment Methods, and Total Charges. The fees and rates are able to be listed by the type of transaction and transaction methods accepted by the organization to provide accurate details. For example, for credit card transactions, transactions are able to be listed by credit card type. The organization is able to view the total discount rate and transaction fees charged by each individual credit card. These reports also display transaction activity for each individual date from the start date to the end date of the selected or entered reporting period. These reports are able to comprise all transaction activity for all games of chance combined within the specified reporting period, or list transaction activity for individual games of chance within the specified reporting period. In addition to raffle financial information, organizations are also able to access participant listings comprising participant information, as described infra, for raffle participation within the specified reporting period.

Merchant Account Interface donation reports comprise the Number of Donations Made, Revenue, Transaction Fees, Processing Fees, Rates, Surcharges, and Total Charges. The fees and rates are able to be listed by the type of transaction and transaction methods accepted by the organization to provide accurate details. For example, for credit card transactions, transactions are able to be listed by credit card type. The organization is able to view the total discount rate and transaction fees charged by each individual credit card. These reports also display transaction activity for each individual date from the start date to the end date of the selected or entered reporting period. These reports are able to comprise all transaction activity for all donors combined within the specified reporting period, or list transaction activity for individual donors within the specified reporting period. In addition to donation financial information, organizations are also able to access donor listings comprising donor information, as described infra, for donations made within the specified reporting period.

FIG. 3, Node 203: Games of Chance Management Interface

The Games of Chance Management Interface enables organization to operate and manage games of chance. In a preferred embodiment, the games of chance are raffles.

Entering Raffle Information into the System

Organizations must add or post raffles by entering information as described infra into a database. Entering raffle information also comprises establishing online, offline, or both online and offline participation methods as described infra, establishing the raffle prize type as described infra, and establishing key variables such as permitted, excluded, or restricted States, Counties, or Municipalities as described infra. Organizations are able to add or post as many raffles as desired.

For ease of use, the process for providing raffle information and storing this information in a database can be structured in a number of ways as long as all necessary information has been provided as required for the Game of Chance Interface to operate and function properly, and establish the key variables for the access, display, and participation criteria and conditions, access filter, and access authorization as described infra, as well as establishing methods and listing structures for participation as described infra.

In one embodiment, the process for adding raffles can be structured as a list of tasks where each tasks is linked to sections, pages, forms, form objects, and functions that enable the user to provide information and insert this information into a database or file system structure.

In a second embodiment, the process for adding raffles can be structured as a step by step process comprising tasks where each task comprises pages, sections, forms, form objects, and functions that enable the user to provide information and insert this information into a database or file system structure.

Information is inserted into a database while images and files are uploaded to folders in directories to be accessed by the system through the Organization Account Interface and its various component interfaces. Dependant on the system configuration, images can be uploaded and stored in a database.

To add a raffle to the system, an organization begins by providing basic raffle information comprising a raffle title or heading, and a description of the raffle, or provide additional raffle information as described infra. This initial step establishes the identifiers for a raffle within a database. Data entry for raffle information, as described infra, can comprise a combination or distribution of steps.

Configuring Ticket Sales and Participation Methods

Next, the organization selects the type of raffle ticket sales or participation method as described infra, and is given the option to establish pre-activation participation. Pre-activation participation allows the organization to manually enter participant information, create a participant account, and produce raffle tickets for participants who have purchased tickets or requested participant prior to the activation of the raffle as described infra.

Configuring Types of Raffles and Entering Prize Information

Next, the organization selects the raffle prize type or raffle type structure as described infra. This determines the number of prizes and drawings the raffle will be able to comprise.

Single prize type raffles, as described infra, comprise entering prize data and information for a prize comprising a Prize Category and/or Prize Sub-Category, as described infra, Raffle Item or Item Heading, Prize Images, Prize Image Upload component which allows images to be uploaded from the user's computer to a server, option to notify participants the image is not the actual image of the prize, Prize Description, Prize Value, Prize Cost, Prize Quantity, and Prize Options such as Raffle Item, Cash Value, and Cash Towards Purchase. An example image is also provided displaying how to scale and crop images to avoid distortion when the system resizes the images during the upload process to the required dimensions. If no images are provided, and error handler automatically provides a default image stating no image is available. The same is true for all images that require uploading from interface components. Images are resized to meet the display and listing requirements of the system. Once this information has been provided and inserted into a database, no additional prizes can be added and the process of adding prize information to the raffle is finished.

Choice prize type raffles, as described infra, comprise entering prize data and prize information for a prize comprising Prize Category and/or Prize Sub-Category, as described infra, Raffle Item or Item Heading, Prize Images, Prize Image Upload component which allows images to be uploaded from the user's computer to a server, option to notify participants that the image is not the actual image of the prize, Prize Description, Prize Value, Prize Cost, Prize Quantity, and Prize Options such as Raffle Item, Cash Value, and Cash Towards Purchase. An example image is also provided displaying how to scale and crop images to avoid distortion when the system resizes the images during the upload process to the required dimensions. If no images are provided, and error handler automatically provides a default image stating no image is available. The same is true for all images that require uploading from interface components. Images are resized to meet the display and listing requirements of the system. Once this information has been provided and inserted into a database, the organization is able to add additional prizes to this raffle. Prizes can continue to be added to this type of raffle, but only one winner will be selected and be offered a choice of only one of these prizes. For example, the prize may comprise a choice of one of three luxury vehicles. In this example one winner will be selected to receive one prize. Once all of the prizes for this raffle have been inserted into a database, the process of adding prize information to the raffle is finished.

Multiple prize type raffles, as described infra, comprise entering prize data and prize information for a prize comprising Prize Category and/or Prize Sub-Category, as described infra, Raffle Item or Item Heading, Prize Images, Prize Image Upload component which allows images to be uploaded from the user's computer to a server, option to notify participants that the image is not the actual image of the prize, Prize Description, Prize Value, Prize Cost, Prize Quantity, and Prize Options such as Raffle Item, Cash Value, and Cash Towards Purchase. An example image is also provided displaying how to scale and crop images to avoid distortion when the system resizes the images during the upload process to the required dimensions. If no images are provided, and error handler automatically provides a default image stating no image is available. The same is true for all images that require uploading from interface components. Images are resized to meet the display and listing requirements of the system. Once this information has been provided and inserted into a database, the organization is able to add additional prizes to this raffle. Prizes can continue to be added to this type of raffle. Each prize added creates a prize level. For example, adding three prizes creates a first prize, second prize, and a third prize. Multiple prize type raffles comprise only one prize listing per prize level. For example, first prize may comprise a luxury vehicle, second prize may comprise a motorcycle, third prize may comprise a vacation package, and fourth prize may comprise three televisions. In this example six winners would be selected to receive one prize each. Once all of the prizes for this raffle have been inserted into a database, the process of adding prize information to the raffle is finished.

Multiple prize type raffles also comprise Early Bird Drawings and Prizes as described infra. The prize information for early bird prizes for multiple prize type raffles are the same as described infra. Multiple prize type raffle prize information comprises an additional early bird prize option when adding prizes to the raffle. By selecting the early bird prize option, the prize is designated as an early bird prize. As the information for each early bird prize is inserted into a database, an additional step is added to establish the early bird drawing information for the early bird prize. If the prize has a cost of zero, the early bird drawing can occur at a set ticket number of ticket sales, a drawing date, or both a set number of ticket sales or a drawing date, which ever occurs first. If the prize cost is greater than zero, the early bird drawing can only occur at a set number of ticket sales. Dependant on prize cost, the appropriate early bird drawing information can be inserted into a database. Because the focus of raffle participation is the main drawing and early bird drawings are considered types of bonus drawings for early participation, this evaluation of prize cost is essential to prevent profit losses. For example, if there are two early bird drawings, one at two thousand ticket sales and the other on a set date, and one thousand five hundred are sold by the end of the date for the early bird with the set drawing date, and the remaining five hundred ticket are sold the next day, this could not only cause severe losses to occur, but also leave no margin of revenue for the main drawing. This is especially critical if no more tickets are sold by the time the drawing date for the main drawing has been reached. The methods and calculations used to determine profitability is described further infra. Multiple prize type raffle early bird drawings comprise only one prize listing per prize level. For example, first prize may comprise a luxury vehicle, second prize may comprise a motorcycle, third prize may comprise a vacation package, and fourth prize may comprise three televisions. In this example six winners would be selected to receive one prize each.

Mega prize type raffles, as described infra, comprise entering prize data and prize information for a prize comprising Prize Category and/or Prize Sub-Category, as described infra, Raffle Item or Item Heading, Prize Images, Prize Image Upload component which allows images to be uploaded from the user's computer to a server, option to notify participants that the image is not the actual image of the prize, Prize Description, Prize Value, Prize Cost, Prize Quantity, and Prize Options such as Raffle Item, Cash Value, and Cash Towards Purchase. An example image is also provided displaying how to scale and crop images to avoid distortion when the system resizes the images during the upload process to the required dimensions. If no images are provided, and error handler automatically provides a default image stating no image is available. The same is true for all images that require uploading from interface components. Images are resized to meet the display and listing requirements of the system. Once this information has been provided and inserted into a database, the organization is able to add additional prizes to this raffle. Prizes can continue to be added to this type of raffle. Each prize added creates a prize level. For example, adding three prizes creates a first prize, second prize, and a third prize. In addition to adding individual prize levels as in a multiple prize type raffle, mega prize type raffles enable the addition of choice prize type raffle groups within each prize level. For example, first prize may comprise a choice of one of three luxury vehicles, second prize may comprise a choice of one of two motorcycles, third prize may comprise a vacation package, and fourth prize may comprise three televisions. The prizes are grouped by level and any prize group comprising more than one prize is treated as a choice prize group. Each level can comprise either a single prize or a choice of prizes. For example, first prize may comprise a choice of one of three luxury vehicles, second prize may comprise a choice of one of two motorcycles, third prize may comprise a vacation package, and fourth prize may comprise three televisions. In this example six winners would be selected to receive one prize each. Once all of the prizes for this raffle have been inserted into a database, the process of adding prize information to the raffle is finished.

Mega prize type raffles also comprise Early Bird Drawings as described infra. Mega prize type raffle early bird drawings comprise prize groups for each prize level. Each prize group may comprise of one or more prizes. For example, first prize may comprise a choice of one of three luxury vehicles, second prize may comprise a choice of one of two motorcycles, third prize may comprise a vacation package, and fourth prize may comprise three televisions. In this example six winners would be selected to receive one prize each. Once all of the prizes for this raffle have been inserted into a database, the process of adding prize information to the raffle is finished.

Single prize type raffle prize management options comprise view prize information, edit prize information, delete or remove prize information, and add a sponsor for the prize.

Choice prize type raffle prize management options comprise view prize information, edit prize information, delete prize information, add a sponsor for the prize, add another prize, and edit prize listing order.

Multiple prize type raffle prize management options comprise view prize information, edit prize information, delete prize information, add a sponsor for the prize, add another prize, add an early bird drawing, add an early bird prize, and edit prize listing order.

Mega prize type raffle prize management options comprise view prize information, edit prize information, delete prize information, add a sponsor for the prize, add another prize, add a prize group, edit prize group, edit prize group order, add an early bird drawing, add an early bird prize, and edit prize order.

Multiple prize type raffle early bird drawing and prize management options comprise view prize information, edit prize information, delete prize information, add a sponsor for the prize, add another prize, add an early bird drawing, edit early bird drawing, and edit prize order.

Mega prize type raffle early bird drawing and prize management options comprise view prize information, edit prize information, delete prize information, add a sponsor for the prize, add another prize, add an early bird drawing, edit early bird drawing, add a prize group, edit prize group, edit prize group order, and edit prize order.

Editing early bird prizes and drawings require evaluating drawing ticket sales amounts, drawing dates, and prize cost. Since early bird drawings that occur on a specific date must comprise prizes with a cost of zero, the system must evaluate changes to cost information when organizations edit early bird prizes. An early bird prize with a cost of zero can be placed in early bird drawings comprising ticket sales amounts, drawing dates or both ticket sales amount drawings and drawing dates. Prizes comprising a cost greater than zero can only be placed in early bird drawings comprising ticket sales amount drawings. When editing early bird drawing information, the system evaluates the type of drawing, whether the drawing is to be held at a set ticket sales amount, a date, or both dependant on which occurs first. Then the prize costs are evaluated to determine how the early bird drawing can be edited.

Prize order is initially established as prizes are added. For example, the first prize added is the first prize, the second prize added is second prize, and so on. The same is true for choice prizes where the first prize added is prize choice one, the second prizes added is prize choice two, and so on.

Single prize type raffles do not comprise an order because they comprise only one prize.

Choice prize type raffles comprise only one prize group comprising choices of prizes. The order of the prizes within prize listings for choice prize groups is initially established as prizes are added. These prizes appear as Prize Choice One, Prize Choice Two, and so on. Once prizes are added, the order in which the prize choices appear can be edited. By selecting the edit prize order option a prize listing will appear. There is an option list next to each prize listed comprising numbers. These numbers range from the number one through a number representing the count of the total number of prizes. Each option list for each individual prize comprises the order number for that particular prize as a default order value. For example, prize choice one will display the number one as the default order value, prize choice two will display the number two as the default order value, and so on. To change the order in which these prizes will appear in raffle listings, a new order number can be selected from the option list for a particular prize. The system then automatically reorders all of the prizes and displays the a prize order listing. The system takes the new order number selected for a prize, places the prize in the new position in the prize order list, and then renumbers the prizes comprising order numbers between the new order number for the prize and the original order number for the prize in sequence plus or minus one dependant on the direction of the change. For example, if there are five prizes and we change prize four to prize two, the original prize two becomes three and the original prize three becomes prize four. If we change prize two to prize four, the original prize four becomes prize three and the original prize three becomes prize two. This eliminates the need for an organization to manually renumber prize orders individually. This is especially valuable when there are a large number of prizes or prize groups.

Multiple prize type raffles comprise multiple prizes. The order of prizes within prize listings is initially established as prizes are added. These prizes appear as First Prize, Second Prize, and so on. Once prizes are added, the order in which the prizes appear can be edited. By selecting the edit prize order option a prize listing will appear. There is an option list next to each prize listed comprising numbers. These numbers range from the number one through a number representing the count of the total number of prizes. Each option list for each individual prize comprises the order number for that particular prize as a default order value. For example, first prize will display the number one as the default order value, second prize will display the number two as the default order value, and so on. To change the order these prizes will appear in raffle listings, a new order number can be selected from the option list for a particular prize. The system then automatically reorders all of the prizes and displays a new prize order listing. The system takes the new order number selected for a prize, places the prize in the new position in the prize order list, and then renumbers the prizes between the new order number for the prize and the original order number for the prize in sequence plus or minus one dependant on the direction of the change. For example, if there are five prizes and we change prize four to prize two, the original prize two becomes three and the original prize three becomes prize four. If we change prize two to prize four, the original prize four becomes prize three and the original prize three becomes prize two. This eliminates the need for an organization to manually renumber prize orders individually. This is especially valuable when there are a large number of prizes or prize groups.

Mega prize type raffles comprise multiple and choice prizes. The orders of prizes are initially established as prizes are added. Prizes are able to be added as groups of prizes. Organizations are able to add another prize, add another prize to the current prize group, add another prize to another existing prize group, or add another prize to create a new prize group. These prizes appear as First Prize, Second Prize, Third Prize Choice One, Third Prize Choice Two, and so on. Essentially Mega prize type raffles are multiple prize type raffles that encapsulate a single prize or a choice of prizes. Once prizes are added, the order in which the prizes appear can be edited, only with Mega prize type raffles are prizes able to be ordered by their encapsulating group and are able to be ordered within the same encapsulating group. By selecting the edit prize order option a prize listing will appear. Next to each prize listing is an option list comprising numbers. These numbers range from the number one through a number representing the count of the total number of prizes. Each option list for each individual prize comprises the order number for a particular prize as a default value. For example, first prize will display the number one as the default value, second prize will display the number two as the default value, and so on. To change the order these prizes will appear in raffle listings, the new order number can be selected from the option list for a particular prize. The system then automatically reorders all of the prizes and displays the new prize order listing. The system takes the new order number selected for a prize, places the prize in the new position in the prize order list, and then renumbers the prizes between the new order number for the prize and the original order number for the prize in sequence plus or minus one dependant on the direction of the change. For example, if there are five prizes and we change prize four to prize two, the original prize two becomes three and the original prize three becomes prize four. If we change prize two to prize four, the original prize four becomes prize three and the original prize three becomes prize two. This eliminates the need for an organization to manually renumber prize orders individually. This is especially valuable when there are a large number of prizes or prize groups. Since Mega prize type raffles comprise prize groups which are able to comprise one or more prize listings, an additional ordering tier is added to encapsulate each group of prizes for a particular draw. The ordering is essentially applied to the group. For example, if there will be three winners drawn for a raffle and the winners will be drawn as first prize, second prize and third prize winners, and the first prize group comprises a choice of one of three prizes, the second prize group comprises one prize, and the third prize group comprises one prize, the first prize group comprises three prizes which are able to be ordered and reordered amongst each other prize within the group. Then the groups themselves are also able to be ordered and reordered to change the structure of the prize drawings. For example with reference to the example provided above, the first prize group comprises one prize, the second prize group comprises one prize, and the third prize group comprises a choice of one of three prizes. Organizations are also able to edit or change the group in which a prize is encapsulated or comprised. By editing or changing the prize group of a prize, the prize is able to be inserted into an existing prize group or a new group is able to be created for the prize, in which the prize would be inserted. The system will automatically reorder and renumber the prizes in the original prize group and the targeted or new prize group. When a prize is removed from a prize group, the prizes that are listed after the prize that was removed are reorder by subtracting one from their order numbers. When a prize is added to a prize group, the prize is added to the selected position or to the end of the group. When the prize is place in a position within an existing prize order, the prizes after the position of the newly added prize are reordered by adding one to their order numbers. If the prize is place at the end of the list of prizes, the order number for the prize is the order number of the last prize previously listed as last in the prize group list plus one. Mega prize type raffle prize listings are automatically numbered to reflect the grouping and ordering established by the organization. This eliminates manual entry of order numbers for prizes and prize groups. Groups are able to be represented as first price, second prize, third prize, and so on. Prizes are also able to be represented as first prize, second prize, third prize choice one, third prize choice two, and so on. Combinations of prize groups and prizes are at the discretion of the organization operating the raffle.

Multiple prize type raffle early bird drawings comprise single or multiple prizes. Prize listings for early bird drawings are able to be ordered in the same manner as multiple prize type raffle prizes as described infra. Adding early bird drawings to multiple prize type raffles adds an additional dynamic to multiple prize type raffle listings. Adding early bird drawings essentially create raffles within raffles. The system dynamically creates drawing group identifiers to separate the main drawing and main drawing prize drawings from early bird drawings and early bird drawing prize drawings. Drawing group identifiers encapsulate prizes. The system orders drawing groups automatically by evaluating ticket sales amounts, drawing dates, or both ticket sales amounts and drawing dates. Multiple prize type raffle early bird drawings are dynamically numbered. For example, multiple prize type raffle early bird drawings for a raffle are labeled as Early Bird Drawing One, Early Bird Drawing Two, and so on. Prizes are listed within each early bird drawing group as described infra and ordered or reordered as described infra. The additional dynamic exists in the ordering of prizes within multiple prize type raffles and the impact on the creation or deletion of early bird drawings. If an early bird drawing comprises more than one prize, the prizes can be ordered or reordered as described infra within the early bird drawing group. When an organization removes, deletes, or moves early bird prizes from an early bird drawing group to the point where no prizes remain within an early bird drawing group, the empty early bird drawing group is removed completely and any other early bird drawing groups are reordered and relabeled automatically. When main drawing prizes are moved to early bird drawings, early bird drawing prizes are moved to the main drawing, or early bird drawing prizes are moved to another early bird drawing, the prizes within the drawing group of origin and the prizes within the destination drawing group are reordered, renumbered, and relabeled as described infra.

Mega prize type raffle early bird drawings comprise multiple and choice prizes. Prize listings for early bird drawings are able to be ordered in the same manner as mega prize type raffle prizes as described infra. Adding early bird drawings to Mega prize type raffles adds an additional dynamic to Mega prize type raffle listings. Adding early bird drawings essentially create raffles within raffles. The system dynamically creates drawing group identifiers to separate the main drawing and main drawing prize drawings from early bird drawings and early bird drawing prize drawings. Drawing group identifiers encapsulate prize groups which encapsulate prizes. The system orders drawing groups automatically by evaluating ticket sales amounts, drawing dates, or both ticket sales amounts and drawing dates. Mega prize type raffle early bird drawings are dynamically numbered. For example, mega prize type raffle early bird drawings for a raffle are labeled as Early Bird Drawing One, Early Bird Drawing Two, and so on. Prizes are listed within each early bird drawing group as described infra and ordered or reordered as described infra. The additional dynamic exists in the ordering of prizes within mega prize type raffles and the impact on the creation or deletion of early bird drawings. If an early bird drawing comprises more than one prize, the prizes can be ordered or reordered as described infra within the early bird drawing group. When an organization removes, deletes, or moves early bird prizes from an early bird drawing group to the point where no prizes remain within an early bird drawing group, the empty early bird drawing group is removed completely and any other early bird drawing groups are reordered and relabeled automatically. When main drawing prizes are moved to early bird drawings, early bird drawing prizes are moved to the main drawing, or early bird drawing prizes are moved to another early bird drawing, the prizes within the drawing group of origin and the prizes within the destination drawing group are reordered, renumbered, and relabeled as described infra.

Early bird prizes are able to be moved to the main drawing for a raffle, but when a main drawing prize or an early bird prize is moved to, or added to, another early bird drawing, the system evaluates the prize cost as described infra. This protects organizations from incurring losses under circumstances where ticket sales can not justify the expenses of operating the raffle or distributing the prizes to winners. For example, if a prize is donated it has a cost of zero. This prize can be placed in any drawing or prize group without placing the organization at risk. If a prize has been purchased by the organization, the prize has a cost associated with it. This cost creates risk. When participants purchase raffle tickets they are purchasing a chance to win a prize in the main drawing. Early bird drawings are bonus drawings that give participants an additional chance to win a prize at no additional cost in return for participating earlier in the tickets sales, active, or operational period of the raffle, therefore there must be ticket sales revenue allotted towards the main drawings. If the raffle does not meet its targeted maximum ticket sales, the organization is able to convert the raffle to a 50/50 type raffle. This type of a raffle creates an equal split of the gross ticket sales revenue to be distributed between the organization and winning ticket holders where half of the gross revenue received from ticket sales in distributed to the organizations, and the remaining half is distributed amongst winning ticket holders. This protects the organization from having to payout prizes it can not afford when ticket sales goals have not been met. A problem is created when the dynamics of early bird drawings are added to a raffle. If a raffle has two early bird drawings, one with a set ticket sales amount and another with a set drawing date, both drawing targets could be reached on the same day. This would cause both early bird drawings to be held at the same ticket sales amount essentially combining the two early birds. This comprises only part of the problem and may not cause financial harm if structured properly. The real problem is if the combined cost of the prizes is greater than the total ticket sales for the combined drawings. The purpose of multiple early birds is to drive early sales, increase participants chances of winning, and essential cover the costs of early bird prizes while generating early profits that could help cover some of the costs associated with the main drawings. If the early bird is converted to a 50/50 type raffle and no other tickets are sold, the main drawing may also need to be converted to a 50/50 type raffle as well, which would leave the organization with no profit from the raffle ticket sales. The organization would also assume the risk on the cost of any prizes purchased and any additional cost associated with operating and managing the raffle. The solution is to enable prizes with a cost greater than to zero to be placed only in main drawings or early bird drawings comprising a set ticket sales amount. Prizes that have a cost equal to zero are able to be placed in main drawings and/or early bird drawings comprising a set ticket sales amount or drawing date. No prize with a cost greater than zero dollars can be placed in any early bird drawing comprising a set drawing date. This enables the raffle to be converted to a 50/50 type raffle without risk to the organization. If sales targets are not met, but drawing dates are, the dated drawings can proceed as planned since the prizes cost the organization zero, and the raffle with the failed ticket sales targets can be converted to 50/50 type raffles. Any purchased prizes not distributed due to the 50/50 type raffle conversion can be returned, sold, auctioned, or applied to a future raffle to recover costs.

Raffle Sponsorship

Organizations are able to assign sponsors to raffles, drawings, and prizes. If no sponsor is selected, no sponsor is listed. Sponsors must be register members for organizations to be able to assign a sponsor to a raffle, drawing, or prize. Organizations are able to browse a Sponsor Directory as described infra and select a sponsor to be listed for a raffle, drawing, or prize. When an organization selects a sponsor to be listed for a raffle, drawing, or prize, the sponsor's advertisement will be automatically displayed in the raffle details listing as described infra. If no sponsors are assigned to a raffle, drawing, or prize then a random advertisement will be displayed in the raffle details listing as described infra. This process can occur during the adding of prizes or after a prize has been added. Adding a sponsor to a raffle, drawing, or prize enables sponsors to access games of chance participants for a raffle as described infra.

Configuring Permission, Exclusion, or Restriction Criteria for the Game of Chance As described infra, the permission, exclusion, and restriction criteria comprise the location or residency information of users or visitors, and the permitted, excluded, or restricted areas for games of chance. As described infra the system supports various embodiments for establishing the permission, exclusion, and restriction criteria for games of chance operated by an organization.

In a preferred embodiment, organizations are able to establish the permitted, excluded, or restricted States, Counties, and/or Municipalities for each individual game of chance the organization operates as described infra. This information can be entered or inserted into the system's database in any order for each game of chance operated. The system evaluates this data and information for each individual game of chance as applied to the conditions, as described infra, upon game of chance is activation and the game of chance start date is reached.

Permitted, excluded, and/or restricted States, Counties, and/or Municipalities are listed in listings as they are added for a game of chance. This allows the organization to keep track of the criteria that has been applied to the game of chance.

Permitting an area grants permission to users, visitors, and/or participants to view or participate in the game of chance as applied in the conditions, access filter, or access authorization as described infra.

Excluding an area restricts users, visitors, and/or participants from viewing or participating in the game of chance as applied in the conditions, access filter, or access authorization as described infra.

An excluded area is an area where an area within a permitted area is restricted form participating. For example, if New York State residence are permitted to participate, but Erie County residence are not permitted to participate, the organization would permit New York State and exclude Erie County.

A restricted area is an area where a specific area is excluded which does not reside within a permitted area. For example, if New York residences are not permitted to participate, the organization would not permit New York State.

Not permitting an area would exclude or restrict the entire area, unless there are permitted areas within the area. For example, if Erie County residences are permitted to participate, but New York State residences have not been permitted to participate nor excluded from participating, then Erie County residences will be able to participate even though Erie County is in New York State. If Erie County is the only area in New York State that has been permitted to participate, then only Erie County residence will be able to access and/or participate in the game of chance in the State of New York. All other counties within New York State will be excluded, or essentially restricted, from participating.

The system utilizes the permission of areas, and the exclusion of areas to determine accessibility and eligibility. Since not permitting and not excluding an area automatically restricts the area by not including the area in the conditions, there is no need to actually restrict an area that does not exist within a permitted area. To restrict an area the organization simply need not add it to the permissions for the game of chance. If the permission does not exist it will not be accessible, unless it exists within a permitted area. The conditions, as described infra, evaluate jurisdictional levels and depth to determine accessibility or eligibility of residences from an area by evaluating the existence of an area, the permissions, and the exclusions of areas. If the area does not appear in the permissions or within an area in the permissions, it is automatically not permitted or restricted. The exclusion of areas enables areas within permitted areas to be restricted or not permitted. If an area is both permitted and excluded at the same time, it will be excluded. Exclusions override permissions which allow smaller areas within larger areas to be singled out and excluded from access or participation.

The permission and exclusion of areas is a tiered bidirectional process that can be structured or configured to include any level of geographic, demographic, governmental, or jurisdictional boundaries, areas, locations, or regions. For the purpose of this invention the boundaries of the United States of America have been used. This does not limit the systems ability to address cross government boundaries to comprise other countries. To include other countries in the permission, exclusion, or restriction criteria and conditions as described infra, additional tiers are able to be added. For the purpose of this invention the following paragraphs continue to address permission, exclusion, or restriction criteria within the boundaries of the United States of America.

To permit residences of a state to access and/or participate in a game of chance, the organization enters or selects the state to permit from an option list, menu, link listing, or any type of form object that will allow the user to make a selection or enter information. Next, the organization establishes if no permit or license is required to be acquired or received by the organization from the selected state to operate the game of chance within the selected state, or if the permit or license acquired or received by the organization from the selected state to operate the game of chance within the selected state is the only permit or license required to operate the game of chance within the selected state and no other permits or licenses are required for jurisdictions or areas within the selected state. If the permit or license acquired or received by the organization from the selected state to operate the game of chance within the selected state is the only permit or license required to operate the game of chance within the selected state and no other permits or licenses are required for jurisdictions or areas within the selected state, the permission is a "State-Wide" permission. If the organization has acquired a permit or license from the selected state to operate the game of chance within the selected state, the organization is able to enter the permit or license number. This information is comprised in a form or forms comprising form objects used to insert and store this information in a database.

To permit residences of a county to access and/or participate in a game of chance, the organization enters or selects the county to permit from an option list, menu, link listing, or any type of form object that will allow the user to make a selection or enter information. Next, the organization establishes if no permit or license is required to be acquired or received by the organization from the selected county to operate the game of chance within the selected county, or if the permit or license acquired or received by the organization from the select county to operate the game of chance within the selected county is the only permit or license required to operate the game of chance within the selected county and no other permits or licenses are required for jurisdictions or areas within the selected county. If the permit or license acquired or received by the organization from the select county to operate the game of chance within the selected county is the only permit or license required to operate the game of chance within the selected county and no other permits or licenses are required for jurisdictions or areas within the selected county, the permission is a "County-Wide" permission. If the organization has acquired or received a permit or license from the selected county to operate the game of chance within the selected county, the organization can enter the permit or license number. This information is comprised in a form or forms comprising form objects used to insert and store this information in a database.

To permit residences of a municipality to access and/or participate in a game of chance, the organization enters or selects the municipality to permit from an option list, menu, link listing, or any type of form object that will allow the user to make a selection or enter information. Next, the organization establishes if no permit or license is required to be acquired or received by the organization from the selected municipality to operate the game of chance within the selected municipality. If the organization has acquired or received a permit or license from the selected municipality to operate the game of chance within the selected municipality, the organization can enter the permit or license number. This information is comprised in a form or forms comprising form objects used to insert and store this information in a database.

To exclude a State, County, or Municipality the organization selects or enters the state, county, and/or municipality to exclude for the game of chance. This information is inserted into a database. The system does not allow duplicate entry of permitted, excluded, or restricted States, Counties, and/or Municipalities.

To navigate tiers of boundaries and regions, forms and form objects are used to provide option lists, link lists, or data entry fields. To add a state, a user selects a state. To add a county, a user selects a state and then selects a county within the selected state. To add a municipality, a user selects a state, then selects a county within the selected state, and then selects a municipality within the selected county. The same is true for adding areas to both the permission and exclusion lists for a game of chance.

To remove areas from either the permissions or exclusions for a game of chance, the user selects a remove or delete link or button that exists for each area listed in the permission or exclusion listings as described infra. This will remove the permission or exclusion criteria from a game of chance.

As described infra, the establishment of these permission and exclusion criteria, as described above, can be configured within the system by either an organization operating a game of chance, a system administrator, or regulators of games of chance. Although infra describes a preferred embodiment, the system is structured to enable the embodiments of infra as optional system configurations. Optional system configurations also enable permission, exclusion, or restriction capabilities to be directly configured by regulators as described infra.

Entering Raffle Information into the System Continued

Additional raffle information, as described infra, must be entered into the system. Raffle and drawing information comprising the raffle ticket sales Start Date, raffle ticket sales End Date, Drawing Date for the main raffle drawing, Drawing Time for the main raffle drawing, Drawing Location, drawing location address, as well as Raffle Rules, Shipping Information, additional raffle sponsors and affiliates, and Participating Ticket Sales Locations for offline ticket sales. This information is able to be provided prior to or after entering prize information, or provided prior to or after permission, exclusion, and restriction information.

The raffle ticket sales Start Date, raffle ticket sales End Date, Drawing Date for the raffle, and Drawing Time for the raffle establish the period of operation for the raffle. Upon activation the raffle will not be displayed or accessible to participants or visitors until the raffle ticket sales Start Date has been reached. The raffle will expire and raffle participation will no longer be available after the raffle ticket sales End Date has been surpassed. The Drawing Date and Drawing Time provide information to participants and visitors establishing when winners will be drawn or selected and the completion period for the raffle.

As described infra, ticket sales are able to occur through offline participation methods. The system has been developed to support offline ticket sales either independently or in conjunction with online ticket sales as described infra. In either case, offline ticket sales comprise providing participating ticket sales locations to visitors, users, or participants. Individuals are able to physically travel to these participating ticket sales locations or contact these participating ticket sales locations to purchase or request raffle tickets.

As described infra, if the organization has opted to offer offline or both online and offline ticket sales, the participating ticket sales locations will need to be entered into the system for a game of chance. As the information for each participating ticket sales location, as described infra, is entered into the system the locations appear in a participating ticket sales locations listing. The information for the participating sales locations is able to be edited or deleted from this listing.

Financial Reporting, Calculators, and Statistical Analysis of Prize, Drawing, and Raffle Information Financial tools and calculators enable an organization to analyze the profitability of a game of chance. These analytical tools establish Ticket Price, Ticket Count, and Additional Cost variables for a raffle, and calculate break even points and profitability. Organizations enter the desired Ticket Price, the desired Number of Tickets for Sale, and any Additional Costs that are budgeted or may be associated with the raffle. These values are inserted into the calculation variables along with stored variables from a database to generate a report comprising the results of these calculations. The reports and calculations comprise ticket count, ticket price, additional costs, estimated total ticket sales based on the ticket price and ticket count provided, total raffle prize costs from the cost of each prize for the raffle, estimated total fees including discount rates, transaction fees, licensing fees, merchant account fees, gateway fees, processing fees, and surcharges, estimated profitability for prize payouts, the estimated profitability for 50/50 type raffle conversion payouts, a listing of each prize with associated prize costs and totals for each drawing, total prize count for the raffle and each individual drawing, 50/50 reserve amount, beginning drawing prize budget, remaining drawing prize budget, profitability of each drawing, total prize cost for the raffle and each individual drawing, total estimated sales at ticket price and count for the raffle and each individual drawing where sales are reported from one drawing to the next, and the forecasted percentage sold. The system automatically reserves half, or fifty percent, of the expected sales revenue from each early bird drawing for the main drawing. This ensures that at least fifty percent of gross sales revenue will be available for the main drawing should the main drawing need to be converted to a 50/50 type raffle drawing due to a lack of ticket sales to meet raffle costs. Then the total estimated fees for conducting, operating, processing transactions, and licensing are subtracted from the remaining fifty percent to determine the beginning prize budget. This is the break even point for prize costs. Next the system subtracts the total cost of all the prizes for each individual drawing to determine the remaining drawing or prize budget. This is critical because only the main drawing can be converted to a 50/50 type raffle. If no more tickets are sold after an early bird drawing ticket sales amount has been reach, or not enough tickets are sold to cover the costs of the main raffle drawing, the organization is still responsible to conduct the main drawings. This is when a raffle is able to be converted to a 50/50 type raffle utilizing the reserved sales amount, 50/50 reserve, from each early bird drawing to conduct the main drawing. Early bird drawing information for early bird drawings with drawing dates, rather than early bird drawings with a drawing ticket sales amount, is listed as either zero or not available since each prize in an early bird drawing with a set drawing date can not have a cost greater than zero. The ticket sales amount for early bird drawings are the number of tickets that must be sold before an early bird drawing will be held. The early bird drawing date is a set date an early bird drawing will be held regardless of how many tickets have been sold. Since early bird drawings with a drawing date have a total prize cost of zero, there is no need to determine a prize cost budget. For prize groups comprising choice prizes where the winner will have a choice of one of multiple prizes, the system evaluates the costs of all of the prizes within the choice prize group and uses only the highest value within the prize group in cost calculations. If the estimated profits for either the main drawing or any early bird drawing with a drawing ticket sales amount are less than zero, the raffle can not be activated. The organization will need to change the ticket price, ticket sales amount, adjust additional costs, or edit prizes or drawings to make the raffle profitable to enable activation. In addition to the above financial analysis and reporting, an odds or statistical participation report is also generated and provided disclosing a participant's chances of winning drawings for a raffle as described infra. This enables organizations to determine the ticket price, number of ticket to offer for sale, number of prizes to offer, number and type of drawings to conduct, and evaluate raffle and prize costs to maximize participation and profitability.

A detailed raffle listing displays raffle information, as described infra, as it has been entered into the system by an organization. Raffle information can be edited, removed, or deleted from this detailed raffle listing. The listing comprises edit buttons or links which transverse various data entry pages, forms, and form objects that guide the organization through editing and removing or deleting information. Selecting these links or buttons enables organizations to access edit or delete sections which resemble the insert sections used to initially enter data and information into the system comprising the adding games of chance process.

Games of Chance Activation, Operation, and Management

Games of Chance are able to be activated by the organization operating the game of chance, an administrator of the system, a regulator of the jurisdiction governing the game of chance, or regulators of the jurisdictions governing permitted areas or participants of the game of chance.

In one embodiment, organizations submit a request for activation for a game of chance to a system administrator. A system administrator then activates the game of chance, which commences operation upon the specified raffle start date provided by the organization.

In a second embodiment, organizations activate their own games of chance which commence operation upon the specified raffle start date provided by the organization.

In a third embodiment, organizations submit a request for activation for a game of chance to a regulator of the jurisdiction governing the raffle. The regulator then activates the game of chance, which commences operation upon the specified raffle start date provided by the organization.

In a fourth embodiment, organizations submit a request for activation for a game of chance to each regulator of the jurisdiction governing the areas whose residence are permitted to participate. Each regulator then activates the raffle's operation for their given jurisdiction, which commences operation within each activated jurisdiction upon the specified raffle start date provided by the organization.

Activation as described infra are both preferred methods under current governing jurisdictional regulations and laws. Activation, as described infra, enables raffle information to be reviewed by a system administrator to provide technical assistance to ensure information as been entered properly. This review is not necessary, but is preferred to ensure organizations using the system for the first time have not made mistakes, and gives added comfort to users from a consultative perspective.

Upon activation of a raffle, the billing cycle and licensing payment periods are established as described infra. Upon activation, a notification is also sent to all member participants eligible to participate in the raffle that meet the criteria and conditions as described infra, and who have selected the option to receive notifications by subscribing to do so as described infra. This notification can comprise an automated email or any other form of communication which comprises raffle and participation information.

Upon activation of a raffle, raffle tickets and raffle ticket sequence numbering can occur as described infra. When a raffle is activated the system takes the maximum or targeted ticket sales number amount and creates a data record set for each ticket to be potentially sold a given raffle and gives each of these record sets a unique ticket sequence number starting with the number one and counting upwards in increments of one until the maximum number of tickets is reached.

In a preferred embodiment, ticket number sequencing is performed at the close of ticket sales as described infra. This is because a set number of maximum targeted ticket sales may not be required to be established. Although the description of the invention up until now has addressed a set number of tickets to be sold for each raffle, and methods of preventing selling tickets past a limited number of tickets as described infra, the organization may choose to offer an unlimited number of tickets for purchase up until the raffle end date has been surpassed. This is the same as an early bird drawing with a set drawing date, but is applied to the main drawing. Since there is no way of knowing how many tickets are to be sold or how many tickets will be sold by the close of ticket sales, it is preferred to sequence the tickets after the raffle end date has been surpassed, prior to printing or drawing the tickets.

In some cases, organizations may have begun the sale of raffle tickets or participation in a raffle prior to raffle activation. If a raffle has been configured by the organization as an online raffle where tickets are to be sold or participation accepted only online, pre-activation ticket sales and participation will need to be entered into the system prior to activation of the raffle. This is done using the manual ticket entry system as described infra. Access to the manual ticket entry system is determined by which embodiment of the raffle activation process is used as described infra. If a request for raffle activation is required, the organization may need to request manual ticket entry activation prior to requesting raffle activation. Upon activation of manual ticket entry, the sold ticket information or prior participation can be entered into the system. Then once all prior participation information for a raffle has been entered, the organization can request activation which will disable manual ticket entry in the case of a raffle designated for online ticket sales. In the case of raffles designated for offline ticket sales or both online and offline tickets, the manual ticket entry system may be enabled and accessible until the close of the raffle.

Raffle Status Levels and Phases

As raffle activation is discussed, raffles comprise various levels or phases of activity. As a raffle is first being added, edited, or entered into the system, the raffle is "pending." Next, if a request for activation has been issued, the raffle is "pending activation." Next, if the raffle comprises any ticket sales or participation that have been conducted prior to activation, for an online participation raffle, and a request for manual ticket entry has been issued, the raffle is "pending manual ticket entry." Next, if manual ticket entry for an online participation raffle has been activated, the raffle is in "manual ticket entry mode." Next, when a raffle is activated, the raffle is "active." Next, if the raffle is suspended, the raffle is "suspended." Next, if the raffle is sold out, the raffle is "sold out." Next, when the raffle has reached the scheduled raffle end date, the raffle is "ending today." Next, once the scheduled raffle end date has been surpassed, the raffle is "expired." Finally, after the drawings have been conducted, winners drawn, selected, and entered into the system, and the last winner has been entered into the system, the raffle is "archived." This information sets the grounds for raffle operation and management processes.

Raffle Management Listing

As raffles are entered into the system they are able to be managed from raffle management listings comprising raffles which exist for an organization. These listings comprise summary information for each raffle which exists within the system for an organization. Raffle management listings comprise links and buttons enabling users to transverse various raffle management sections for each individual raffle. These sections comprise direct linking, emailing participants, printing tickets, participation reports, raffle reports, manual ticket entry and viewing raffle information details from which raffles may be edited, deleted, or activated, and organizations may submit requests for manual ticket sales and raffle activation. These section are able to either stand alone as menu options where the menu option is first selected, and then the game of chance is selected for which to apply the section's functionality, or these sections are able to be listed as functional option links or buttons for each game of chance listed in the raffle management listing.

The direct linking section comprises a link generator for directly linking to raffles operated by an organization. This allows an organization to generate the code for the direct link as described infra. This section also comprises graphical images that are able to be included within the direct link code that allows the image to be clicked on to transverse the internet to access the system as described infra. Images are able to be replaced within the code at the discretion of the organization. The organization is able to upload its own images to the system and generate the direct link code comprising the new image information inserted into the code. This is then able to be provided to affiliates essential managing affiliate advertising of the organization's games of chance, or used by any entity to promote an organization's games of chance. The pages of this section comprise code generation and code copying links or buttons which when clicked on create and display, or copy, the direct link code.

The next section enables organizations to contact raffle participants. By selecting to transverse this section organizations are able to enter email information in to an email form that has been dynamically populated with the email addresses of all participants participating in a raffle operated by the organization. The organization is able to email all participants in all of the raffles operated by the organization, or participants in each individual raffle independently. In addition to contacting participants of a single raffle, organizations are able to email all participants that have participated in raffles operated by the organization. In both of these instances the email addresses dynamically populated into the email form are distinctly populated to ensure no duplicates receipts occur for the participants. The organization also has the option to print mailing labels in both of these cases. The organization is also able to print mailing label sheets that have been formatted to print on standard label paper directly from the user's browser, and that have been dynamically populated with participant contact information.

The next section enables organizations to print raffle tickets. Raffle tickets are able to be printed directly from a user's browser, and instructions are provided for configuring print settings and margins to properly format the print pages for printing raffle tickets.

In one embodiment, once these setting have been configured, the organization enters the first and last ticket numbers, ticket sequence numbers, or selects the print all tickets option to print the desired raffle tickets. The actual ticket number need not be entered, but rather the count numbers. For example, if the organization only wants to print the first two thousand tickets, the starting ticket number would be the number one and the ending ticket number would be the number two thousand. The system already knows the identifiers for the organization and the game of chance. When printing tickets the system sorts and orders the tickets by the unique identifiers of the tickets which will always be ordered in the database as they are entered and created in the database at the time of participation. These unique identifiers are then used to produce a count which essentially comprises the ticket sequence numbers giving the ticket a sequential count number from the number one to the last ticket in increments of one. The tickets are then formatted into a printable view comprising ticket information as described infra. These tickets are the drawing tickets used to conduct manual raffle drawings and select winners. Error handlers do not allow ending ticket numbers to be entered that exceed the number of tickets sold. An alternative is to use option lists that allow the organization to select a starting ticket number and an ending ticket number from a list of option. The maximum number in any one of these lists is the number of tickets sold.

In a second embodiment, the organization can provide a beginning ticket date and an ending ticket date instead of a starting ticket number and an ending ticket number to retrieve a group of tickets as described infra. Ticket dates are the dates tickets where purchased, created, or inserted in a database. This is the date the data record set for the ticket was created in a database and the date of participation. These dates also comprise time stamping. When retrieving the tickets for a specified time period, the system determines the sequence number of the first ticket produced on the starting date of the specified period, and then produces the count or sequence numbers, as described infra, up to the last ticket produced on the ending date for the specified period. This ensures correct and consistent ticket number sequencing.

In a third embodiment, the organization can provide a combination of ticket numbers or ticket dates. This will display ticket that either begin at a certain ticket count number and end on a certain date, or begin on a certain date and end at a certain ticket count number.

The next section is for participation reporting. Participation reporting enables organizations to view lists of information for raffle participation. Participation reports comprise participation analysis and participation information for game of chance. Participation analysis information summarizes participation and sales activity and comprises the maximum tickets available for sale or acquisition, number of tickets sold, number of remaining tickets, ticket price, total ticket sales, total prize costs, additional costs, total actual accrued fees, and other information as described infra. Participation information comprises additional details of participation by participant region, location, or residency. A listing is displayed comprising every state, county and municipality in which a participant resides and displays the number of participants in each state, county, and municipality, the total number of tickets purchased in each state, county, and municipality, and the percentage of tickets purchased by participants in each state, county, and municipality of the total tickets sold. The organization is able to select any of these states, counties, or municipalities to view a detailed report of participant information. The detailed participation report comprises the information described above as well as detailed listings of participants comprising the ticket holder's first name, last name, address, state, county, municipality, ZIP or postal code, telephone number, email address, and number of tickets purchase by the ticket holder, or participant, for the game of chance within the selected state, county, or municipality.

The next section comprises dynamically generated raffle reports. Raffle report information comprises a form or series of forms which enable the selection of specific raffle information and listing of form objects for the entry of additional information. Organizations select and/or enter information to be included in a report for a raffle which is able to be used or submitted for regulatory reporting. This information may comprise organization information as described infra, sponsor information as described infra, Participant information as described infra, raffle information as described infra, permission, exclusion, or restriction information as described infra, ticket information as described infra for games of chance participants, raffle prize information as described infra, financial analysis information as described infra, and ticket drawing and winner information as described infra. This information is structured and formatted into forms and form objects enabling organizations to select and enter the information desired to be included in a report. Once the organization has selected and entered the desired information, a dynamically populated report is able to be created by the system. The organization is then able to click on a link or button to display this custom report comprising the specified information. Once the report has been displayed, the report is able to be printed from the user's computer screen or browser window, or downloaded as a file to be saved or printed.

The next section is a raffle information display listing for viewing detailed raffle information as described infra. Viewing raffle information in this section displays detailed views of this information and provides formatting of this information as it is displayed to a user, visitor, or participant in FIG. 100, Node 101 the Games of Chance Interface in the game of chance detail view. This is the same display view as described infra. Prior to activation all of the information in this section is able to be edited and/or deleted by the organization, and comprises additional financial analysis information comprising estimated values as described infra. Once a raffle is activated, the system is able to automatically disable edit and deletion capabilities within this view and enables actual financial analysis of real data and values to replace estimated values, data, variables, and calculations, as described infra, as active game of chance operations commence. The only data an organization is able to edit at all times is the additional cost portion of the raffle information which may comprise ongoing expenditures, and the addition, deletion, or editing of raffle and/or prize sponsors which may also comprise ongoing sponsorship activities.

Manual Ticket Entry

The manual ticket entry system comprises methods and processes for handling ticket sold or participation that occurs through offline methods of participation. In order to utilize the full potential of the system and its sales, advertising, participation, and reporting capabilities, participants need to be entered into the system. This enables the system to report participation and raffle activity as well as enable participant notifications. In the case of raffles configured to operate online participation, manual ticket entry enables organizations that may have accrued participation offline prior to activating their online raffle, to enter pre-online participant to the system to maintain the integrity of the system and its reporting, as well as provide accurate participation information to users. This manual ticket entry system is able to be configured to be enabled or disabled by system administrators.

Manual ticket entry comprises entering participant information into forms and form objects, creating participant accounts or retrieving participant information from existing participant accounts, and generating participant raffle tickets for games of chance. Manual ticket entry enables organizations to enter information for tickets acquired or purchased offline by participants.

For manual ticket entry, organizations first determine if a participant already has a participant member account for the system. To determine if a participant is already a registered member, the organization enters the participant's email address into a search form field and searches a database of registered member participants for a matching email address. If the participant's account is found to exist, the participant's information is dynamically populated into a participation form comprising information as described infra. If the participant account is not found to exist, the organization is able to enter information into a participant registration form comprising information as described infra. In addition to this information the organization enters the number of tickets the participant has purchased or acquired offline to create online tickets for the participant. Next the information is submitted to the system. If the participant's account already exists, tickets are generated for the participant as described infra. If the participant's account does not already exist, a participant account is created as described infra, and the newly created account information is sent to the participant along with a temporary password for accessing their newly created participant account. Then tickets are generated for the new participant account as described infra. Participants who are already registered members will be able to access this information in their Participant Account Interface as they would any of their other participation information. Participants who are not already registered members may need to agree to the participant membership agreement and confirm their account information upon login in order to activate their participant membership account and access their Participant Membership Interface.

Ticket Drawings and Winner Selection

Once an active raffle has been sold out, is expired, or has reached an early bird drawing date or a specified early bird drawing ticket sales amount, organizations are able to print raffle tickets to conduct raffle drawings as described infra.

In a preferred embodiment, raffle tickets are printed and manually drawn by hand to determine winners of prizes. This is preferred because of public opinion having more trust for manual hand drawings over electronic methods of winner selection.

In a second embodiment, the system is able to randomly select winners for selected drawings. The organization accesses the raffle information listing, as described infra, for an active raffle that is sold out, expired, or comprises early bird drawings that have reached their drawing dates or drawing ticket sales count amounts. The organization then clicks on a link or button displayed for the drawing which will randomly select winning tickets and their ticket holders for each prize or prize group in a drawing.

When winners have been selected, ticket numbers, as described infra, are entered into a ticket entry form accessible from the raffle information listing, as described infra, by selecting the appropriate drawing prize or prize group for which the winning ticket has been drawn. The ticket number is entered into a ticket entry form and submitted to the system. The system retrieves the ticket holder's information, sets the ticket holder as the winner, notifies all participants a winner has been selected and who the winner is, and displays the selected winner in raffle listings as the winner for the appropriate prize or prize group. In the case of choice prize groups, the prize selected to be received by the winner is also selected as the winning ticket number is being submitted to the system for processing. In the case where a raffle is converted to a 50/50 type raffle, the system evaluates the existence of early bird drawings in the raffle. If a raffle comprises early bird drawings, the system calculates the prize amount by dividing half of the total ticket sales by the number of winners to be drawn. The number of winners to be drawn is determined by subtracting the number of winners drawn for completed early bird drawings from the total number of winners to be drawn for the raffle. If the raffle does not comprise early bird drawings, then the system calculates the prize amount by dividing half of the total ticket sales by the number of winners to be drawn. The system then sets the prizes to be won for each prize or prize group drawing to the 50/50 prize amount, which would replace advertised prizes.

The system also supports uploading, downloading, and streaming video feeds of drawings. The organization is able to upload a drawing video using an upload utility which places the video in a folder in a file system directory on a server accessible to users to view drawings. The system also has built in streaming video capabilities to display live drawings. These methods of media are accessible and viewable by participants in the Participant Account Interface.

The system also supports uploading photographic images of drawings. The organization is able to upload drawing images using an upload utility which places images in a folder in a file system directory on a server accessible to users to view drawings in the same manner logos and images are uploaded to the system for raffles, advertisements, membership registration, and membership accounts. These methods of media are accessible by participants in the Participant Account Interface.

Once all drawing have been completed and winners have been entered into the system, the raffle is able to be closed and archived. Once archived, organizations are able to view archived raffles, adjust additional cost information, print reports, and contact participants as described above.

FIG. 3, Node 204: Sponsor Directory Interface

The Sponsor Directory Interface is a mirror image of the Sponsor Directory Interface as described infra, which is accessible from the Organization Account Interface enabling organizations to search for sponsors for their raffles without having to log out of their Organization Account Interface.

FIG. 3, Node 205: Event Management Interface

The Event Management Interface enables organizations to manage their Event Interface as described infra. The Event Management Interface comprises a calendar, event form, event listings, and event registry.

The calendar comprises year, month, and date selection components that allow organization to select a specific date. The calendar also comprises browsing functions which enable an organization to browse backwards and forwards across months of a year and years to view dates. The calendar also comprises an add link or button to access an event form.

An event form is also displayed within the Event Management Interface. The event form enables organizations to enter event information as described infra. This form enables organizations to add and edit event information.

An event listing displays a listing of all scheduled events. From this listing, organizations are able to click on links or buttons to transverse event management tasks such as editing or delete event information, view the event registry, print attendance reports, and contact event registrants or attendees.

The event registry comprises listings of attendees registered to attend an event. This listing comprises attendee information as described infra. The registry is displayed in the form of an attendance sheet and event report comprising ticket sales information if applicable.

Organizations are able to contact attendees registered for an event via an email form that is dynamically populated with the email addresses of all registered attendees for a selected event. Organizations are also able to print mailing label sheets that have been formatted to print on standard label paper directly from a user's browser, and that have been dynamically populated with attendee contact information.

FIG. 3, Node 206: Regulator Directory Interface

The Regulator Directory Interface comprises regulatory listings and information for registered member regulators as described infra. In addition to this information, the contact information for Regulator Account Interface user, as described infra, and the jurisdictional regulatory information for games of chance, as described infra, are also listed and displayed.

Upon accessing the Regulator Directory Interface, a listing for the state, county, and municipal regulators for the jurisdiction governing the location of the organization is displayed. Organizations are able to select states, counties, and municipalities to view listings of registered member regulators. From these regulator listings, organizations are able to click on links or buttons to view regulatory contacts as described infra, regulatory information as described infra, and view or access regulator websites. Organizations are also able to access online permit and licensing applications for games of chance which are able to be either applied for online or downloaded.

FIG. 3, Node 207: Licensing Management Interface

The Licensing Management Interface is a segregation of infra. This enables the system to be configured to display licensing and billing information in an individual interface or control panel as the system continues to grow and require more space for merchant and licensing information which may need to be individually accessible.

FIG. 3, Node 208: Affiliate Management Interface

The Affiliate Management Interface enables organizations to operate and manage affiliate programs for the promotion of games of chance operated and managed by an organization. The Affiliate Management Interface comprises an Affiliate Program Configuration Interface and an Affiliate Program Merchant Interface. Through the Affiliate Program Configuration Interface, organizations are able to upload advertisement images to be used for the affiliate direct link, as described infra, and enter the affiliate referral fee as either a fixed amount of currency per ticket purchase or a percentage of the ticket price. Through the Affiliate Program Merchant Interface, organizations are able to view information for affiliates which have referred participation comprising affiliate information, as described infra, the number of total referred ticket sales for each game of chance, and the total amount of referral fees accumulated for each game of chance. Organizations are also able to view affiliate information for games of chance where organizations select a game of chance from games of chance listings to view affiliate information for a selected game of chance. Affiliate listings comprise each referring affiliate of a game of chance, the number of total referred ticket sales for each affiliate, and the total amount of referral fees accumulated for each affiliate of a selected game of chance. If an affiliate has established a merchant account, as described infra, the organization is able to submit electronic payment to the selected affiliate, otherwise the organization is able to submit payment to an affiliate utilizing other methods of payment.

FIG. 3, Node 209: Statistical Analysis Interface

The Statistical Analysis Interface comprises a statistical system summary comprising membership and games of chance information. Membership information is listed by National, State, County, and Municipal jurisdictional divides, and comprises the number of organizations, sponsors, advertisers, and participants registered as users of the system. Games of Chance information is listed by National, State, County, and Municipal jurisdictional divides, and comprises the number of games of chance pending, pending activation, active, sold out, and ending today. The statistical system summary information provides members with a summary of system activity and membership.

FIG. 1, Node 300 and FIG. 4: Sponsor Account Interface

The Sponsor Account Interface enables sponsors to sponsor games of chance, manage games of chance sponsorship, promote games of chance, manage sponsor account information, and acts as a control panel for sponsor interfaces and components.

FIG. 4, Node 301: Account Management Interface

The Account Management Interface comprises methods, processes, forms, and form objects for the management of sponsor information as described infra. Sponsors are able to edit their registration or membership information from this section, including uploading advertiser logos or images to a server.

The Account Management Interface also allows sponsors to add, edit or delete users of the Sponsor Account Interface for their entity, and assign access permissions to their users which determine which interface, or sections of interfaces, or components of the Sponsor Account Interface each user is able to access.

FIG. 4, Node 302: Sponsored Games of Chance Management Interface

The Sponsored Games of Chance Management Interface comprises listings of sponsored games of chance comprising organization information as described infra, and games of chance information as described infra.

The Sponsored Games of Chance Management Interface also comprises a direct linking section as described infra, only the sponsor version of direct linking replaces an organization's identifier with the sponsor's identifier and links to sponsored games of chance as described infra.

When sponsors are added to games of chance by organizations operating and managing games of chance, the sponsor receives advertising space within games of chance listings for sponsored games of chance. Sponsor advertising is displayed to users viewing games of chance listings, and sponsors are able to view the number of times an advertisement has been viewed by users, visitors, or participants, and the number of times users, visitors, or participants have clicked on the sponsor's advertisement. This information is provided as an advertising report. This advertising report comprises advertisement listings which comprise view and click information listed and displayed by date and time. View and click information may also comprise user, visitor, or participant State, County, and Municipality listings to provide sponsors with statistical marketing data. This data is also able to be viewed through marketing location reports which resemble games of chance participation reporting, as described infra, but rather than reporting games of chance participation, marketing location reports replace participation with view and click data for sponsor advertisements rather than games of chance. Availability of marketing location reports is dependant on system configurations and the embodiments which comprise these configurations. In a preferred embodiment, marketing location reports are available to sponsors.

FIG. 4, Node 303: Promotional Interface

The Promotional Interface component of the Sponsor Account Interface enables games of chance sponsors to target advertising, marketing, and promotions via direct access to participants participating in games of chance sponsored by the sponsor. As sponsors are listed for games of chance, these sponsors are able to email or print mailing labels enabling sponsors to send advertisements, promotions, coupons, discounts, and marketing materials to participants of their sponsored games of chance.

The Promotional Interface component of the Sponsor Account Interface also enables sponsors to send information to either all participants, or target participants by their State, County, and/or Municipality. Participants are able to receive this information via email, mail, or their Participant Account Interface as described infra.

FIG. 4, Node 304: Affiliate Program Management Interface

The Affiliate Program Management Interface is an extension of the Affiliate Account Interface, as described infra, which enables sponsors to become affiliates without the need to register as an affiliate member separately. This enables sponsors to participate in the promotion of games of chance without registering multiple accounts. Sponsors are automatically qualified to participate in the promotion of games of chance as an affiliate member.

FIG. 4, Node 305: Organization Directory Interface

The Organization Directory Interface is a mirror image of the Organization Directory Interface as described infra, which is accessible from accessible from the Sponsor Account Interface enabling sponsors to search for organizations and offer sponsorship without having to log out of their Sponsor Account Interface.

FIG. 4, Node 306: Statistical Analysis Interface

The Statistical Analysis Interface for the Sponsor Account Interface is identical to the Statistical Analysis Interface for the Organization Account Interface as described infra.

FIG. 1, Node 400 and FIG. 5: Participant Account Interface

The Participant Account Interface enables participants to participate in games of chance, manage games of chance participation, promote games of chance, manage participant account information, receive information from sponsors and advertisers, and acts as a control panel for participant interfaces and components.

FIG. 5, Node 401: Account Management Interface

The Account Management Interface comprises methods, processes, forms, and form objects for the management of participant information as described infra. Participants are able to edit their registration or membership information from this section.

The Account Management Interface comprises participant location and residency information such as the participant's State, County, Municipality, and Age, which comprises criteria or variables for the conditions for determining games of chance access and eligibility as described infra.

In a preferred embodiment, the participant's date of birth or age can not be edited or altered by the participant. The participant is required to provide their correct date of birth or age upon registration as described infra. Providing false or misleading participant information may restrict the participant from games of chance participation or disqualify a participant from claiming prizes for which the participant is the winning ticket holder. To edit or alter date of birth or age information, the participant will need to provide proof of their date of birth or age to a system administrator. For example, the participant may have made a typographical error when registering. The date of birth or age displayed in the Account Management Interface comprises an information change request component that generates a dynamically populated facsimile cover sheet comprising the participant's information and facsimile recipient information. The participant is able to submit the facsimile to the designated facsimile recipient accompanied by proof of the participant's date of birth or age. The designated facsimile recipient or a system administrator is able to make the necessary changes to the participant's date of birth or age information.

In an alternate embodiment, participants are able to edit or alter their date of birth or age. The method described infra is preferred due to the legal nature of games of chance participation.

FIG. 5, Node 402: Games of Chance Participation Management Interface

The Games of Chance Participation Management Interface enables participants to view and manage games of chance participation. The Games of Chance Participation Management Interface comprises participation information listings, displays, and components which enable participates to access games of chance information for games of chance the participant is currently participating in and games of chance the participant has previously participated in.

The component comprising a participant's current participation in games of chance comprises listings comprising games of chance information as described infra, organization information as described infra, and sponsor information as described infra for games of chance in which the participant is participating. These listings comprise links or buttons that enable the participant to transverse games of chance and participation information for selected games of chance. These listings also comprise access to the participant's raffle tickets for a game of chance, statistical analysis of participation for a game of chance, and the ability to continue to participate in the game of chance by attaining additional tickets or chances to win.

Participants are able to view and print their tickets for a game of chance as described infra. This enables participants which have lost their tickets, would like to print copies of their tickets, or were unable to print their ticket upon initial participation, to print their raffle tickets from the Participant Account Interface.

In addition to being able to print their tickets, participants are able to view statistical information regarding the participant's chances of winning a particular game of chance. This statistical information comprises the chance of winning if the maximum number of tickets are sold, the chance of winning at current ticket sales, the chance of winning if the maximum number of tickets are sold based on the number of tickets a participant purchased, and the chance of winning at current ticket sales based on the number of tickets a participant purchased. These statistics are comprised in various sets of data that transverse prize drawings. The calculations are determined by the maximum number of ticket offered for sale, the current number of tickets sold, the number of prizes being offered, the number of winning tickets to be drawn, the type of raffle structure whether single prize, choice prize, multiple prize, or mega prize, and the number of ticket purchased by the participant. This information is displayed in a dynamically generated report. This report includes information for all drawings to be held for a particular raffle including early bird drawings. Each drawing is listed separately along with a total for the entire raffle that may also comprise a running statistical analysis based on drawing activity. For example, a mega prize type raffle may have a main drawing and three early bird drawings. The statistical report will display information for the chances of winning each individual early bird drawing, the main drawing, and the raffle. The running statistical analysis changes as winners are drawn for each drawing until all winners are drawn. Once a winner has been drawn for a drawing or prize, participants no longer have a chance to win that particular drawing or prize, therefore the participant's chance of winning will change for the rest of the raffle drawings. Each individual raffle drawing may also comprise a running statistical analysis. The statistical report provides the most current information for a participant's chances of winning a game of chance for which they have entered, and takes into consideration how many tickets have been purchased, when the tickets have been purchase, and how many chances of winning still remain.

Participants are also able to view their participation history. As games of chance end and winners are drawn, participants in a game of chance are able to view all winners drawn for games of chance in which they have participated. The same is true for early bird drawings held for currently active raffles. Participants are able to track there participation, view winners, and print participation reports comprising information for their total participation in games of chance. Participants have the option to view or print complete reports, partial reports, reports between specified dates, individual games of chance participation reports, or a complete detailed report of all participation from the time the participant first became a registered member.

The Participant Account Interface also comprises direct link access to games of chance. Participant direct link access enables participants to access games of chance from the Participant Account Interface without initializing the participant's State, County, Municipality, or Age. Since the participant is already logged into the Participant Account Interface, the system already knows who the participant is by their identifier. The system uses the participant's identifier to retrieve the participant's State, County, Municipal and/or Age information which enables the system to bypass re-establishing this information and enables the participant to go directly to games of chance sections of the Games of Chance Interface. This comprises one click access to games of chance domains or games of chance listings and participation without requiring the participant to provide their State, County, and Municipality again.

FIG. 5, Node 403: Promotional Interface

The Promotional Interface comprises a searchable directory of promotions, coupons, and special offers for member participants from member sponsors and advertisers as described infra. Participant's are able to search these promotions, coupons, and special offers by entities, categories, or sub-categories as described infra which may be combined into a single search listing. Upon selecting the type of search to utilize, participants are able to access promotions, coupons, and special offer information as they are provided by sponsors or advertisers. This information comprises printable and/or instructional promotion, coupon, or special offer methods of redemption. Participants are also able to submit requests for information such as brochures, literature, or any other type of additional information to sponsors or advertisers. Participants are also able to specify contact or delivery methods for requested information.

FIG. 5, Node 404: Affiliate Program Management Interface

The Affiliate Program Management Interface is an extension of the Affiliate Account Interface, as described infra, which enables participants to become affiliates without the need to register as an affiliate member separately. This enables participants to participate in the promotion of games of chance without registering multiple accounts. Participants are still required to register to participate in the promotion of games of chance as an affiliate member as described infra. Affiliate membership registration is directly accessible from the Participant Account Interface without logging out of the Participant Account Interface, and registration forms are dynamically populated with the participant's information as described infra. The user is able to provide any additional information as described infra.

FIG. 5, Node 405: Statistical Analysis Interface

The Statistical Analysis Interface for the Participant Account Interface is identical to the Statistical Analysis Interface for the Organization Account Interface as described infra.

FIG. 1, Node 500 and FIG. 6: Advertiser Account Interface

The Advertiser Account Interface enables advertisers to operate and manage games of chance, manage advertiser account information, and acts as a control panel for advertiser interfaces and components.

FIG. 6, Node 501: Account Management Interface

The Account Management Interface comprises methods, processes, forms, and form objects for the management of advertiser information as described infra. Advertisers are able to edit their registration or member information from this section, including upload advertiser logos or images.

The Account Management Interface also allows advertisers to add, edit or delete users of the Advertiser Account Interface for their advertiser, and assign access permissions to their users which determine which interface, or sections of interfaces, or components of the Advertiser Account Interface each user is able to access.

FIG. 6, Node 502: Advertisement Management Interface

The Advertisement Management Interface enables advertisers to add, edit, delete, purchase, renew, and manage advertisements posted, displayed, or to be displayed in the Game of Chance Interface.

Advertisers begin the advertising process by entering advertisement information and uploading advertisements to the system. Examples of advertisement image sizes are available for acceptable advertisements. Advertisement information comprises the advertisement URLs, Alternate Text for the advertisement image, and the image path selected using the upload tool to retrieve the advertisement image from the advertiser's computer. The image of the advertisement is able to be uploaded to a server to be accessed by the system, or a URL is able to be provided which provides the URL path to a remote server where the image is stored. An additional URL provides the target URL link path to a website or web page to be viewed when an advertisement is clicked.

Next advertisers are able to target advertising areas. Advertisers are able to add, edit, and delete States, Counties, and/or Municipalities to target advertising areas. These areas are displayed in targeted advertising area listings for an advertisement. This information is compared to user, visitor, or participant State, County, and Municipality information to determine which advertisements are to be displayed, which comprise a match between user location and targeted advertising areas as described infra.

The Advertisement Management Interface also comprises an advertising fee calculator which calculates the advertising fees to be charged for advertisements. As each State, County, and/or Municipality is entered or removed from targeted advertising area listings for an advertisement, the advertising fee calculator displays the number of States, Counties, and/or Municipalities listed for an advertisement and the fees to be charged for the targeted States, Counties, and/or Municipalities, and the total fees to be charged for the advertisement. The advertiser is able to select or enter the advertising period for an advertisement. By default, the calculator comprises an advertising period of one month or thirty days. The advertising period is able to be determined by either selecting or entering the number of months the advertisement is to be displayed to users, visitors, or participants, or the advertiser is able to select or enter an advertising period start date and an advertising period end date. The calculator then recalculates the advertising fees to be charged upon changes to targeted advertising areas or advertising periods.

Next the advertiser selects a registered member organization from an Organization Directory as described infra. This determines the organization which will receive a donation which comprises a set amount or a percentage of the fees charged for an advertisement. Member organizations are eligible to receive these advertising donations as registered member users of the system, and beneficiary information is displayed along with advertisements as described infra. The organizations selected to receive these advertising fee donations are also listed within the Beneficiary Listing Interface as described infra.

Once a beneficiary organization has been selected, the advertiser is able to purchase the targeted advertising. The targeted advertising purchasing section comprises advertisement, targeted advertising areas, and advertiser information as described infra. The targeted advertising purchasing section also comprises a payment form enabling advertisers to make an electronic payment for their targeted advertising. The advertiser is not required to immediately purchase or pay for advertisements. Advertisements may remain as "pending." This enables advertisers to enter or edit advertising information at their convenience, and return to advertisement information through advertisement listings as described infra. Once an advertisement has been purchased, the advertisement is able to be activated.

In one embodiment, advertisements are activated automatically upon payment, and commences to be displayed upon activation or the scheduled advertising start date. Advertisements continue to be displayed until the specified advertising periods have expired.

In a second embodiment, advertisements are activated by a system administrator after payment has been made. Advertisements are "pending activation" until a system administrator activates the advertisement to be displayed. This enables system administrators to review advertising content to ensure an advertisement is appropriate for users, visitors, and participants. The advertising periods begin upon activation or scheduled advertising start dates. Advertisements continue to be displayed until the specified advertising periods have expired.

As advertisements are entered into the system they are able to be managed from advertisement management listings comprising advertisements which exist for the advertiser. These listings comprise summary information for each advertisement which exists within the system for an advertiser. Advertisement management listings comprise links and buttons enabling users to transverse various advertisement management sections for each individual advertisement. These sections comprise advertisement images, advertisement statistical information, links to detailed views of advertisement information, advertisement editing, advertisement deleting, advertisement reports, advertisement purchasing or payment, and advertisement renewal. These section are able to either stand alone as menu options where the menu option is first selected, and then the advertisement is selected for which to apply the section's functionality, or these sections are able to be listed as functional option links or buttons for each advertisement listed in an advertisement management listing.

Advertisement statistical information comprises advertisement views, clicks, view to click ratios and percentages, and statistical advertisement and display information. Advertisers are able to view the number times an advertisement has been viewed and clicked upon, the ratio of these views and clicks, statistical listings of view and click information for targeted States, Counties, and/or Municipalities, as well as access to advertising reports comprising advertising information for each advertisement and reporting on advertising activity.

Advertisers are able to edit and delete advertisements and view advertisement information details. Advertisers are able to edit information as described infra, or delete or remove advertisements.

Advertisers are able to purchase or make payment for advertisements which are pending. Once an advertisement has expired, advertisers are able to renew these advertisements without adding the advertisement to the system a second time. To purchase, make payment, or renew an advertisement, the advertiser is able to access the target marketing payment form as described infra.

FIG. 6, Node 503: Promotional Interface

The Promotional Interface component of the Advertiser Account Interface enables advertisers to target advertising, marketing, and promotions via direct access to participants with State, County and/or Municipal location or residency criteria matching the advertiser's targeted advertising locations as described infra. As advertisers advertise to users as described infra, these advertisers are able to email or print mailing labels enabling advertisers to send advertisements, promotions, coupons, discounts, and marketing materials to participants who are located or reside with States, Counties, and/or Municipalities matching the targeted areas or locations of an advertiser's active advertisements as described infra. Participants are able to receive this information via email, mail, or their Participant Account Interface as described infra.

FIG. 6, Node 504: Affiliate Program Management Interface

The Affiliate Program Management Interface is an extension of the Affiliate Account Interface, as described infra, that enables advertisers to become affiliates without the need to register as an affiliate member. This allows advertisers to participate in the promotion of games of chance without registering multiple accounts. Advertisers are automatically qualified to participate in the promotion of games of chance as an affiliate member.

FIG. 6, Node 505: Statistical Analysis Interface

The Statistical Analysis Interface for the Advertiser Account Interface is identical to the Statistical Analysis Interface for the Organization Account Interface as described infra.

FIG. 1, Node 600 and FIG. 7: Regulator Account Interface

The Regulator Account Interface enables regulators to regulate games of chance, manage regulator account information, and acts as a control panel for regulation interfaces and components. The Regulator Account Interface comprises Federal level, State level, County level, and Municipal level regulatory interfaces. These interfaces comprise identical interfaces and components which are limited to the specific jurisdictional level of each regulator and span each underlying jurisdiction level. The governing jurisdiction of a regulator is determined by current applicable statutes, laws, and regulations governing the regulation of games of chance, regulatory jurisdictions, and the jurisdictional level in which a regulator resides. As laws regarding jurisdictional governance over games of chance change, the system is able to be configured to enable these changes in regulatory practice.

In one embodiment, regulators are able to regulate games of chance operated by organizations located within the jurisdiction of the regulator.

In a second embodiment, regulators are able to regulate games of chance operated by organizations offering participation in games of chance to residences within the regulator's jurisdiction.

In a third embodiment, regulators are able to regulate games of chance operated by organizations located within the jurisdiction of the regulator, and regulators are able to regulate games of chance operated by organizations offering participation in games of chance to residences within the regulator's jurisdiction.

FIG. 7, Node 601: Federal Regulator Interface

The Federal Regulator Interface enables Federal level regulators to regulate games of chance operated in every State, County, and Municipality within federal jurisdiction.

FIG. 7, Node 602: State Regulator Interface

The State Regulator Interface enables State level regulators to regulate games of chance operated in the State of the regulator's jurisdiction and every County, and Municipality within a State's jurisdiction.

FIG. 7, Node 603: County Regulator Interface

The County Regulator Interface enables County level regulators to regulate games of chance operated in the County of the regulator's jurisdiction and every Municipality within a County's jurisdiction.

FIG. 7, Node 604: Municipal Regulator Interface

The Municipal Regulator Interface enables Municipal level regulators to regulate games of chance operated in a Municipality's jurisdiction.

FIG. 8, Node 606: Account Management Interface

The Account Management Interface comprises methods, processes, forms, and form objects for the management of regulator information as described infra. Regulators are able to edit their registration or membership information from this section, including uploading regulator logos or images to a server.

FIG. 8, Node 607: Account User Management Interface

The Account User Management Interface enables regulators to add, edit or delete users of the Regulator Account Interface for their entity, and assign access permissions to their users which determine which interface, or sections of interfaces, or components of the Regulator Account Interface each user is able to access.

FIG. 8, Node 608: Games of Chance Regulation Interface

The Games of Chance Regulation Interface enables regulators to monitor games of chance as determined by governing jurisdiction. The Games of Chance Regulation Interface comprises an Organization Directory Interface, as described infra, which is filtered dependant on the jurisdictional level of the regulator as described infra. Display results comprise games of chance information as described infra. Games of chance results comprise Raffle Status Levels and Phases as described infra. Games of chance information, as described infra, is able to be viewed for games of chance at all status levels and phases. The Games of Chance Regulation Interface also comprises a control panel view displaying a count of all games of chance listed by status levels and phases operating within the regulator's jurisdiction. These listings provide regulators with an overview of games of chance activity within their jurisdictions and enables regulators to view games of chance information, as described infra, for games of chance listed within each status level and/or phase.

The Games of Chance Regulation Interface enables regulators to enter ticket numbers, as described infra, into a participant ticket search form. Upon submission of this form, the system retrieves ticket holder information, as described infra, games of chance information as described infra, and ticket information as described infra.

FIG. 8, Node 609: Regulatory Reporting Interface

The Regulatory Reporting Interface comprises games of chance reporting, as described infra, for each game of chance operated within the regulators jurisdiction. A second reporting function enables regulators to generate activity reports between defined dates or within defined periods of time, which comprise games of chance activity within the regulator's jurisdiction.

FIG. 8, Node 610: Regulatory Management Interface

The Regulatory Management Interface enables regulators to configure regulatory requirements for their specific jurisdictions. Regulatory requirement information comprises the minimum required age for participation, games of chance permit and licensing requirements, games of chance permit and licensing application configurations, upload utilities or tools for uploading downloadable permit and licensing applications, required ticket text or notice information, permit and licensing fees for both games of chance and system licensing, and permission, exclusion, or restriction requirements if applicable dependant on system configuration.

The minimum age requirement for participation in games of chance is the minimum legal gaming age requirement for a regulator's jurisdiction.

Games of chance permit and licensing requirements establish whether a regulator requires organizations operating games of chance governed by the jurisdiction of a regulator to apply for a permit or license to operate a game of chance as governed by the regulator's jurisdiction.

Regulators are able to configure a standardized electronic permit or licensing application enabling organizations to apply for permits or licensing via the Organization Account Interface. Regulators are able to access a permit or licensing application control panel to review and either approve or deny permits and licenses. Upon approval, an automatically generated permit or license number is created comprising identifiers and assigned to the organization. These permit or license numbers are inserted into a database and dynamically populated into forms, form objects, code variables, and content as configured by the system. Then an approval notice is issued and sent to the applicant. If the application is denied, a denial notice is issued and sent to the applicant. Regulators are able to provide an explanation as to why a permit or license was denied within denial notice forms prior to submittal of denial notices.

Regulators are also able to upload a downloadable and printable permit and/or license applications which are able to be submitted to the regulator via postal service, facsimile, or other traditional methods of delivery.

Regulators are able to provide required text or notices which may be required to appear on tickets. For example, the State of New York may require the text or notice, "Ticket holders need not be present to win." This notice will be dynamically populated into tickets dependant on the governing jurisdictions of the games of chance as described infra.

Various regulators may charge licensing or other fees to either organizations operating games of chance or the entity offering the invention for use by organizations within the governing jurisdiction of a regulator, or both. Regulators are able to enter fee information as defined amounts of currency or percentages of ticket sales or licensing revenue.

Dependant on system configurations, regulators may also establish, define, and set the permission, exclusion, or restriction criteria for games of chance conditions as described infra.

FIG. 8, Node 611: Communication and Contact Management Interface

The Communication and Contact Management Interface enables regulators to contact or send communications via email to either a single organization or all organizations operating games of chance governed by the jurisdiction of a regulator, and either a single participant or all participants participating in a game of chance governed by the jurisdiction of a regulator.

FIG. 8, Node 612: Organization Directory Interface

The Organization Directory Interface is a mirror image of the Organization Directory Interface as described infra, only this interface is accessible from the Regulator Account Interface enabling regulators to search for organizations to without having to log out of their Regulator Account Interface.

FIG. 8, Node 613: Statistical Analysis Interface

The Statistical Analysis Interface for the Regulator Account Interface is identical to the Statistical Analysis Interface for the Organization Account Interface as described infra.

FIG. 1, Node 700 and FIG. 9: Affiliate Account Interface

The Affiliate Account Interface enables affiliates to promote games of chance, manage affiliate account information, and acts as a control panel for affiliate interfaces and components.

FIG. 9, Node 701: Account Management Interface

The Account Management Interface comprises methods, processes, forms, and form objects for the management of affiliate information as described infra. Affiliates are able to edit their registration or membership information from this section, including uploading advertiser logos or images to a server.

FIG. 9, Node 702: Affiliate Program Management Interface

The Affiliate Program Management Interface enables affiliates to promote games of chance operated by organizations. Affiliates place direct link code, as described infra, into the code of an affiliate's website creating a linked advertisement. An addition affiliate identifier is added to the direct link code to identify and track the source of the referring link. If a participant participates in a game of chance through a path originating from an affiliate direct link, the affiliate will earn an affiliate referral fee as described infra.

Affiliates are able to enter merchant account information as described infra. Alternatively, affiliates are also able to select other methods of payment to configure referral fee billing such as "pay by check," in which case organizations would send a check to an affiliate via postal service.

FIG. 9, Node 703: Statistical Analysis Interface

The Statistical Analysis Interface for the Affiliate Account Interface is identical to the Statistical Analysis Interface for the Organization Account Interface as described infra.

FIG. 1, Node 800: Account Manager Account Interface

The structure, methods, processes and apparatus of the Account Manager Account Interface are proprietary trade secrets and are not disclosed publicly.

FIG. 1, Node 900: System Administrator Account Interface

The structure, methods, processes and apparatus of the System Administrator Account Interface are proprietary trade secrets and are not disclosed publicly. The System Administrator Account Interface is an all encompassing interface comprising all of the interface components and functionality. In addition, the System Administrator is able to configure the entire system in a multitude of embodiments and establish configurations and settings for the system which controls the dynamic of the system. The system administrator is also able to input data and default information and setting into the system for this master interface.

Miscellaneous FIG. 2 Interfaces

FIG. 2, Node 106: Political Directory Interface

The Political Directory Interface comprises methods and processes for displaying information about the support of elected officials for the system and the organizations utilizing the system to build financial support through games of chance activity. The Political Directory Interface gives users the ability to view information for elected officials, contact information, letters of support, opinions, responses, and communications. Users are also able to visit the elected official websites when available.

FIG. 2, Node 107: Member Account Login Interface

The Member Account Login Interface comprises username and password protected account login for accessing user account interfaces. Users must be registered members and user accounts must be activated before a user can access their account. Users are also able to retrieve lost or forgotten password by providing or selecting their user account security question, and answering their user account security question, While all of the above embodiments describe combinations and distributions of methods and processes, those skilled in the art will realize that the functionality can be distributed over a plurality of methods and processes. The primary dependency of the system for operating and managing games of chance is as described infra. Although the system as a whole in the preferred embodiment focuses on raffles as the game of chance, the core of the system, as described infra, can be applied to determine user accessibility, eligibility, and participation for a plurality of conventional and non-conventional games of chance or lotteries. Other components of this invention comprise methods for providing input data to be used by processes and logical determinants as described infra, as well as methods to utilize user input, information, and data necessary to the processes, as described infra, to provided additional functionality. This invention comprises components and interfaces that create a centralized venue for gaming activity. Those skilled in the art will also realize that the functionality can be distributed over a plurality of computers, servers, internet service providers, domains, websites, and web pages. Distributing the functionality in such a manner which enable entities operating and managing games of chance to do so independently. Nothing in the system's architecture should be construed to limit methods, processes, and functionality to a single venue even though it is the preferred embodiment of the apparatus.

I claim:

1. An access authorization control system comprising a central server having or interconnected to (A) an input/display device (i) operated by a first user to allow the first user to enter the first user's age and the first user's residence to the central server, and (ii) provides the input/display device's location to the central server system;

(B) an activity interface having an activity database, the activity database has a list of activities, at least one activity on the list of activities is regulated by a government entity;

(C) the access authorization control system has Access Authorization Controls, the Access Authorization Controls limit the list of activities that the first user can access or view based on (a) the first user's (i) residence information is located in:

(a) a pre-approved Nation, (b) a pre-approved State, (c) a pre-approved County, (d) a pre-approved Municipality;

(e) a pre-approved Zip or Postal code or (f) combinations thereof, and (ii) age; and (b) the input/display device's location is located in the pre-approved Nation, the pre-approved State, the pre-approved County, the pre-approved Municipality; the pre-approved Zip or Postal code; or combinations thereof;

the central server system:

(I) confirms the age, residence and location, and an administrator's, requirements for each activity on the activity database;

(II) compares (a) first user's entered age information to (i) the minimum, and the administrator's, required age requirements to partake in each activity on the list of activities, and (ii) first user's age information found on a verification database interconnected to the central server; and (b) first user's entered residence information to (i) the residence, and the administrator's residence, requirements to partake in each activity on the list of activities, and (ii) first user's residence information on the verification database; and (c) input/display device's location to (i) the location, and the administrator's location, requirements to partake in each activity on the list of activities;

(III) transmits to the input/display device the limited list of activities when the first user's entered information satisfies (a) the age and residence requirements and the input/display device's location requirements for each activity identified on the limited list of activities and (b) the administrator's age, residence and location requirements for each activity identified on the limited list of activities;

wherein the Access Authorization Controls for jurisdictional regulatory compliance:

(a) allows or denies access authorization in real-time of one or more remote users;

(b) allows or denies access authorization in real-time, and verifies user's device location data and residency data of one or more remote users;

(c) allows or denies access authorization in real-time, and verifies user device location data of one or more remote users;

(d) allows or denies access authorization in real-time, and verifies user residency data of one or more remote users; and (e) enabling the internet to be regulated in real-time in relation to one or more remote users using the internet to partake in an activity identified on the limited list of activities.

2. The system of claim 1 further comprising the steps, when the (A) first user's entered age information is equal to (i) or exceeds the minimum required age, and the administrator's minimum required age, to partake in each activity identified on the limited list of activities, and (ii) the first user's age information found on the verification database;

(B) first user's entered residence information is (i) within the residence requirements, and the administrator's residence requirements, to partake in each activity identified on the limited list of activities, and (ii) the first user's residence information found on the verification database; and (C) input/display device's location is within (i) the location requirements, and the administrator's location requirements, to partake in each activity identified on the limited list of activities, are met, then the system comprises the further steps of:

allowing the first user to select at least one activity from the limited list of activities that the first user can access;

initiating payment instructions from the first user to have the payment system pay for the selected activity; and permitting the first user to partake in the selected activity.

3. The system of claim 1 wherein the first user's entered residence information is the first user's street address, the first user's state, the first user's county, the first user's country, first user's municipality, the first user's zip code, the first user's telephone number, or combinations thereof.

4. The system of claim 1 wherein the first user's entered residence information is the first user's zip code.

5. The system of claim 1 wherein the first user's entered residence information is the first user's country, state, county, municipality identifiers, jurisdictional data, or combinations thereof.

6. The system of claim 1 wherein the first user's device location data is transformed into zip code information, municipality information, county information, state information, country information, jurisdictional information, or combinations thereof.

7. The system of claim 2 wherein the selected activity is a game of chance.

8. The system of claim 1 wherein the at least one activity is a game of chance.

9. An access authorization control system comprising a central server having or interconnected to (A) an input/display device operated by a first user to allow the first user to enter the first user's age and the first user's residence to the central server;

(B) an activity interface having an activity database, the activity database has a list of activities, at least one activity on the list of activities is regulated by a government entity (C) the access authorization control system has Access Authorization Controls, the Access Authorization Controls limit the list of activities that the first user can access or view based on the first user's residence information is located in:

(a) a pre-approved Nation, (b) a pre-approved State, (c) a pre-approved County, (d) a pre-approved Municipality;

(e) a pre-approved Zip or Postal code or
(f) combinations thereof, and
age;
the central server system:
(I) confirms the age and residence, and an administrator's, requirements for each activity on the activity database;
(II) compares
(a) first user's entered age information to
(i) the minimum, and the administrator's, required age requirements to partake in each activity on the list of activities, and
(ii) first user's age information found on a verification database interconnected to the central server; and
(b) first user's entered residence information to
(i) the residence, and the administrator's residence, requirements to partake in each activity on the list of activities, and
(ii) first user's residence information on the verification database;
(III) transmits to the input/display device the limited list of activities when the first user's entered information satisfies
(a) the age and residence requirements for each activity identified on the limited list of activities and
(b) the administrator's age and residence requirements for each activity identified on the limited list of activities;
wherein the Access Authorization Controls for jurisdictional regulatory compliance:
(a) allows or denies access authorization in real-time of one or more remote users;
(b) allows or denies access authorization in real-time, and verifies user residency data of one or more remote users; and
(c) enabling the internet to be regulated in real-time in relation to one or more remote users using the internet to partake in an activity identified on the limited list of activities.

10. The system of claim 9 further comprising the steps, when the
(A) first user's entered age information is equal to
(i) or exceeds the minimum required age, and the administrator's minimum required age, to partake in each activity identified on the limited list of activities, and
(ii) the first user's age information found on the verification database; and
(B) first user's entered residence information is
(i) within the residence requirements, and the administrator's residence requirements, to partake in each activity identified on the limited list of activities, and
(ii) the first user's residence information found on the verification database;
are met, then the system comprises the further steps of:
allowing the first user to select at least one activity from the limited list of activities that the first user can access;
initiating payment instructions from the first user to have the payment system pay for the selected activity; and
permitting the first user to partake in the selected activity.

11. The system of claim 9 wherein the first user's entered residence information is the first user's street address, the first user's state, the first user's county, the first user's country, first user's municipality, the first user's zip code, the first user's telephone number, or combinations thereof.

12. The system of claim 9 wherein the first user's entered residence information is the first user's zip code.

13. The system of claim 9 wherein the first user's entered residence information is the first user's country, state, county, municipality identifiers, jurisdictional data, or combinations thereof.

14. The system of claim 10 wherein the selected activity is a game of chance.

15. The system of claim 9 wherein the at least one activity is a game of chance.

16. An access authorization control system comprising a central server having or interconnected to
(A) an input/display device (i) operated by a first user to allow the first user to enter the first user's residence to the central server, and (ii) provides the input/display device's location to the central server system;
(B) an activity interface having an activity database, the activity database has a list of activities, at least one activity on the list of activities is regulated by a government entity;
(C) the access authorization control system has Access Authorization Controls, the Access Authorization Controls limit the list of activities that the first user can access or view based on (a) the first user's residence information is located in:
(i) a pre-approved Nation,
(ii) a pre-approved State,
(iii) a pre-approved County,
(iv) a pre-approved Municipality;
(v) a pre-approved Zip or Postal code, or
(vi) combinations thereof; and
(b) the input/display device's location is located in the pre-approved Nation, the pre-approved State, the pre-approved County, the pre-approved Municipality; the pre-approved Zip or Postal code; or combinations thereof;
the central server system:
(I) confirms the residence and location, and an administrator's, requirements for each activity on the activity database;
(II) compares
(a) first user's entered residence information to
(i) the residence, and the administrator's residence, requirements to partake in each activity on the list of activities, and
(ii) first user's residence information on a verification database; and
(b) input/display device's location to
(i) the location, and the administrator's location, requirements to partake in each activity on the list of activities;
(III) transmits to the input/display device the limited list of activities when the first user's entered information satisfies
(a) the residence requirement and the input/display device's location requirements for each activity identified on the limited list of activities and
(b) the administrator's residence and location requirements for each activity identified on the limited list of activities;
wherein the Access Authorization Controls for jurisdictional regulatory compliance:
(a) allows or denies access authorization in real-time of one or more remote users;
(b) allows or denies access authorization in real-time, and verifies user's device location data and residency data of one or more remote users;
(c) allows or denies access authorization in real-time, and verifies user device location data of one or more remote users;

(d) allows or denies access authorization in real-time, and verifies user residency data of one or more remote users; and (e) enabling the internet to be regulated in real-time in relation to one or more remote users using the internet to partake in an activity identified on the limited list of activities.

17. The system of claim 16 further comprising the steps, when the (A) first user's entered residence information is (i) within the residence requirements, and the administrator's residence requirements, to partake in each activity identified on the limited list of activities, and (ii) the first user's residence information found on the verification database; and (B) input/display device's location is within (i) the location requirements, and the administrator's location requirements, to partake in each activity identified on the limited list of activities, are met, then the system comprises the further steps of:

allowing the first user to select at least one activity from the limited list of activities that the first user can access;

initiating payment instructions from the first user to have the payment system pay for the selected activity; and permitting the first user to partake in the selected activity.

18. The system of claim 16 wherein the first user's entered residence information is the first user's street address, the first user's state, the first user's county, the first user's country, first user's municipality, the first user's zip code, the first user's telephone number, or combinations thereof.

19. The system of claim 16 wherein the first user's entered residence information is the first user's zip code.

20. The system of claim 16 wherein the first user's entered residence information is the first user's country, state, county, municipality identifiers, jurisdictional data, or combinations thereof.

21. The system of claim 16 wherein the first user's device location data is transformed into zip code information, municipality information, county information, state information, country information, jurisdictional information, or combinations thereof.

22. The system of claim 17 wherein the selected activity is a game of chance.

23. The system of claim 16 wherein the at least one activity is a game of chance.

24. An access authorization control system comprising a central server having or interconnected to (A) an input/display device (i) operated by a first user to allow the first user to enter the first user's age to the central server, and (ii) provides the input/display device's location to the central server system;

(B) an activity interface having an activity database, the activity database has a list of activities, at least one activity on the list of activities is regulated by a government entity;

(C) the access authorization control system has Access Authorization Controls, the Access Authorization Controls limit the list of activities that the first user can access or view based on the first user's age and the input/display device's location is located in a pre-approved Nation, a pre-approved State, a pre-approved County, a pre-approved Municipality; a pre-approved Zip or Postal code; or combinations thereof;

the central server system:

(I) confirms the age and location, and an administrator's, requirements for each activity on the activity database;

(II) compares (a) first user's entered age information to (i) the minimum, and the administrator's, required age requirements to partake in each activity on the list of activities, and (ii) first user's age information found on a verification database interconnected to the central server; and (b) input/display device's location to (i) the location, and the administrator's location, requirements to partake in each activity on the list of activities;

(III) transmits to the input/display device the limited list of activities when the first user's entered information satisfies (a) the age requirement and the input/display device's location requirements for each activity identified on the limited list of activities and (b) the administrator's age and location requirements for each activity identified on the limited list of activities;

wherein the Access Authorization Controls for jurisdictional regulatory compliance:

(a) allows or denies access authorization in real-time of one or more remote users;

(b) allows or denies access authorization in real-time, and verifies user device location data of one or more remote users; and (e) enabling the internet to be regulated in real-time in relation to one or more remote users using the internet to partake in an activity identified on the limited list of activities.

25. The system of claim 24 further comprising the steps, when the (A) first user's entered age information is equal to (i) or exceeds the minimum required age, and the administrator's minimum required age, to partake in each activity identified on the limited list of activities, and (ii) the first user's age information found on the verification database; and (B) input/display device's location is within (i) the location requirements, and the administrator's location requirements, to partake in each activity identified on the limited list of activities, are met, then the system comprises the further steps of:

allowing the first user to select at least one activity from the limited list of activities that the first user can access;

initiating payment instructions from the first user to have the payment system pay for the selected activity; and permitting the first user to partake in the selected activity.

26. The system of claim 24 wherein the first user's device location data is transformed into zip code information, municipality information, county information, state information, country information, jurisdictional information, or combinations thereof.

27. The system of claim 25 wherein the selected activity is a game of chance.

28. The system of claim 24 wherein the at least one activity is a game of chance.

* * * * *